US010471675B2

(12) United States Patent
Woodman

(10) Patent No.: US 10,471,675 B2
(45) Date of Patent: Nov. 12, 2019

(54) METHOD OF FORMING A FOLDABLE BACKDROP AND A FOLDABLE BACKDROP

(71) Applicant: Brian Woodman, Victoria (CA)

(72) Inventor: Brian Woodman, Victoria (CA)

( * ) Notice: Subject to any disclaimer, the term of this patent is extended or adjusted under 35 U.S.C. 154(b) by 0 days.

(21) Appl. No.: 16/082,961

(22) PCT Filed: Mar. 13, 2017

(86) PCT No.: PCT/CA2017/050329

§ 371 (c)(1),
(2) Date: Sep. 7, 2018

(87) PCT Pub. No.: WO2017/161444

PCT Pub. Date: Sep. 28, 2017

(65) Prior Publication Data

US 2019/0091960 A1 Mar. 28, 2019

(30) Foreign Application Priority Data

Mar. 22, 2016 (CA) ..... 2924560

(51) Int. Cl.

| | |
|---|---|
| ***B31D 5/04*** | (2017.01) |
| ***B31B 70/26*** | (2017.01) |
| ***A47G 1/14*** | (2006.01) |
| ***A63H 33/16*** | (2006.01) |

(Continued)

(52) U.S. Cl.

CPC ..... *B31D 5/04* (2013.01); *A47G 1/141* (2013.01); *A63H 33/16* (2013.01); *A63J 1/02* (2013.01); *B31B 70/26* (2017.08); *G09F 1/06* (2013.01); *B31D 2205/00* (2013.01)

(58) Field of Classification Search

CPC ..... B31D 5/04; B31D 2205/00; B31B 70/26; A47G 1/141; G09F 1/06

See application file for complete search history.

(56) References Cited

U.S. PATENT DOCUMENTS 1,519,193 A * 12/1924 Dietsche, Jr. ..... G09F 1/06 40/124.07
1,638,177 A * 8/1927 Viscount ..... G09F 1/06 40/124.09

(Continued)

FOREIGN PATENT DOCUMENTS

CN 1820935 A 8/2006
EP 1 140 520 B1 10/2001

OTHER PUBLICATIONS

International Search Report Corresponding to PCT/CA2017/050329 dated May 17, 2017.

(Continued)

*Primary Examiner* — Gary C Hoge
(74) *Attorney, Agent, or Firm* — Davis & Bujold PLLC; Michael J. Bujold

(57) ABSTRACT

A method of forming a foldable backdrop through a series of folds placed in a single sheet of foldable material selected for the backdrop. When the final step is taken of pushing a first bottom corner of the sheet under a first mountain fold and pushing a second bottom corner of the sheet under a second mountain fold, a base is formed out of a bottom half of the sheet. A tension in the sheet will force the top half of the sheet into a vertical position perpendicular to the base.

19 Claims, 47 Drawing Sheets

(51) Int. Cl.
*A63J 1/02* (2006.01)
*G09F 1/06* (2006.01)

(56) References Cited

U.S. PATENT DOCUMENTS 2,099,420 A * 11/1937 Cloud ..... G09F 1/06 40/539
2,360,681 A * 10/1944 Hulme ..... A47G 1/141 248/459
3,273,272 A * 9/1966 Paige ..... A47F 5/112 40/124.16
3,733,765 A 5/1973 Bartels
3,899,168 A 8/1975 Besherse
3,961,426 A 6/1976 Wallace
4,330,102 A 5/1982 Gebhardt et al.
4,910,899 A 3/1990 Alperin
4,917,405 A * 4/1990 Muth ..... B31F 1/0006 281/5
5,809,673 A 9/1998 Johnson et al.
5,842,630 A 12/1998 Remer
D407,663 S 4/1999 MacDonald
7,219,871 B2 5/2007 Hecker
8,545,286 B2 10/2013 Coleman
8,588,953 B2 11/2013 Kling
2009/0300952 A1* 12/2009 Hayes ..... B42D 15/042 40/124.07
2015/0052788 A1* 2/2015 Juetten ..... B42D 15/022 40/124.09
2015/0251373 A1 9/2015 Hasegawa

OTHER PUBLICATIONS

Written Opinion Corresponding to PCT/CA2017/050329 dated May 17, 2017.

* cited by examiner

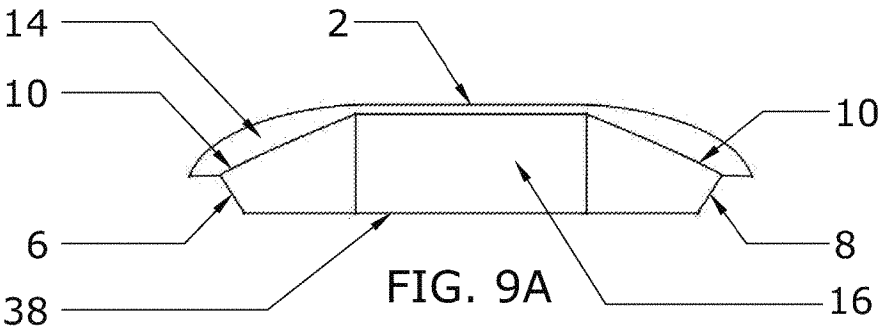
FIG. 9A
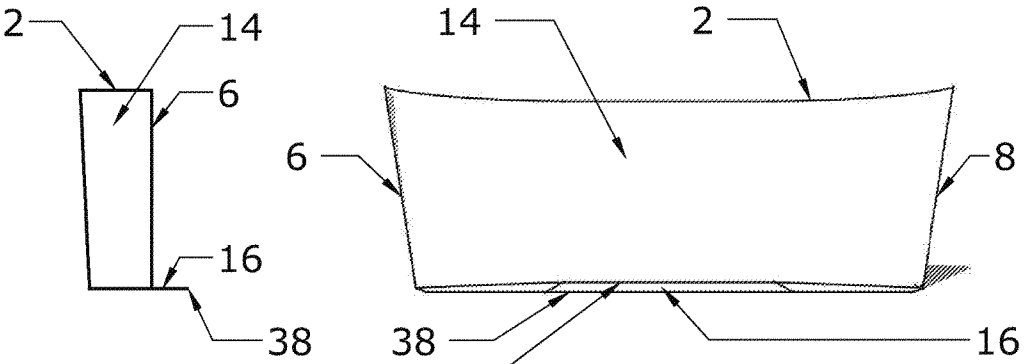
FIG. 9C
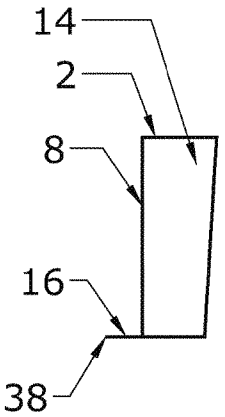
FIG. 9D
FIG. 9B

METHOD OF FORMING A FOLDABLE BACKDROP AND A FOLDABLE BACKDROP

FIELD

The present invention relates to a method of folding a single flat planar material such as paper to form a free-standing, adjustable curved backdrop or background. The method was developed for use in displaying model cars and model figurines, but could be applied on a larger scale to anything from merchandising displays to theatre backdrops.

BACKGROUND

There have been prior instances in which folding processes have been used. An example of a folding process that used origami-like techniques to produce a three-dimensional structure is U.S. Pat. No. 8,545,286 B2 (Coleman) entitled "FOLDING PATTERN". An example of a folding process that used origami-like techniques to produce a three-dimensional pyramid-shaped structure is U.S. Pat. No. 5,842,630 (Remer) entitled "STRUCTURE FORMED OF A SINGLE SHEET OF FOLDABLE MATERIAL FOR CONTAINING THREE DIMENSIONAL OBJECTS". An example of a folded material that produces a three-dimensional backdrop structure is U.S. Pat. No. 5,809,673 (Johnson et al.) entitled "POP-UP DISPLAY DEVICE". An example of a folded material that produces a three-dimensional backdrop structure for displaying photographs and other imagery is European Patent EP 1 140 520 B1 (Mackenzie) entitled "DIORAMA/STAND-UP PICTURE CARD". An example of a curved material that produces a three-dimensional ornament is U.S. Pat. Des. 407,663 (MacDonald) entitled "ORNAMENT". An example of a three-piece curved material that produces a three-dimensional pop-up magazine insert that converts to a stand-alone display is U.S. Pat. Des. 4,910,899 (Alperin) entitled "POP-UP". An example of a folded merchandising display with a base and vertical panel is U.S. Pat. No. 4,330,102 (Gebhardt et al.) entitled "MERCHANDISING DISPLAY". An example of a folded easel display holder is U.S. Pat. No. 7,219,871 B2 (Hecker) entitled "PYRAMID EASEL".

SUMMARY

According to one aspect there is provided a method of forming a foldable backdrop. A step is taken of forming a centrally positioned crease horizontally across a single sheet of foldable material selected for the backdrop, the sheet having a top edge, a bottom edge, a first side edge and a second side edge. The crease symmetrically divides the sheet into a top half and a bottom half. A step is taken of forming a first mountain fold in the bottom half of the sheet spaced from the first side edge. The first mountain fold extends from the bottom edge to the crease. A step is taken of forming a second mountain fold in the bottom half of the sheet spaced from the second side edge. The second mountain fold extends from the bottom edge to the crease. A step is taken of forming a first valley fold from a first pivot point at the confluence of the crease and the first mountain fold to one of a first side edge, a bottom edge spaced inwardly from the first side edge or a first bottom corner of the sheet where the first side edge meets the bottom edge. A step is taken of forming a second valley fold from a second pivot point at the confluence of the crease and the second mountain fold to one of a second side edge, a bottom edge spaced inwardly from the second side edge or a second bottom corner of the sheet where the second side edge meets the bottom edge. A step is taken of pushing the first bottom corner of the sheet under the first mountain fold and pushing the second bottom corner of the sheet under the second mountain fold to form a base. A tension in the sheet will force the top half of the sheet into a vertical position perpendicular to the base.

According to another aspect there is provided a foldable backdrop. The foldable backdrop has a centrally positioned crease horizontally across a single sheet of foldable material selected for the backdrop, the sheet having a top edge, a bottom edge, a first side edge and a second side edge. The crease symmetrically divides the sheet into a top half and a bottom half. The foldable backdrop has a first mountain fold in the bottom half of the sheet spaced from the first side edge. The first mountain fold extends from the bottom edge to the crease. The foldable backdrop has a second mountain fold in the bottom half of the sheet spaced from the second side edge. The second mountain fold extends from the bottom edge to the crease and is perpendicular to the crease. The foldable backdrop has a first valley fold from a first pivot point at the confluence of the crease and the first mountain fold to one of a first side edge, a bottom edge spaced inwardly from the first side edge or a first bottom corner of the sheet where the first side edge meets the bottom edge. The foldable backdrop has a second valley fold from a second pivot point at the confluence of the crease and the second mountain fold one of a second side edge, a bottom edge spaced inwardly from the second side edge or a second bottom corner of the sheet where the second side edge meets the bottom edge. The first bottom corner of the sheet is positioned under the first mountain fold and the second bottom corner of the sheet is positioned under the second mountain fold to form a base. A tension in the sheet will force the top half of the sheet into a vertical position perpendicular to the base.

Modifications will hereinafter be described. In the preferred version of the backdrop, the first mountain fold and the second mountain fold are perpendicular to the crease. As will hereinafter be described under variations, the first mountain fold and the second mountain fold do not have to be perpendicular to the crease.

In the preferred version of the backdrop, the first valley fold extends from the first pivot point to the first bottom corner and the second valley fold extends from the second pivot point to the second bottom corner. As will hereinafter be described under variations, by selecting the orientation of the valley fold one can modify the backdrop. In one variation has the first valley fold extends from the first pivot point to the first side edge and the second valley fold extends from the second pivot point to the second side edge. In another variation, the first valley fold extends from the first pivot point to the bottom edge spaced inwardly from the first side edge and the second valley fold extends from the second pivot point to the bottom edge spaced inwardly from second side edge.

In the preferred version of the backdrop, the top half of the sheet has no folds and forms a curved backdrop. As will hereinafter be described under variations, by having a valley fold extend from the first mountain fold across the top half of the sheet to the top edge and an additional valley fold extend from the second mountain fold across the top half of the sheet to the top edge, one is able to define backdrop panels.

In the preferred version of the backdrop, the base is of a proportionate size and has not legs. As will hereinafter be described under variations, a depth of the base may be lessened by mountain-folding a portion of the base underneath and by adding a series of folds the base may be elevated with depending legs.

Under variations there is also described the linking of one sheet to another sheet by an interlocking fold positioned along one of the first side edge or the second side edge.

In the preferred version of the backdrop, the sheet has no side folds. As will hereinafter be described under variations, by having parallel mountain folds extend along both side edges from the top edge of the sheet to the bottom edge of the sheet, one is able to provide a reinforcing or stiffening structure to the vertical sides of the backdrop.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 9A is a top view of FIG. 8.

FIG. 9B is a left elevation view of FIG. 8.

FIG. 9C is a front elevation view of FIG. 8 slightly shaded to emphasise the three-dimensional structure of the completed backdrop.

FIG. 9D is a right elevation view of FIG. 8.

DETAILED DESCRIPTION

A foldable backdrop and method of making the same will now be described with reference to FIG. 1 through FIG. 10, with variations described in FIG. 11 through FIG. 47.

Figure 1:
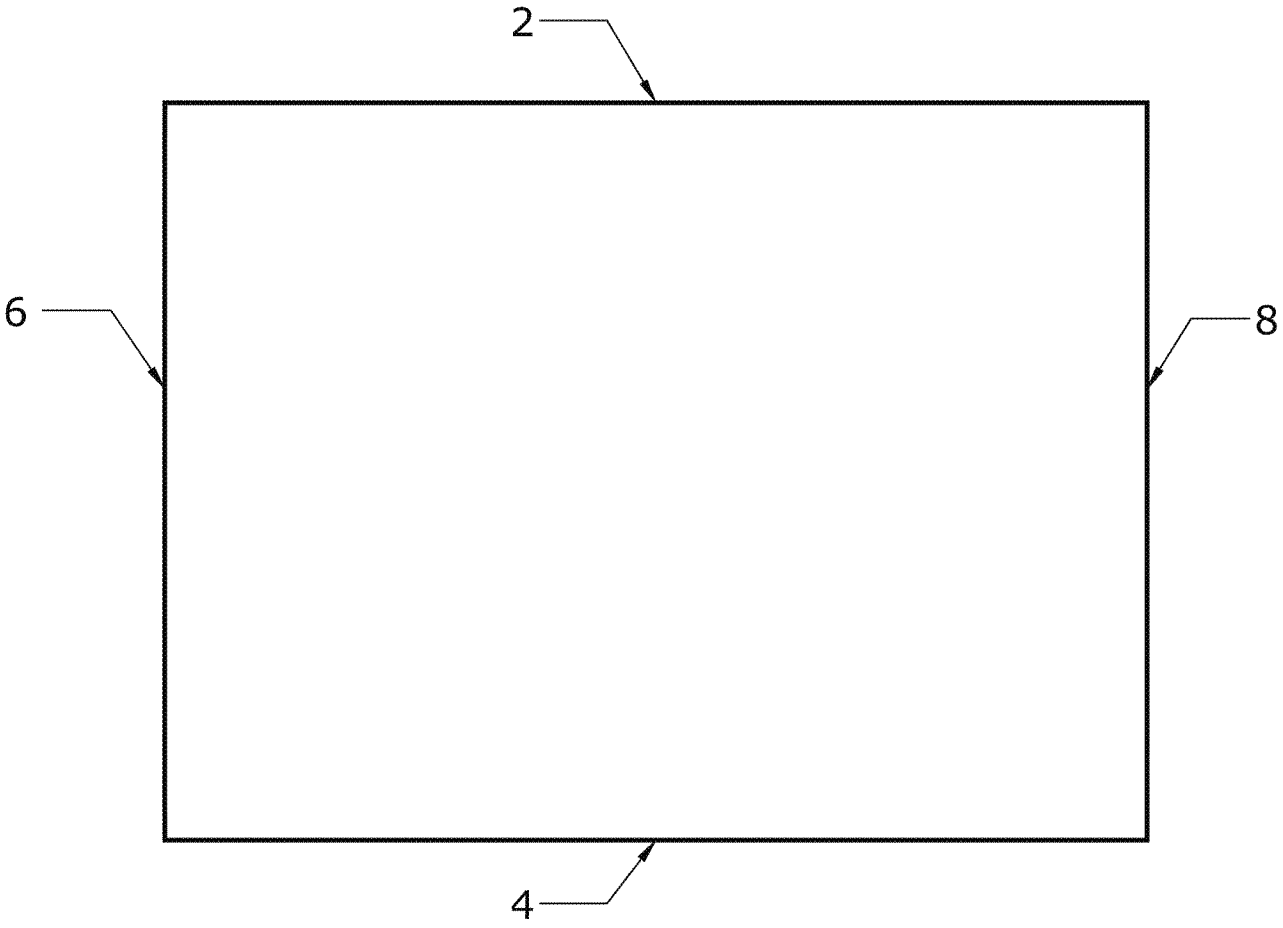
FIG. 1 is a top plan view of a single sheet of foldable material such as paper, shown in landscape orientation.

Structure and Relationship of Parts:

FIG. 1 is a top plan view of a sheet of foldable material such as paper, shown in landscape orientation, the sheet having a top edge (2), a bottom edge (4), a first side edge on the left (6) and a second side edge on the right (8). The aspect ratio (the relationship of the lengths of the width vs. the height of the material) can be any ratio, though typically the material will be of a standard size using ISO, ANSI or Architectural standards. The sheet depicted has an aspect ratio of 3:4.

Figure 2:
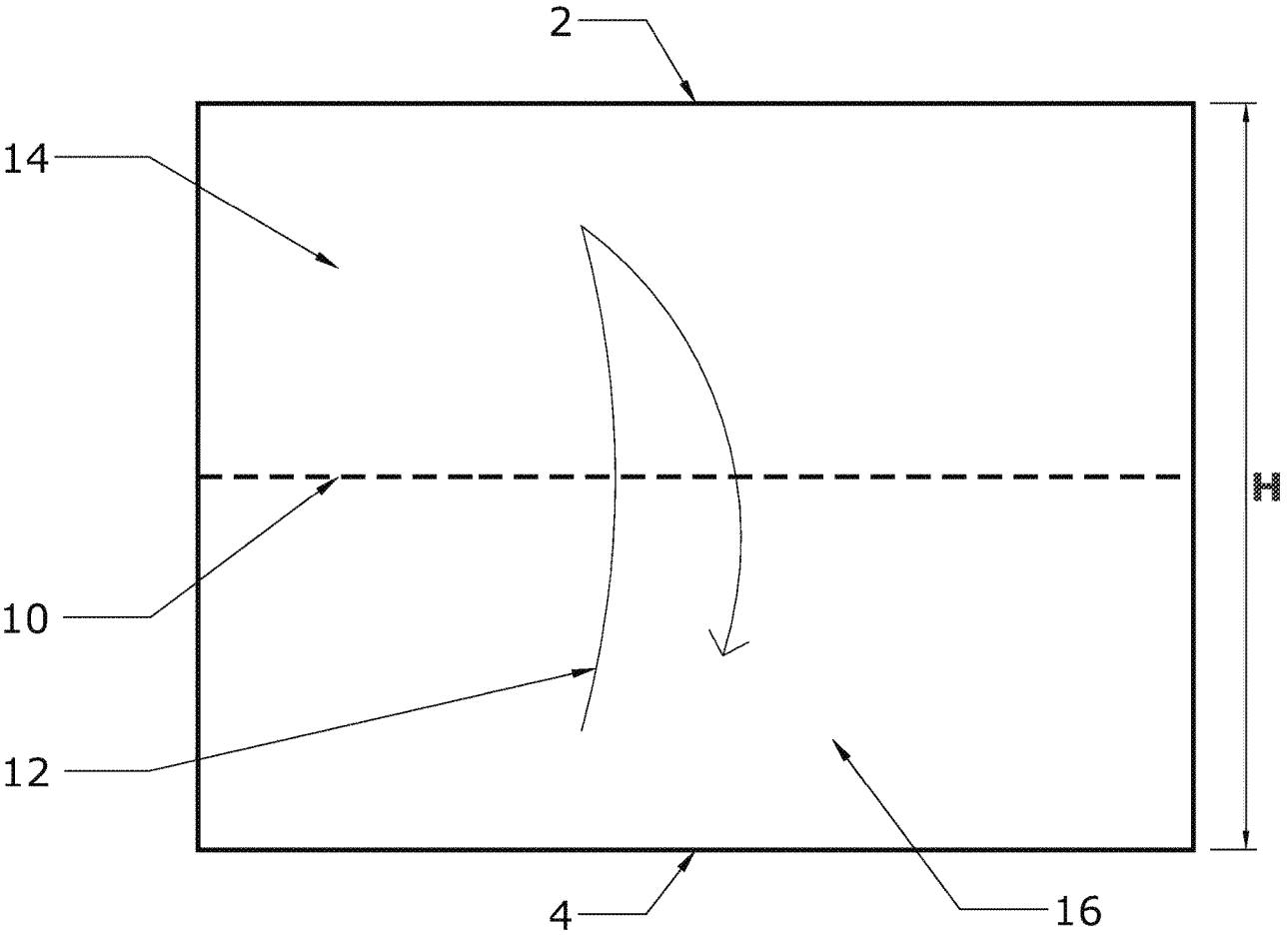
FIG. 2 is a top plan view of FIG. 1 with a depiction of the first step in the folding process, using standard origami diagramming symbols.

FIG. 2 is a top plan view of FIG. 1 with a depiction of the first step in the folding process, using standard origami diagramming symbols. Dashed lines such as the one in the centre of the sheet (10) represent folds that when folded, the line of folding moves away from the viewer and the surfaces surrounding it (14 and 16) move toward the viewer (commonly referred to as "valley" folds). The curved arrow (12) is a folding instruction that indicates the direction of the fold and, in this case as the arrow also reverses direction, an instruction to unfold. The placement of the fold (10) should be such that half or more of the sheet remains at the bottom portion of the sheet. The portion above the fold (10) towards the top of the sheet will become the vertical plane of the backdrop (14). The portion below the fold (10) towards the bottom of the sheet will become the base of the backdrop (16). Optimally, the placement should bisect the height of the sheet (H), maximizing the resulting vertical backdrop while providing enough mass at the base to allow for the unit to be free-standing.

Figure 3:
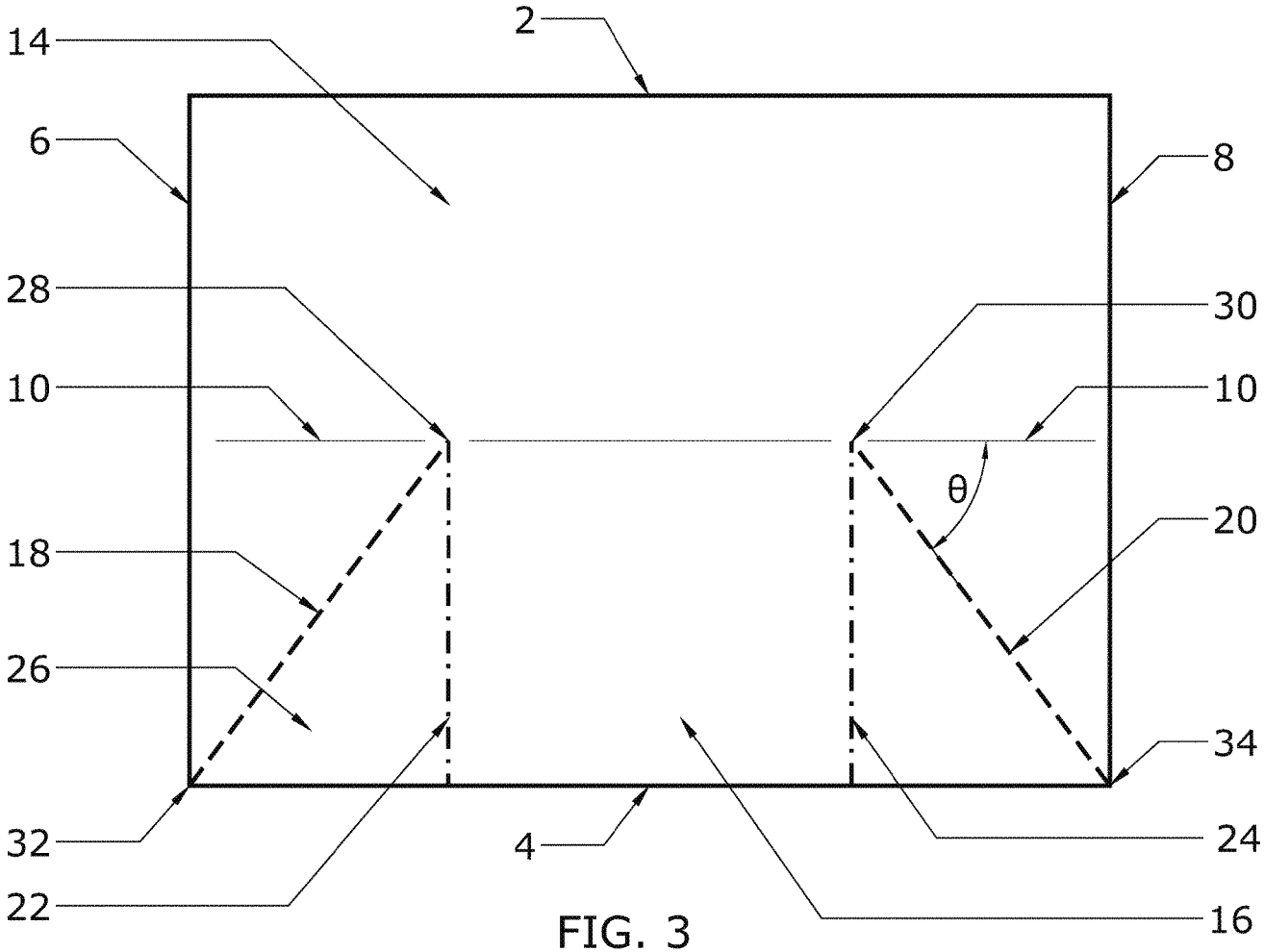
FIG. 3 is a top plan view of FIG. 2 with a depiction of the key folds in the folding process and a typical placement of same.

FIG. 3 is a top plan view of FIG. 2 with a depiction of the key folds in the folding process and a typical placement of same. The thin line (10) is the crease produced by the previous step. A valley fold (18) is on the left side of the sheet from a pivot point (28) to a first bottom corner of the sheet (32) where the first side edge (6) meets the bottom edge (4). A valley fold (20) is on the right side of the sheet from a pivot point (30) to a second bottom corner of the sheet (34) where the second side edge (8) meets the bottom edge (4). Repeating dashed and dotted lines such as the vertical one shown (22) represent folds that when folded, the line of folding moves toward the viewer and the surfaces on either side of it (16 and 26) move away from the viewer (commonly referred to as "mountain" folds). The mountain fold on the left side of the sheet is the dashed and dotted line (22). The mountain fold on the right side of the sheet is the dashed and dotted line (24). The confluence or intersection of the mountain and valley folds with the crease (10) on the left side of the sheet is the pivot point (28). The confluence or intersection of the mountain and valley folds with the crease (10) on the right side of the sheet is the pivot point (30). Also shown is the angle (θ) between the crease (10) and the valley fold (20). This angle governs the extent of the curve in the vertical portion of the right side of the backdrop (14). All of the folds could be pre-creased or scored into the material to assist the novice with the folding process.

Figure 4:
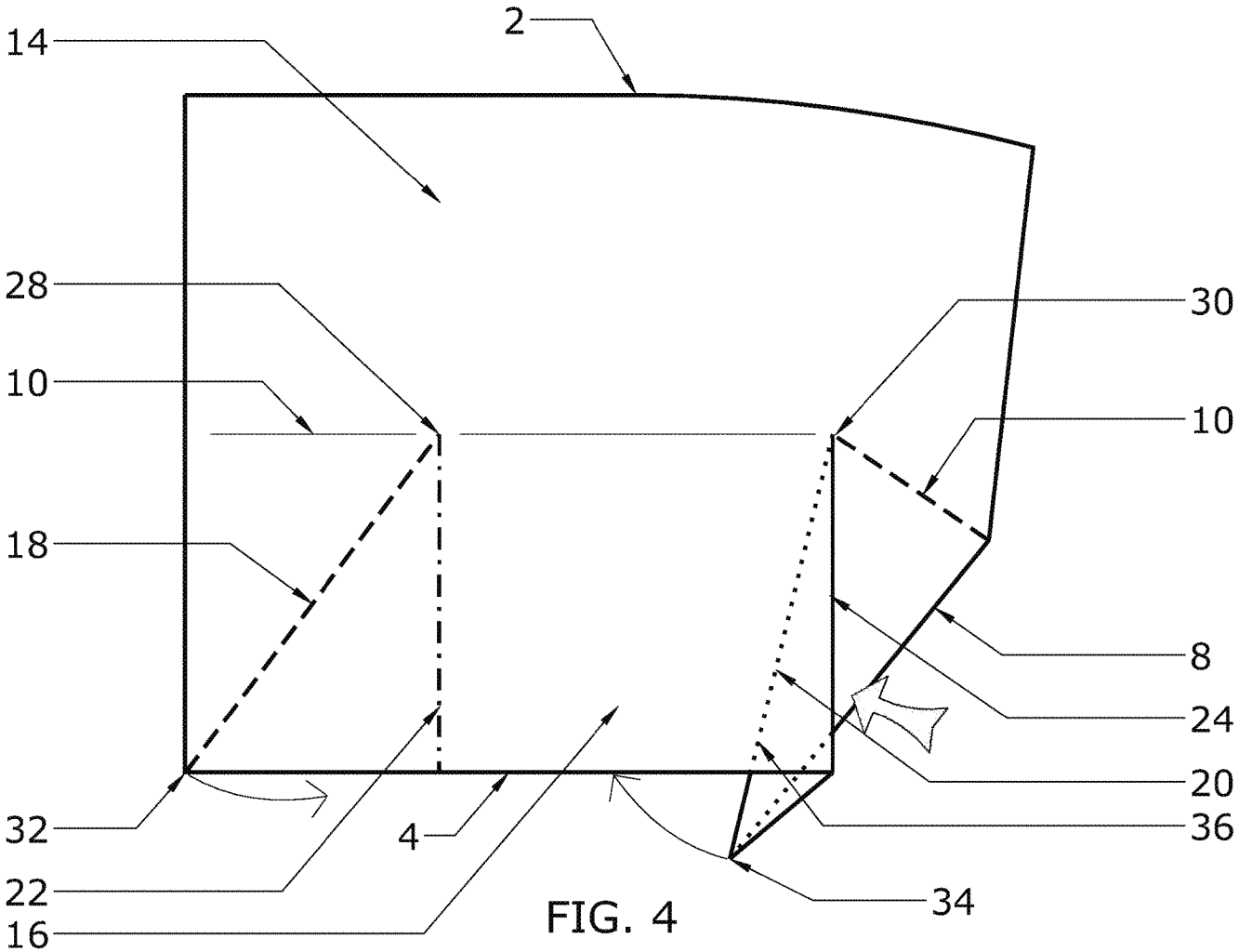
FIG. 4 is a perspective plan view of FIG. 3 with the right side of the model partially folded as the right side of the vertical plane is forced into position and the backdrop becomes three-dimensional.

FIG. 4 is a perspective plan view of FIG. 3 with the right side of the backdrop partially folded as the right side of the vertical plane (14) is forced into a more vertical position along the crease (10). The backdrop is becoming three-dimensional. Dotted or x-ray lines (36) show the position of the material behind the main base of the backdrop. The partially-folded right side mountain fold (24) and the partially-folded right side valley fold (20) are shown, as well as the partially-moved corner (34). The top edge (2) begins to show the curve in the backdrop (14). The lower portion of the right side edge (8) has been partially forced under the base (16). Various arrows using standard origami diagramming symbols depict the actions needed to fold the material along the folding lines.

Figure 5:
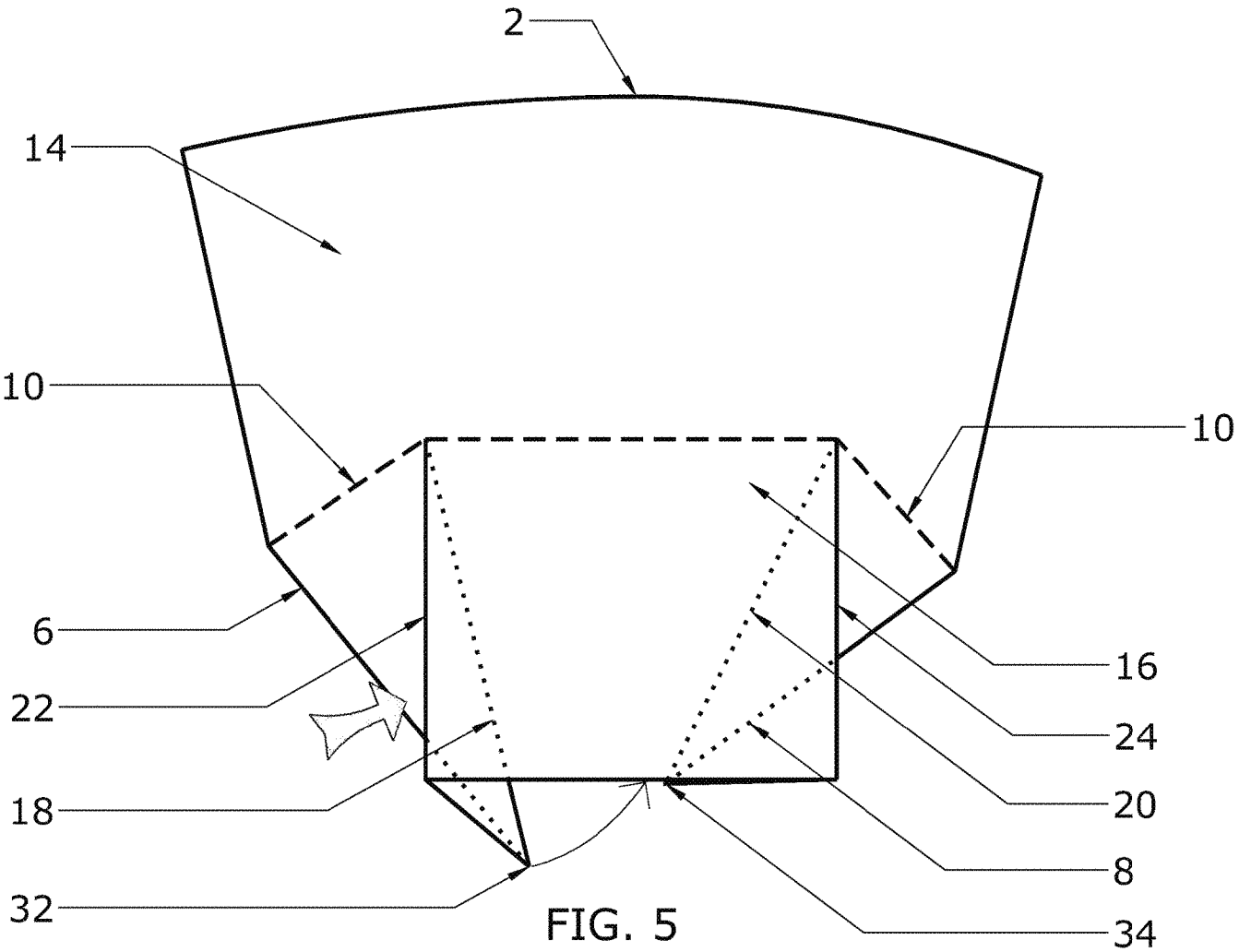
FIG. 5 is a perspective plan view of FIG. 4 that shows the left side of the backdrop partially folded and the right side of the backdrop with the folding process completed.

FIG. 5 is a perspective plan view of FIG. 4 that shows the left side of the backdrop partially folded as the left side of the vertical plane (14) is forced into position along the crease (10) and the right side of the backdrop completed. The partially-folded left side mountain fold (22) and the partially-folded left side valley fold (18) are shown, as well as the partially-moved corner (32). The left side edge (6) has been partially forced under the base (16). The completely-folded right side mountain fold (24) and the completely-folded right side valley fold (20) are shown, as well as the corner (34) in its final position. A portion of the right side edge (8) has been completely forced under the base (16). The top edge (2) shows more of the curve in the backdrop (14). Various arrows using standard origami diagramming symbols depict the actions needed to fold the material along the folding lines.

Figure 6:
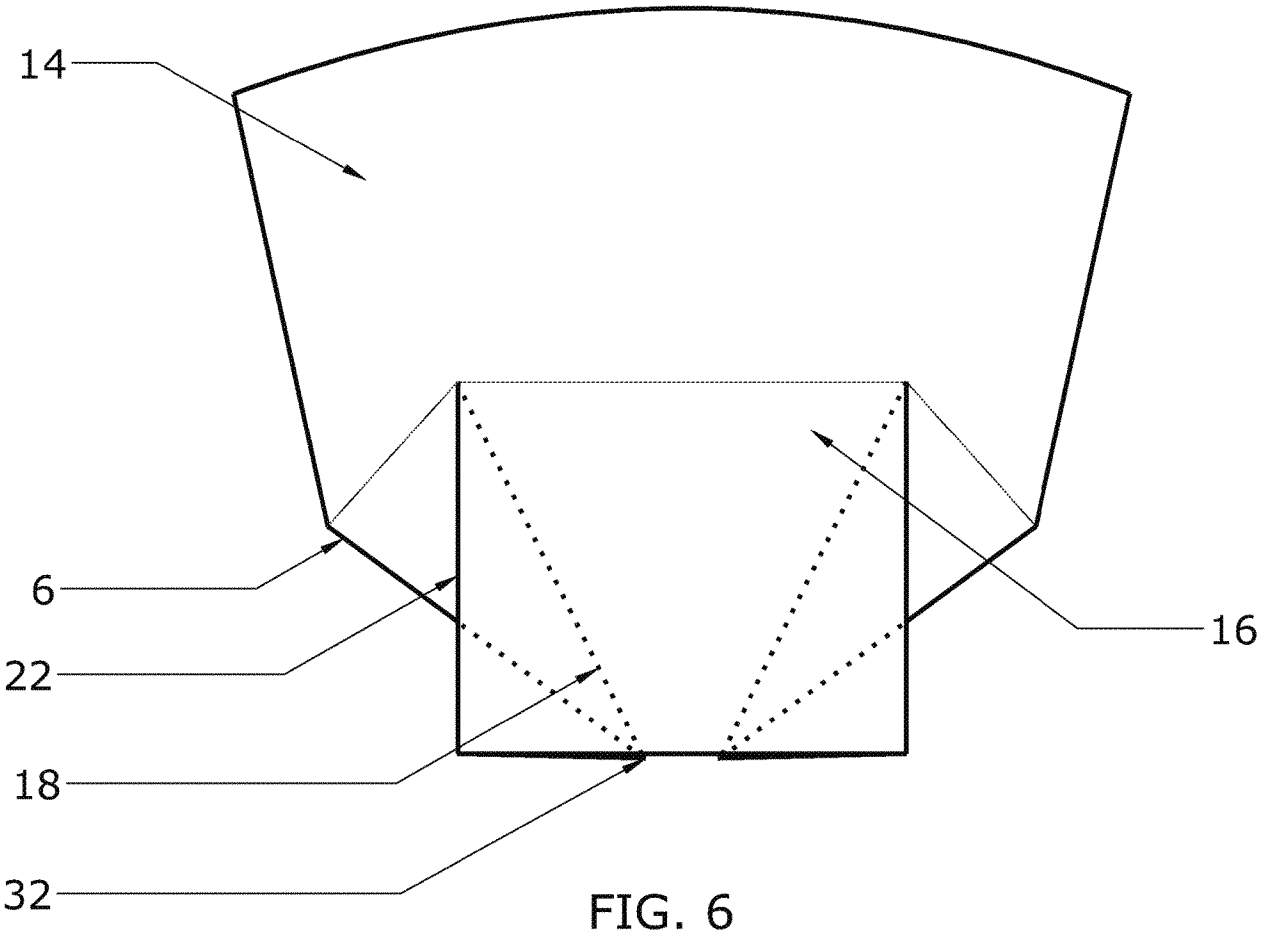
FIG. 6 shows a perspective plan view of the backdrop completed with the entire vertical plane and the horizontal base.

FIG. 6 is a perspective plan view of FIG. 5 that shows both left and right sides of the backdrop completed with the entire vertical plane (14) and the horizontal base (16). The lower portion of the left side edge (6) has been completely forced under the base. The completely-folded left side mountain fold (22) and the completely-folded left side valley fold (18) are shown, as well as the corner (32) in its final position. Dotted or x-ray lines show the position of the material behind the main base of the backdrop.

Figure 7:
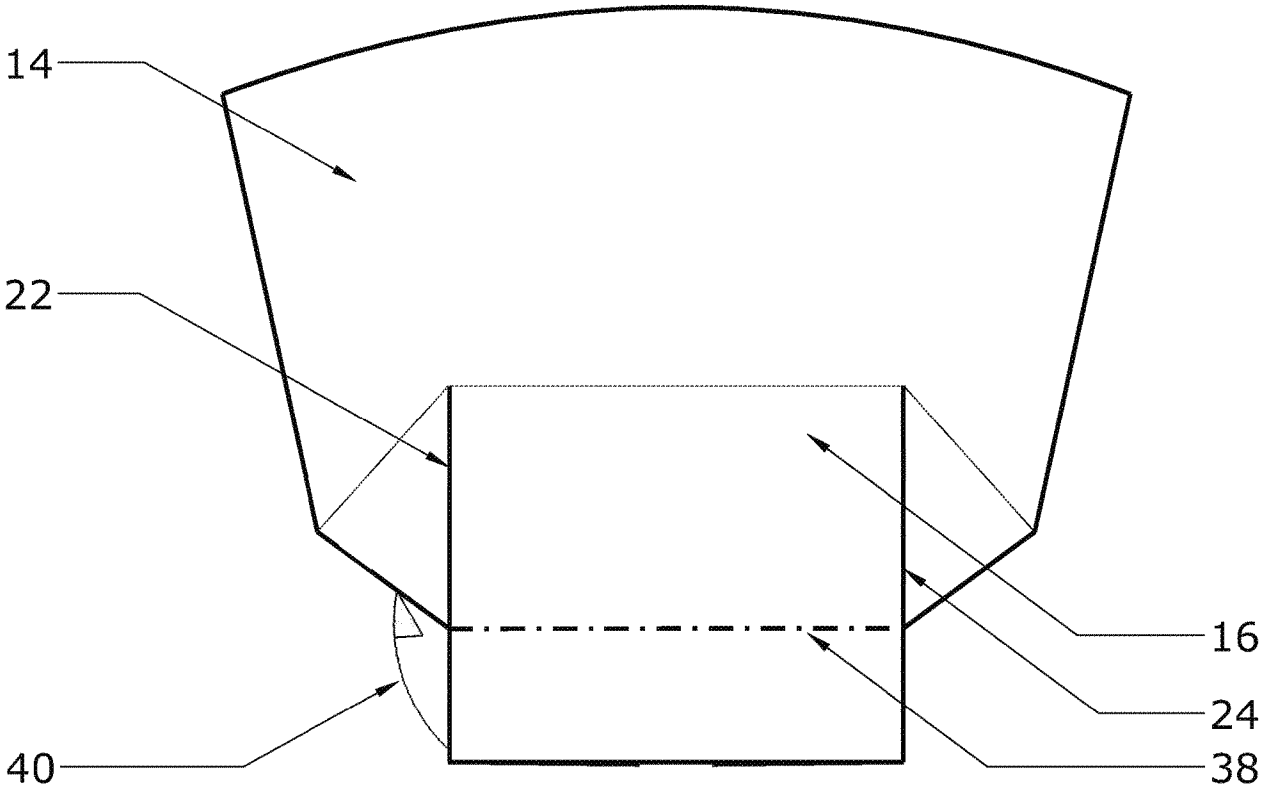
FIG. 7 is a perspective plan view of FIG. 6 that depicts an optional fold used to flip a portion of the base underneath the backdrop.

FIG. 7 is a perspective plan view of FIG. 6 that depicts an optional fold used to flip a portion of the base underneath the backdrop. A mountain fold (38) is positioned from the left side mountain fold (22) to the right side mountain fold (24). An arrow using standard origami diagramming symbols (40) depicts the action needed to mountain-fold the material along the folding line (38).

Figure 8:
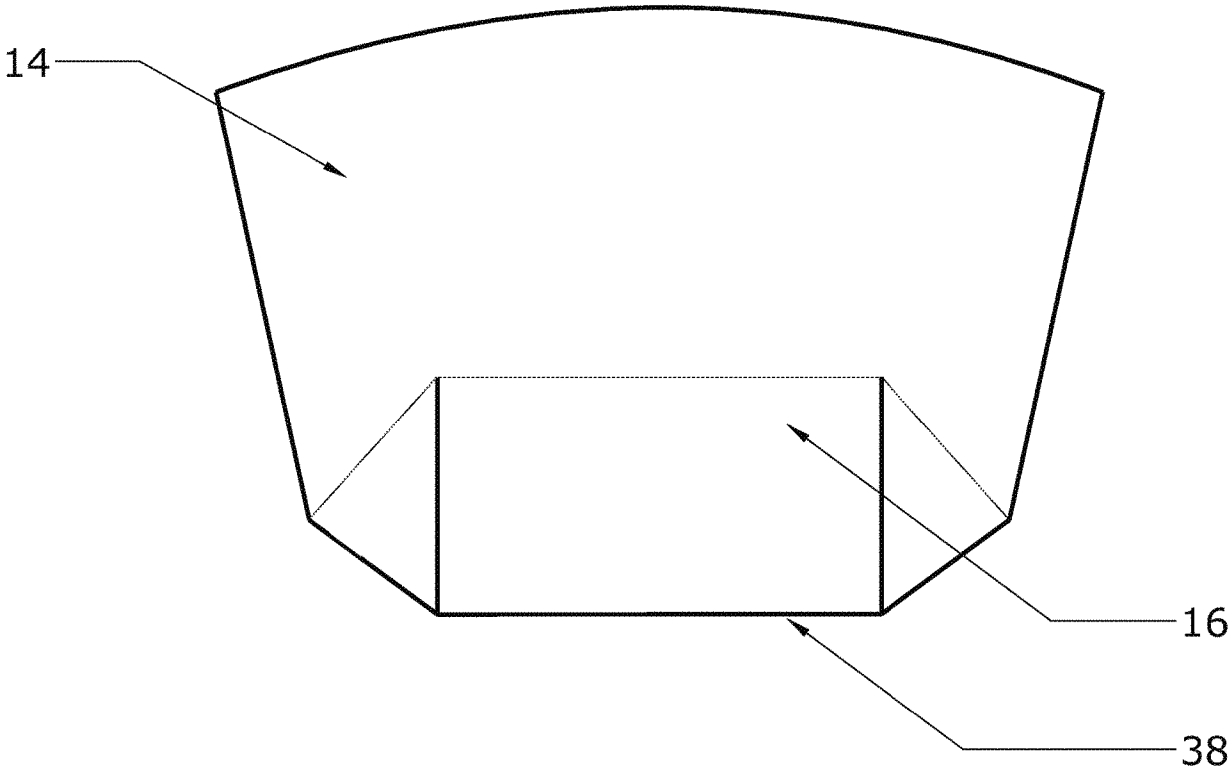
FIG. 8 is a perspective plan view of FIG. 7 that shows the backdrop completed with the optional base configuration.

FIG. 8 is a perspective plan view of FIG. 7 that shows the three-dimensional backdrop completed with the vertical plane (14) and the horizontal base (16) with the optional base configuration. The mountain fold from the previous step (38) becomes the front edge of the base.

FIG. 9B is a left elevation view of FIG. 8 showing the vertical plane (14), the horizontal base (16), the curved top edge of the material (2), the left side edge of the material (6), and the completed mountain fold from FIG. 7 (38) that now forms the front edge of the base.

FIG. 9C is a front elevation view of FIG. 8, slightly shaded to emphasise the three-dimensional structure, showing the vertical plane (14), the horizontal base (16), the crease line joining the two planes (10), the curved top edge of the material (2), the left side edge of the material (6), the right side edge of the material (8) and the completed mountain fold from FIG. 7 (38) that now forms the front edge of the base.

FIG. 9D is a right elevation view of FIG. 8 showing the vertical plane (14), the horizontal base (16), the curved top edge of the material (2), the right side edge of the material (8), and the completed mountain fold from FIG. 7 (38) that now forms the front edge of the base.

Figure 10:
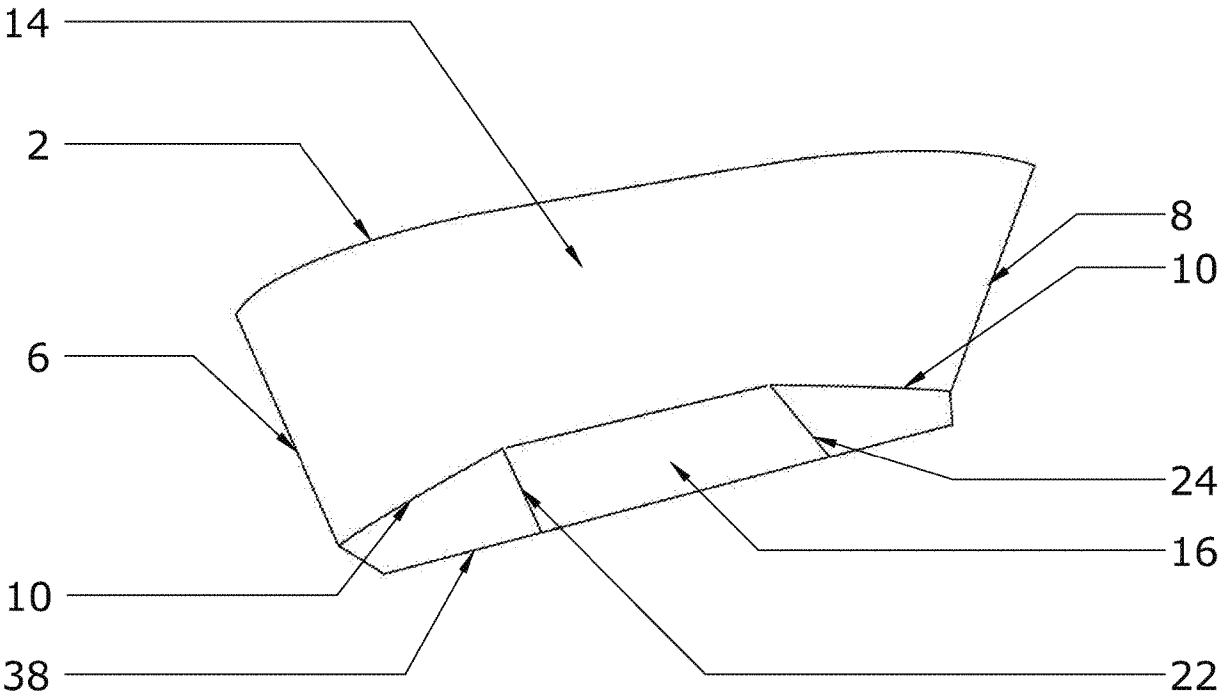
FIG. 10 is an isometric view of the three-dimensional backdrop.

FIG. 10 is an isometric view of the three-dimensional backdrop showing the vertical plane (14), the horizontal base (16), the crease line joining the two planes (10), the curved top edge of the material (2), the left side edge of the material (6), the right side edge of the material (8) and the completed mountain fold from FIG. 7 (38) that now forms the front edge of the base. Also shown are the completed left side mountain fold (22) and right side mountain fold (24).

Figure 11:
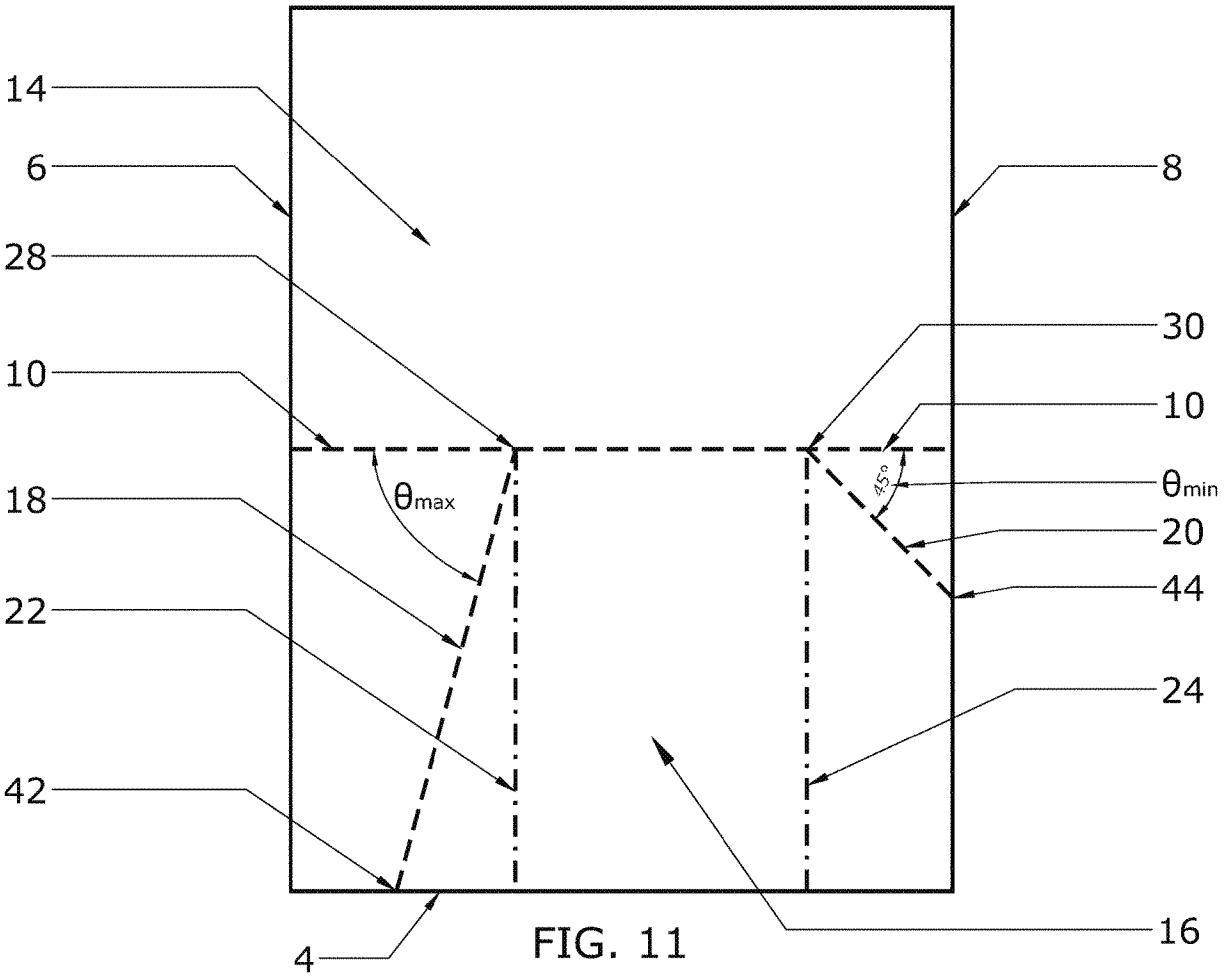
FIG. 11 is a top plan view of a variation of the material's orientation and fold placement, with emphasis on the key placement of the pivot point (22) and the minimum and maximum angles between folds that govern the vertical stability of the backdrop.

FIG. 11 is a top plan view of a sheet of material with a depiction of the key folds in the folding process similar to FIG. 3 but showing a variation of the material's orientation and fold placement, with emphasis on the asymmetrical placement of the pivot points (28 and 30) from their outside edges (6 and 8 respectively), and the minimum angle ($\theta_{min}$) and maximum angle ($\theta_{max}$) between valley folds and the crease. These angles govern the stability of the backdrop's vertical plane (14). A valley fold (10) bisects the sheet. A valley fold (18) is on the left side of the sheet from a pivot point (28) to a point of intersection (42) along the bottom edge (4). A valley fold (20) is on the right side of the sheet from a pivot point (30) to a point of intersection (44) along the right edge (8). The mountain fold on the left side of the sheet is the dashed and dotted line (22). The mountain fold on the right side of the sheet is the dashed and dotted line (24). The confluence or intersection of the mountain and valley folds with the valley fold (10) on the left side of the sheet is the pivot point (28). The confluence or intersection of the mountain and valley folds with the valley fold (10) on the right side of the sheet is the pivot point (30).

Figure 12:
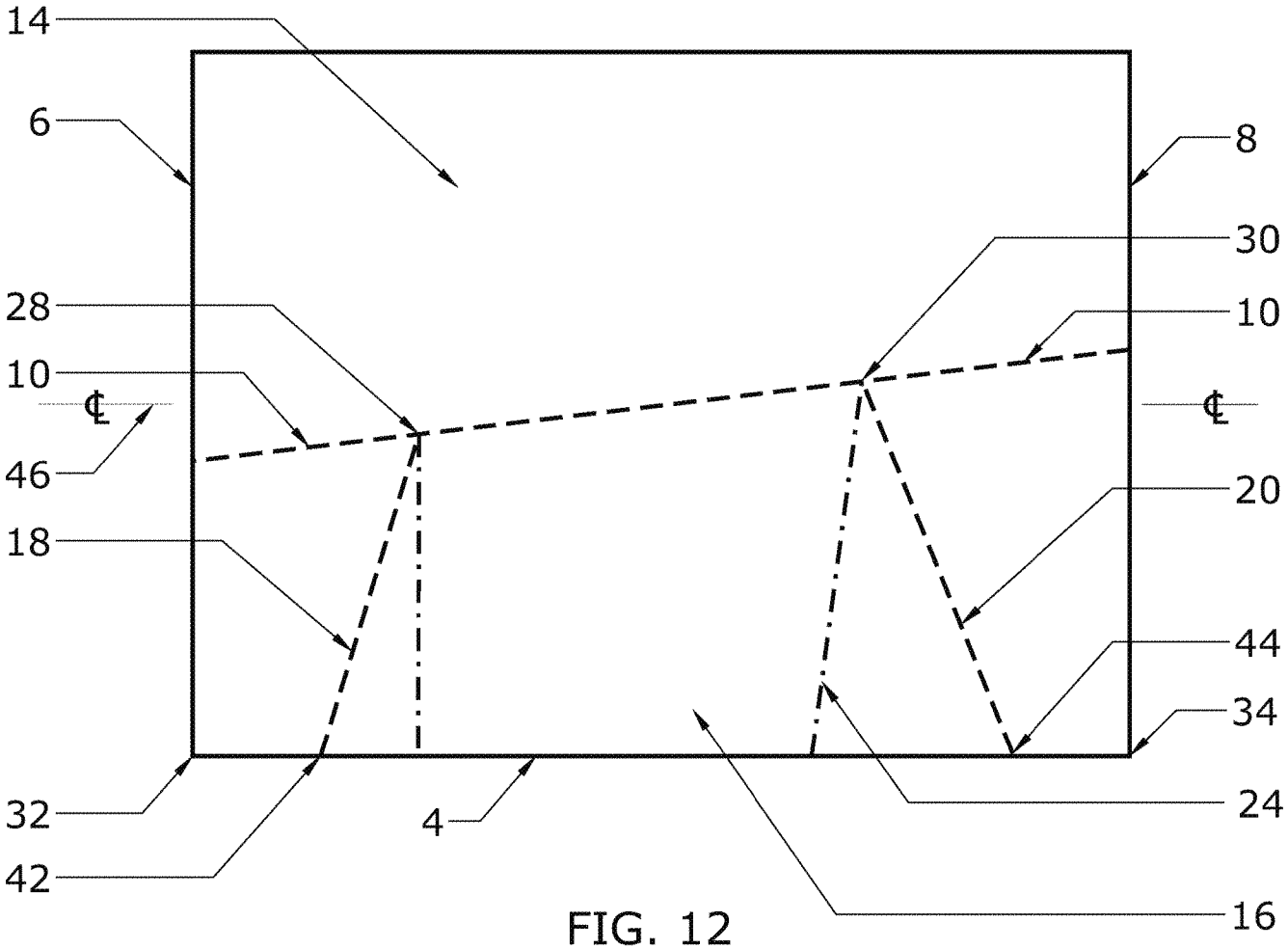
FIG. 12 is a top plan view of another variation of the fold placement to reinforce the variable nature of the placement of the folds that will still result in a usable backdrop.

FIG. 12 is a top plan view of another variation of the fold placement to reinforce the variable nature of the placement of the folds that will still result in a usable backdrop. The bisecting valley fold (10) divides the sheet in half and is symmetrical along the centreline (46). This ensures that the vertical background is maximised while retaining enough mass in the base to allow the finished three-dimensional backdrop to be free-standing. A valley fold (18) is on the left side of the sheet from a pivot point (28) to a point of intersection (42) along the bottom edge (4). A valley fold (20) is on the right side of the sheet from a pivot point (30) to a point of intersection (44) along the bottom edge (4). The mountain fold on the left side of the sheet is the dashed and dotted line (22). The mountain fold on the right side of the sheet is the dashed and dotted line (24). The confluence or intersection of the mountain and valley folds with the valley fold (10) on the left side of the sheet is the pivot point (28). The confluence or intersection of the mountain and valley folds with the valley fold (10) on the right side of the sheet is the pivot point (30).

Figure 13:
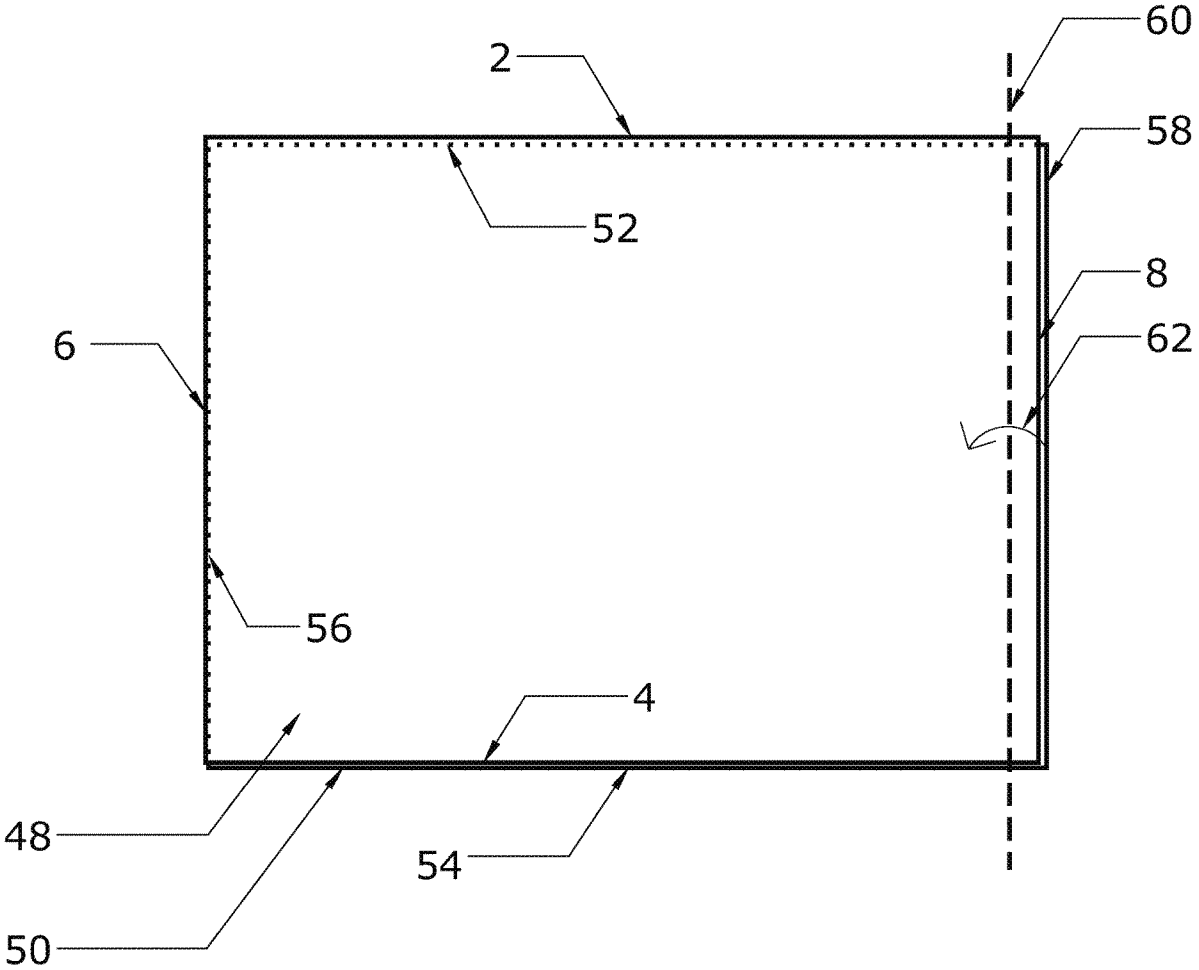
FIG. 13 is a top plan view of two stacked sheets of foldable material.

FIG. 13 is a top plan view that shows two stacked sheets of foldable material placed exactly one on top of the other, preparatory to showing a secondary embodiment of the present invention, made by first joining or linking a common edge of the sheets of material using folds and then by creating the backdrop using the folding process previously described. For clarity, as is common in standard origami diagramming, the sheets are shown slightly offset though in reality they are not. The top sheet (48) is shown having a top edge (2), a bottom edge (4), a first side edge on the left (6) and a second side edge on the right (8). The bottom sheet (50) is shown having a top edge (52) represented by a dotted x-ray line, a bottom edge (54), a first side edge on the left (56) represented by a dotted x-ray line and a second side edge on the right (58). The first valley fold of the joining process (60) is depicted using standard origami diagramming symbols. The curved arrow (62) is a folding instruction that indicates the direction of the fold.

Figure 14:
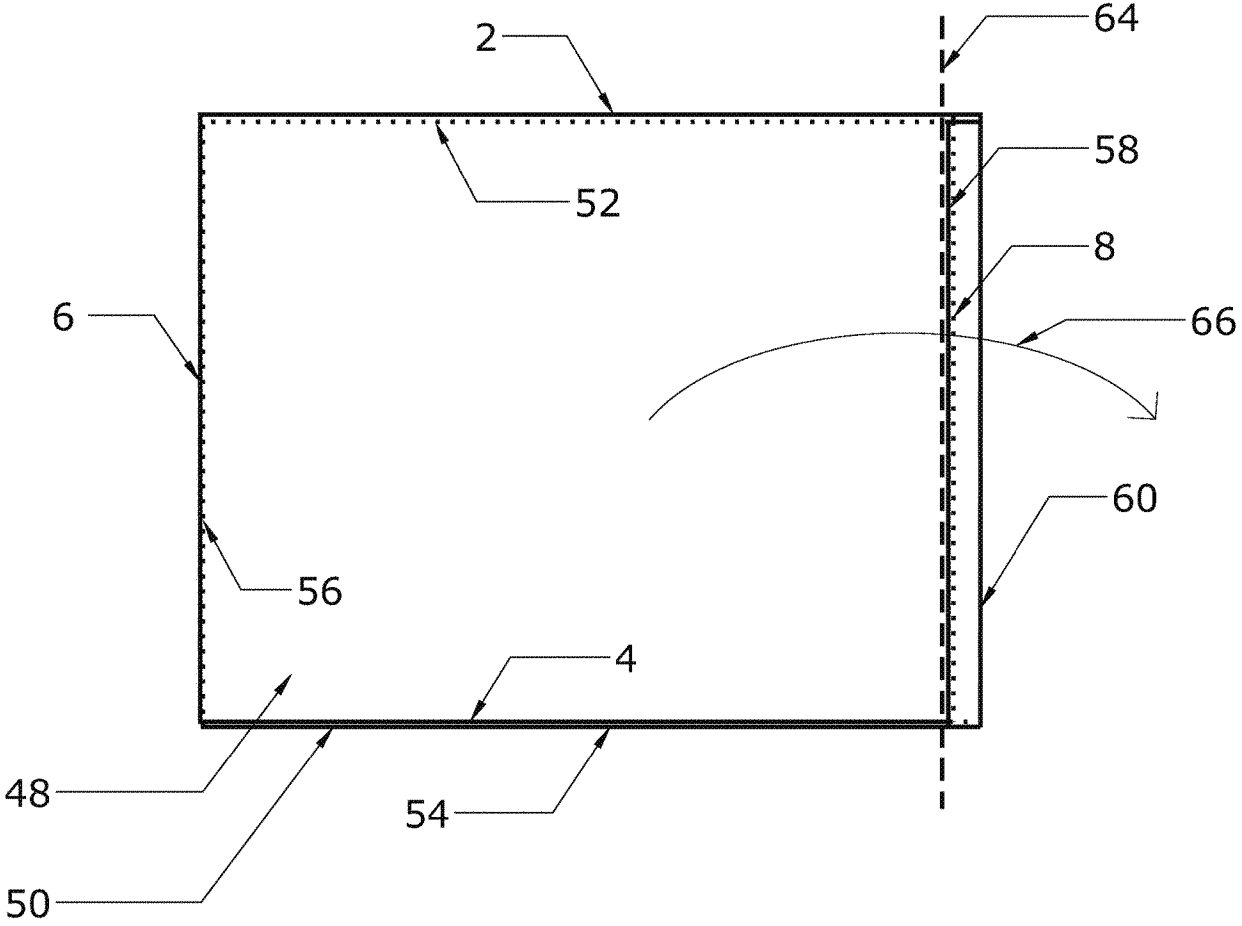
FIG. 14 is a top plan view of FIG. 13 that shows the second fold used to link the two sheets together.

FIG. 14 is a top plan view of FIG. 13 that shows the two sheets after the first fold has been executed. The top sheet (48) is shown having a top edge (2), a bottom edge (4), a first side edge on the left (6) and a second side edge on the right (8) which is now represented by a dotted x-ray line. The bottom sheet (50) is shown having a top edge (52) represented by a dotted x-ray line, a bottom edge (54), a first side edge on the left (56) represented by a dotted x-ray line and a second side edge on the right (58) which is now folded to be on top of the first sheet's right edge (8). The first valley fold of the joining process (60) from FIG. 13 is complete and now temporarily forms the right edge of the backdrop. The next folding step of the joining process is the valley fold (64). The curved arrow (66) is a folding instruction that indicates the direction of the fold.

Figures 15, 15A:
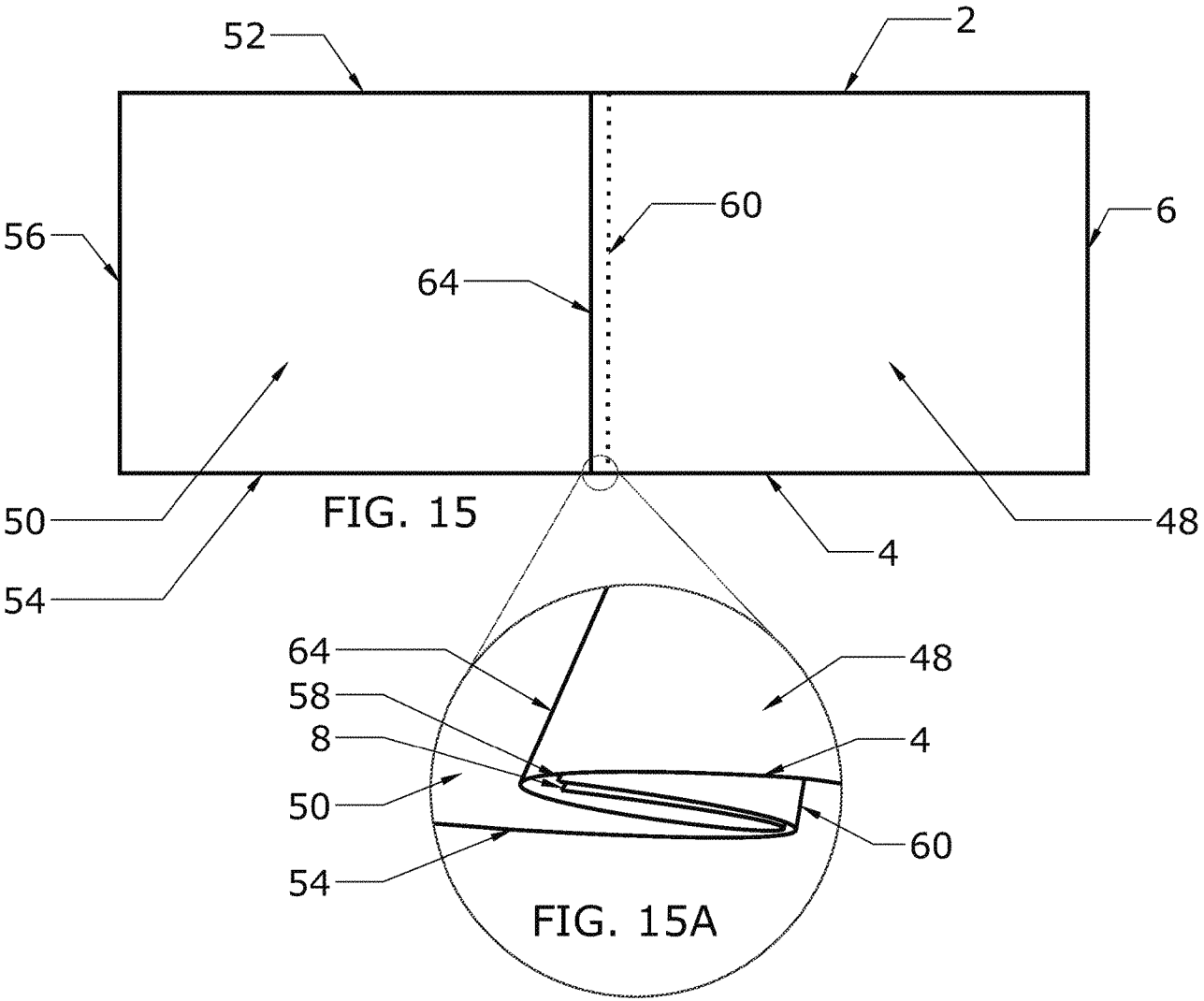
FIG. 15 is a top plan view of FIG. 14 that shows the result of the previous two folds.
FIG. 15A is an isometric view close-up representation of the resulting overlapping sheets depicted in FIG. 15.

FIG. 15 is a top plan view of FIG. 14 that shows the result of the previous valley folds. The two sheets are joined by a "seam" and opened out. The top sheet (48) is flipped over along the fold (64) and becomes the right side of the backdrop, having a top edge (2), a bottom edge (4) and a side edge now on the right (6). The first valley fold of the joining process (60) from FIG. 13 is complete and now forms the hidden edge of the seam in the middle of the backdrop, shown as a dotted x-ray line. The second valley fold of the joining process (64) from FIG. 14 is complete and now forms the visible edge of the seam in the middle of the backdrop. The previous bottom sheet (50) is now revealed to become the left side of the backdrop, having a top edge (52), a bottom edge (54) and a left side edge (56). There is an isometric view close-up representation of the resulting overlapping sheets in FIG. 15A. The right edge (8) of the original top sheet (48) and the right edge (58) of the original bottom sheet (50) from FIG. 13 are shown in their final position inside the folds of the seam.

Figures 16, 16A, 16B:
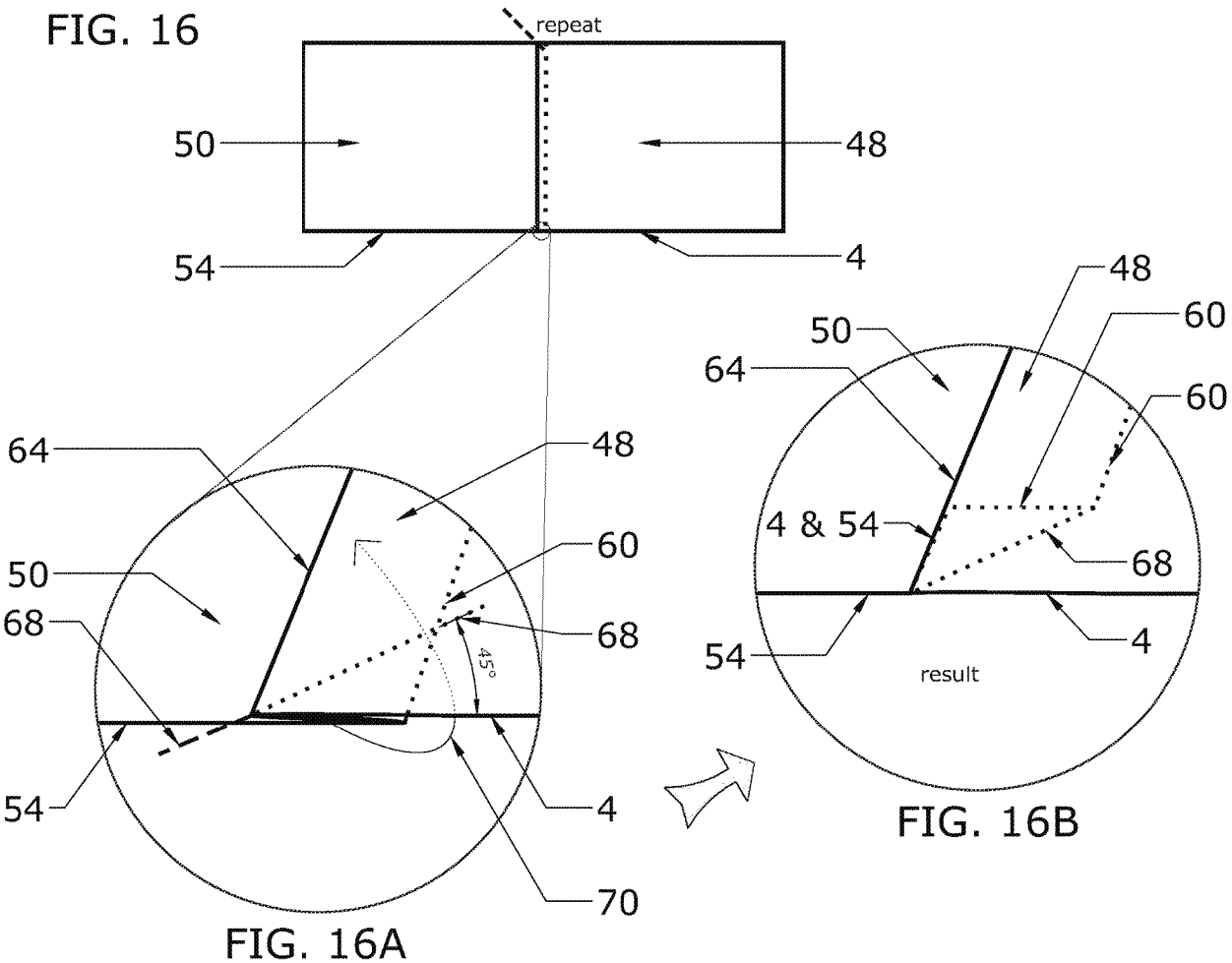
FIG. 16 is a top plan view of FIG. 15 that depicts the folds necessary to "lock" the seam or overlapping sheets together.
FIG. 16A is a first isometric close-up view of the locking process of FIG. 16.
FIG. 16B is a second isometric close-up view of the locking process of FIG. 16.

FIG. 16 is a top plan view of FIG. 15 that depicts the folds necessary to "lock" the seam or overlapping sheets together. FIG. 16A on the lower left is an isometric view close-up of the next folding instruction. It shows the bottom edge (54) of the left side of the backdrop (50), the bottom edge (4) of the right side of the backdrop (48), the hidden edge of the seam in the middle of the backdrop shown as a dotted x-ray line (60), the visible edge of the seam in the middle of the backdrop (64), the next valley fold in the process (68) that intersects the bottom edges (4 and 54) of the backdrop at a 45 degree angle, and an instructional arrow (70) that indicates the direction and nature of the valley fold (68). There is also instructional text used for clarity. Shown on the lower right is FIG. 16B, an isometric view close-up of the result of the locking fold from FIG. 16A. Dotted x-ray lines show the position of the material behind the right side of the backdrop (48). The completed valley fold (68) is shown. Because the valley fold (68) intersected the bottom edges (4 and 54) of the backdrop at a 45 degree angle, a portion of the edges (4) and (54) are folded perpendicular to themselves to lie hidden against the inside of the seam (64). That portion (4 & 54) is shown as an x-ray line while the remaining exposed portion of the bottom edge (54) of the left side and the remaining exposed portion of the bottom edge (4) of the right side are shown as a solid line. Likewise with the hidden seam edge (60): because the valley fold (68) intersected the seam edge (60) at a 45 degree angle, a portion of the edge (60) is folded perpendicular to itself to lie in a perpendicular orientation to the visible edge of the seam (64).

Figure 17:
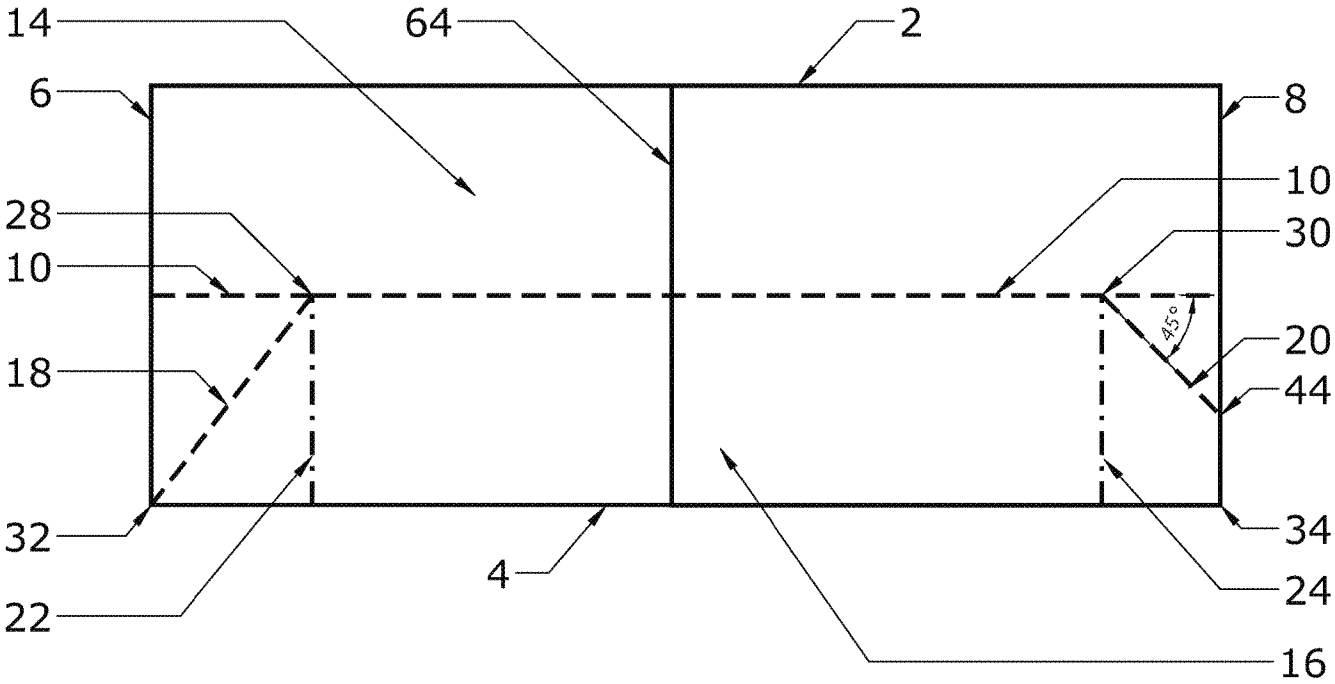
FIG. 17 is a top plan view of FIG. 16 that shows the new linked material with a depiction of the key folds in the folding process necessary to create the extended backdrop and a typical placement of same.

FIG. 17 is a top plan view of FIG. 16 that shows the new linked material with a depiction of the key folds in the folding process necessary to create the extended backdrop and a typical placement of same. The entire extended sheet is now treated as one sheet with a seam edge in the middle (64) and the folds are identical to those noted in FIG. 3: namely, the bisecting valley fold (10) divides the sheet in half; a valley fold (18) is on the left side of the sheet from a pivot point (28) to a first bottom corner of the sheet (32) where the first side edge (6) meets the bottom edge (4). A valley fold (20) is on the right side of the sheet from a pivot point (30) to a point of intersection (44) along the right edge (8) (This is similar to the same placement of this same line on FIG. 11). The mountain fold on the left side of the sheet is the dashed and dotted line (22). The mountain fold on the right side of the sheet is the dashed and dotted line (24). The confluence or intersection of the mountain and valley folds with the fold (10) on the left side of the sheet is the pivot point (28). The confluence or intersection of the mountain and valley folds with the fold (10) on the right side of the sheet is the pivot point (30). A second bottom corner of the sheet (34) is shown where the second side edge (8) meets the bottom edge (4). Also shown is the angle (θ) between the fold (10) and the valley fold (20). This angle governs the extent of the curve in the vertical portion of the right side of the backdrop (14). Note the asymmetrical placement of the pivot points (28 and 30) and the valley folds (18 and 20). This will result in a backdrop with variably curved sides: slightly curved on the left and severely curved on the right.

Figure 18:
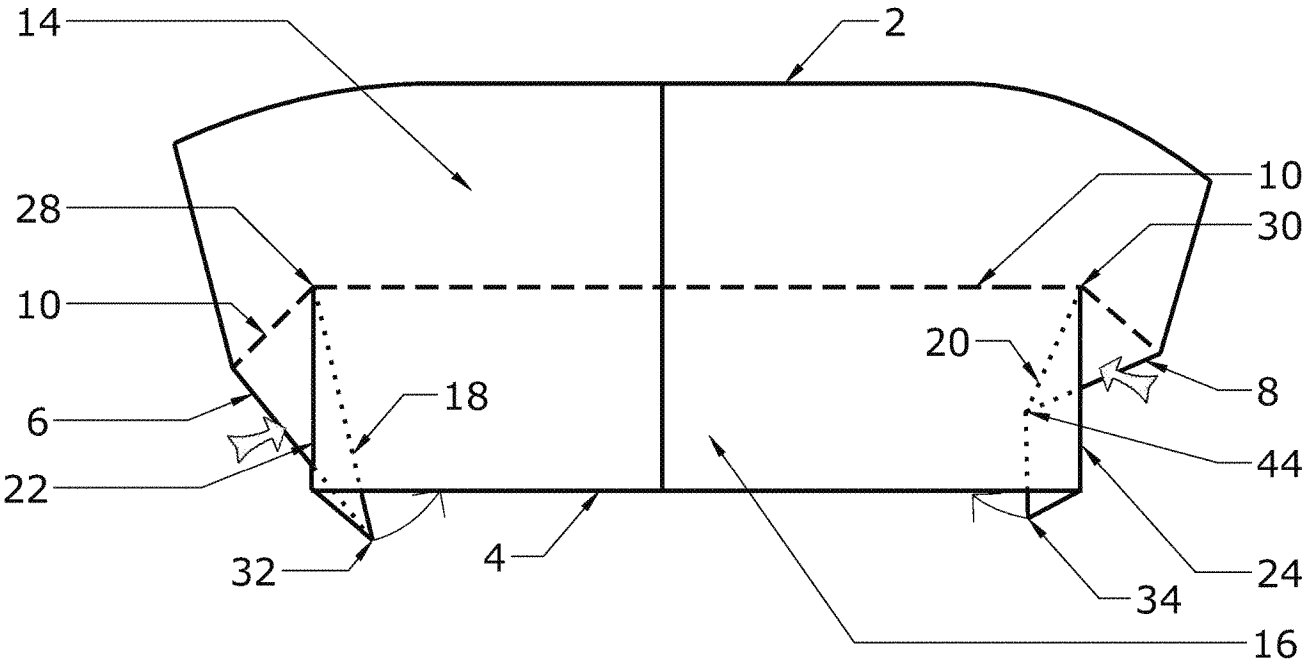
FIG. 18 is a perspective plan view of FIG. 17 that shows the partially-folded backdrop becoming three-dimensional.

FIG. 18 is a perspective plan view of FIG. 17 that shows the backdrop becoming three-dimensional. The left side of the backdrop is partially folded as the left side of the vertical plane (14) is forced into position along the fold (10). The partially-folded left side mountain fold (22) and the partially-folded left side valley fold (18) are shown, as well as the partially-moved corner (32). The left side edge (6) has been partially forced under the base (16). The partially-folded right side mountain fold (24) and the partially-folded right side valley fold (20) are shown, as well as the partially-moved point of intersection (44) and the partially-moved corner (34). The top edge (2) begins to show the curve in the backdrop (14). The lower portion of the right side edge (8) has been partially forced under the base (16). Various arrows using standard origami diagramming symbols depict the actions needed to fold the material along the folding lines.

Figure 19:
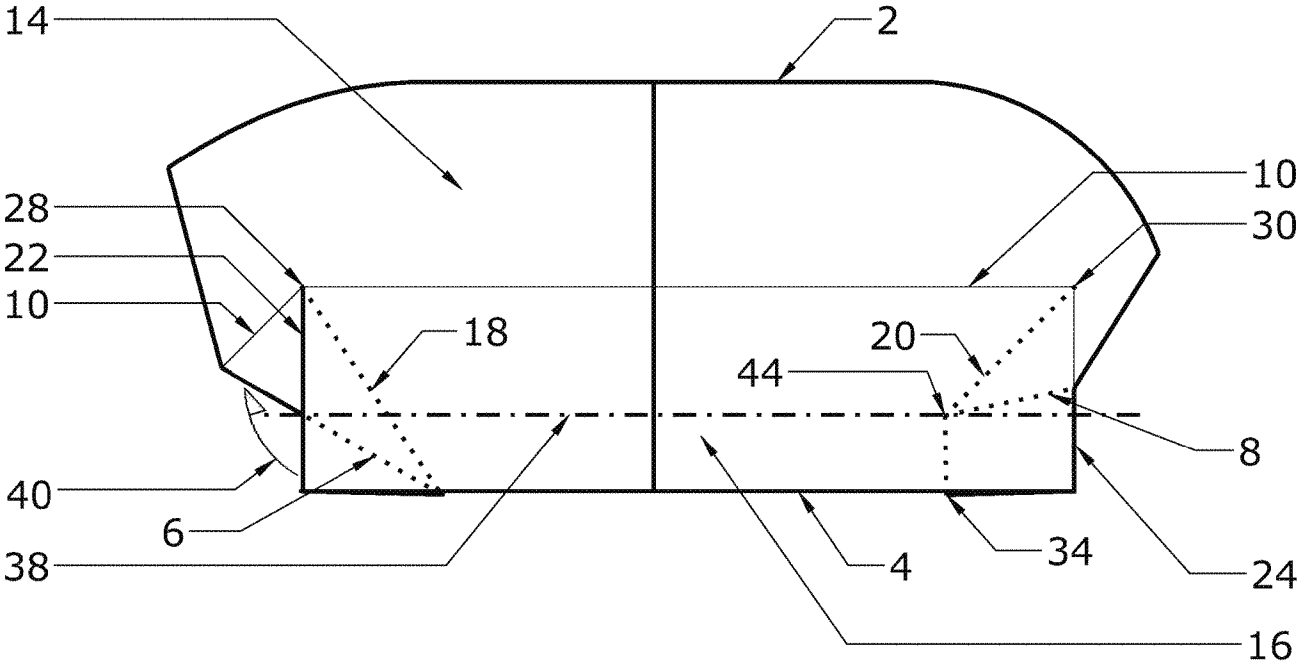
FIG. 19 is a perspective plan view of FIG. 18 that depicts both the left and right sides of the extended backdrop completed.

FIG. 19 is a perspective plan view of FIG. 18 that depicts both sides of the extended backdrop completed with the entire vertical plane (14) and the horizontal base (16). Dotted x-ray lines show the position of the material behind the main base of the backdrop. The lower portion of the left side edge (6) has been completely forced under the base. The completely-folded left side mountain fold (22) and the completely-folded left side valley fold (18) are shown, as well as the corner (32) in its final position. The completely-folded right side mountain fold (24) and the completely-folded right side valley fold (20) are shown, as well as the corner (34) in its final position. A portion of the right side edge (8) has been completely forced under the base (16). Note the difference between the curves on the two sides that resulted from the asymmetrical placement of the mountain and valley folds. The result is a backdrop with variably curved sides: slightly curved on the left and severely curved on the right. This demonstrates the variable nature of the folding process. A mountain fold (38) is positioned from the left side mountain fold (22) to the right side mountain fold (24). An arrow using standard origami diagramming symbols (40) depicts the action needed to fold the material along the folding line (38).

Figure 20:
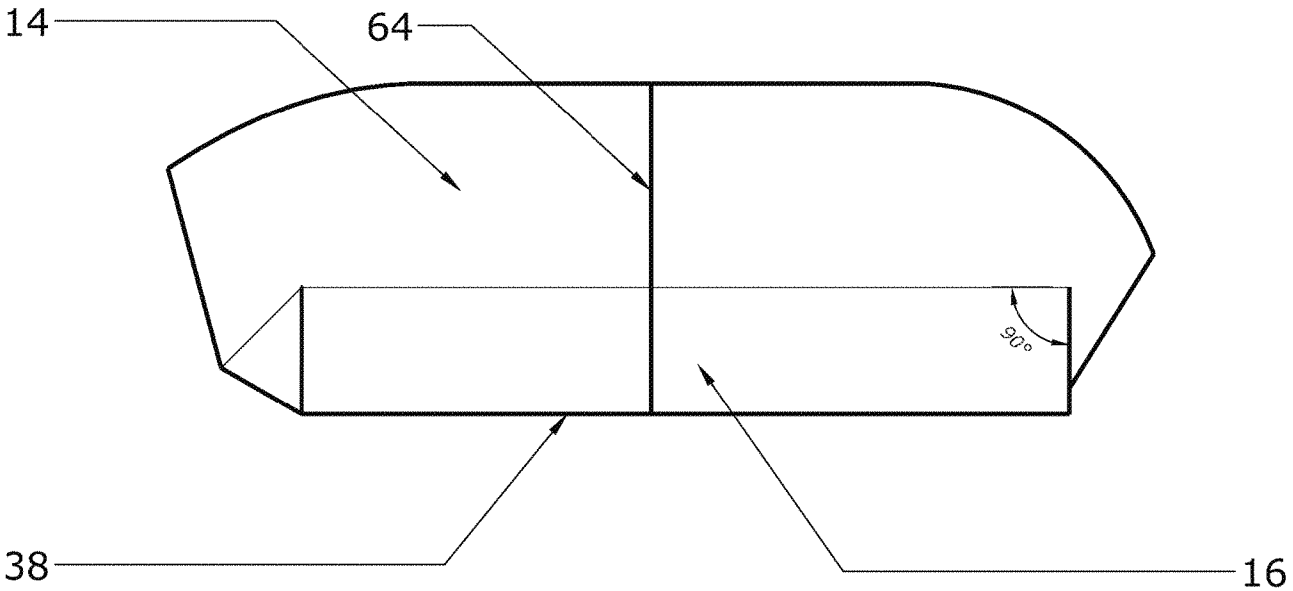
FIG. 20 is a perspective plan view of FIG. 19 that shows the three-dimensional backdrop completed.

FIG. 20 is a perspective plan view of FIG. 19 that shows the three-dimensional backdrop completed with the vertical plane (14), the horizontal base (16) with the optional base configuration and the visible seam (64) joining the two sheets that make up the backdrop. The mountain fold from the previous step (38) becomes the front edge of the base. Of note is how the original 45 degree angle on the right side becomes a 90 degree angle between the rear and side vertical backdrop.

Figure 21:
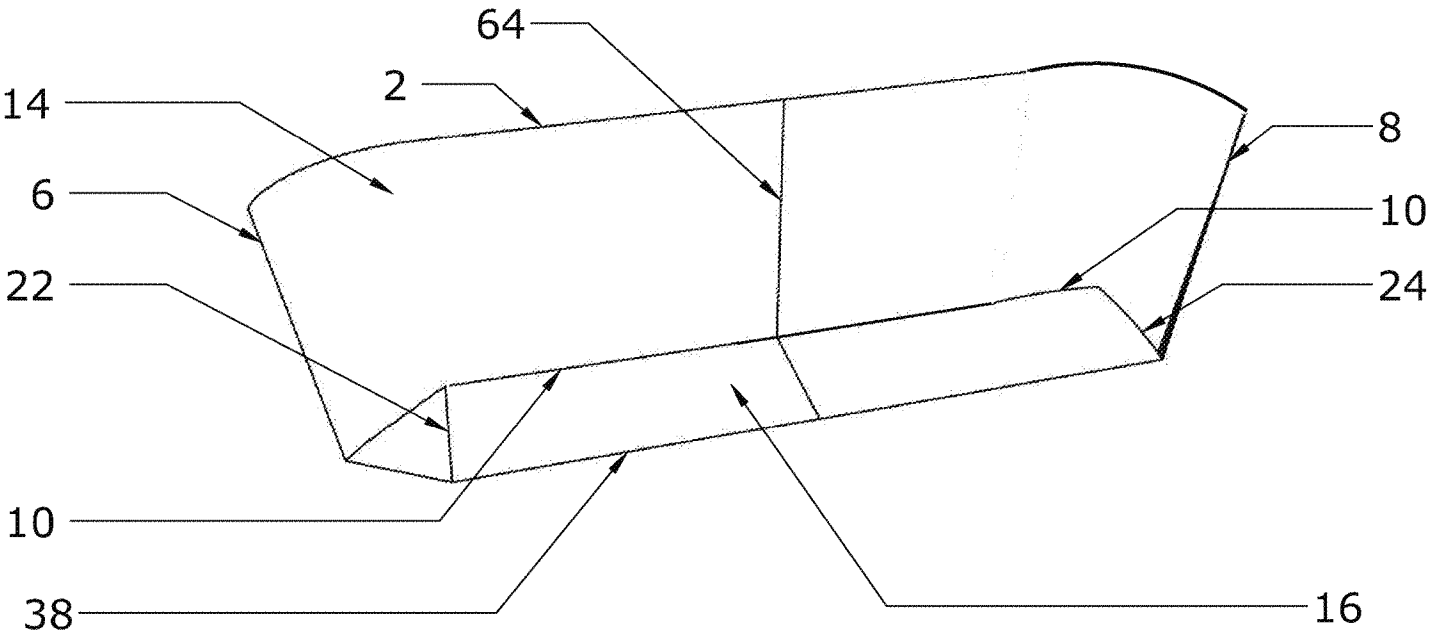
FIG. 21 is an isometric view of the three-dimensional extended backdrop.

FIG. 21 is an isometric view of the three-dimensional extended backdrop showing the vertical plane (14), the horizontal base (16), the crease line joining the two planes (10), the curved top edge of the material (2), the left side edge of the material (6), the right side edge of the material (8) and the completed mountain fold from FIG. 19 (38) that now forms the front edge of the base. Also shown are the completed left side mountain fold (22) and right side mountain fold (24).

Figure 22:
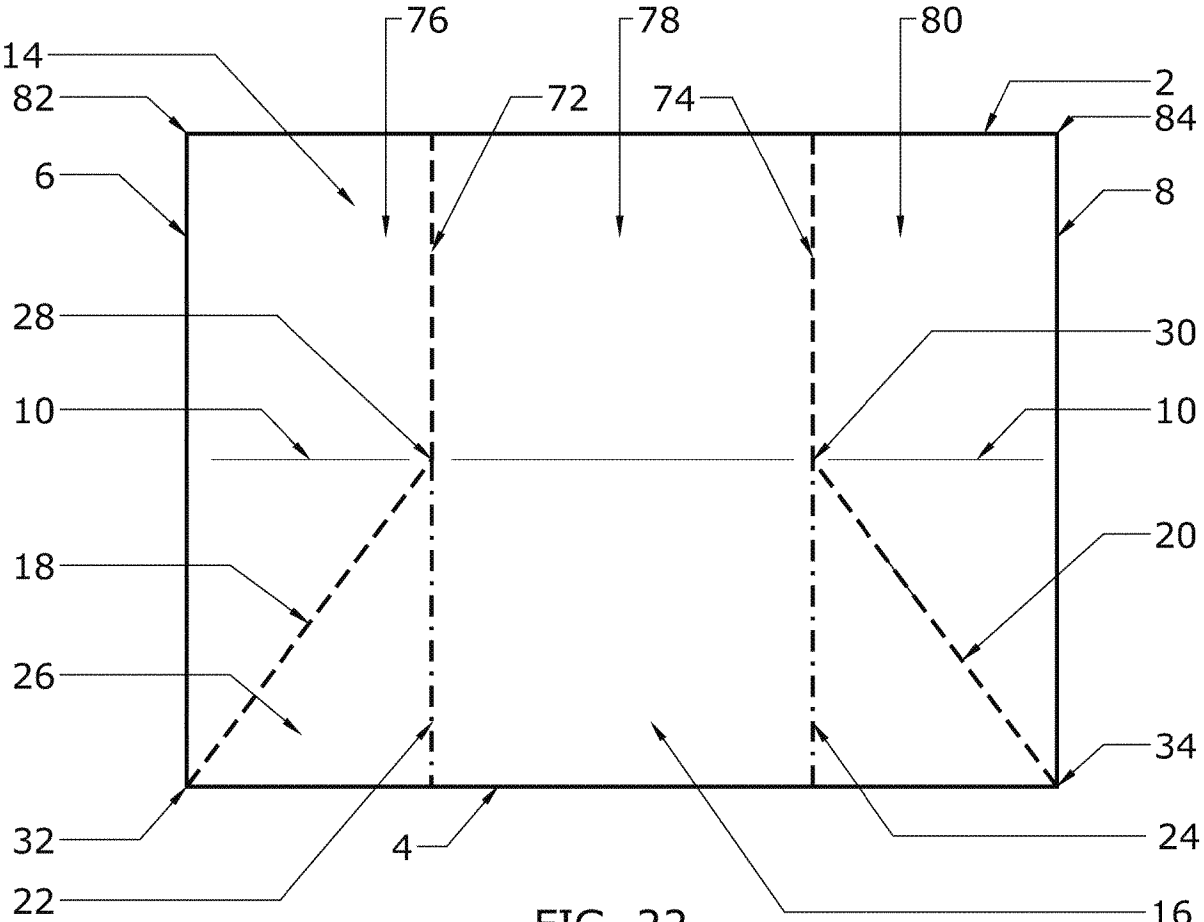
FIG. 22 is a top plan view of FIG. 2 and represents an additional embodiment of the fold placement that results in a "panelled" vertical plane on the backdrop.

FIG. 22 is a top plan view of FIG. 2 and represents an additional embodiment of the fold placement that results in a "panelled" vertical plane (14) on the backdrop. The basic folds of the folding process are identical to those noted in FIG. 3: namely, the thin line (10) is the crease produced by valley-folding the sheet in half in FIG. 2; a valley fold (18) is on the left side of the sheet from a pivot point (28) to a first bottom corner of the sheet (32) where the first side edge (6) meets the bottom edge (4); a valley fold (20) is on the right side of the sheet from a pivot point (30) to a second bottom corner of the sheet (34) where the second side edge (8) meets the bottom edge (4); a mountain fold on the left side of the sheet is the dashed and dotted line (22); a mountain fold on the right side of the sheet is the dashed and dotted line (24). The confluence or intersection of the mountain and valley folds with the crease (10) on the left side of the sheet is the pivot point (28). The confluence or intersection of the mountain and valley folds with the crease (10) on the right side of the sheet is the pivot point (30). In addition to these folds, the vertical portion (14) of the foldable backdrop (the portion of the sheet above the centre line crease (10)) is creased using valley folds (72 and 74) to form three sections or panels: a left side panel (76), a central panel (78) and a right side panel (80). There is a first top corner of the sheet (82) where the first side edge (6) meets the top edge (2). There is a second top corner of the sheet (84) where the second side edge (8) meets the top edge (2).

Figure 23:
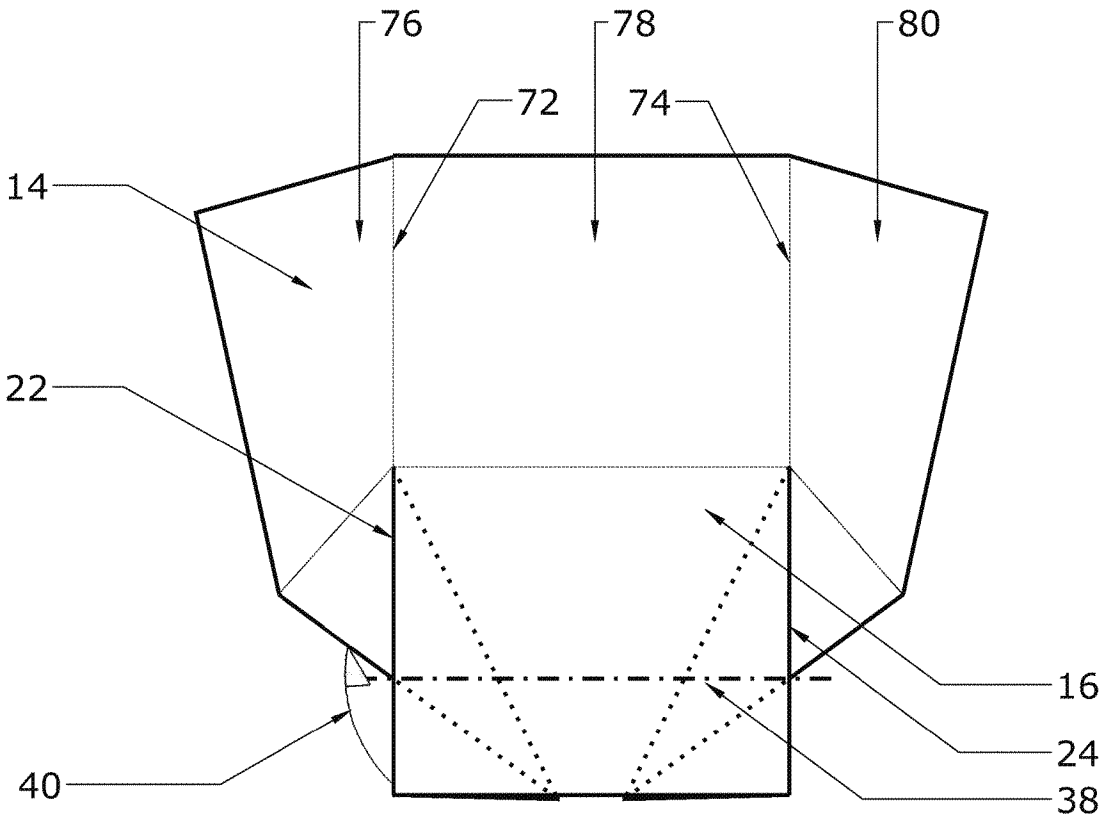
FIG. 23 is a perspective view of FIG. 22 that depicts the completed "panelled" backdrop with an optional fold used to flip a portion of the base underneath the backdrop.

FIG. 23 is a perspective plan view of FIG. 22 that depicts the completed "panelled" backdrop with its three panels (76, 78 and 80) that segment the vertical plane (14). A mountain fold (38) is positioned from the left side mountain fold (22) to the right side mountain fold (24). This is an optional fold used to flip a portion of the base underneath the backdrop. An arrow using standard origami diagramming symbols (40) depicts the action needed to mountain-fold the material along the folding line (38).

Figure 24:
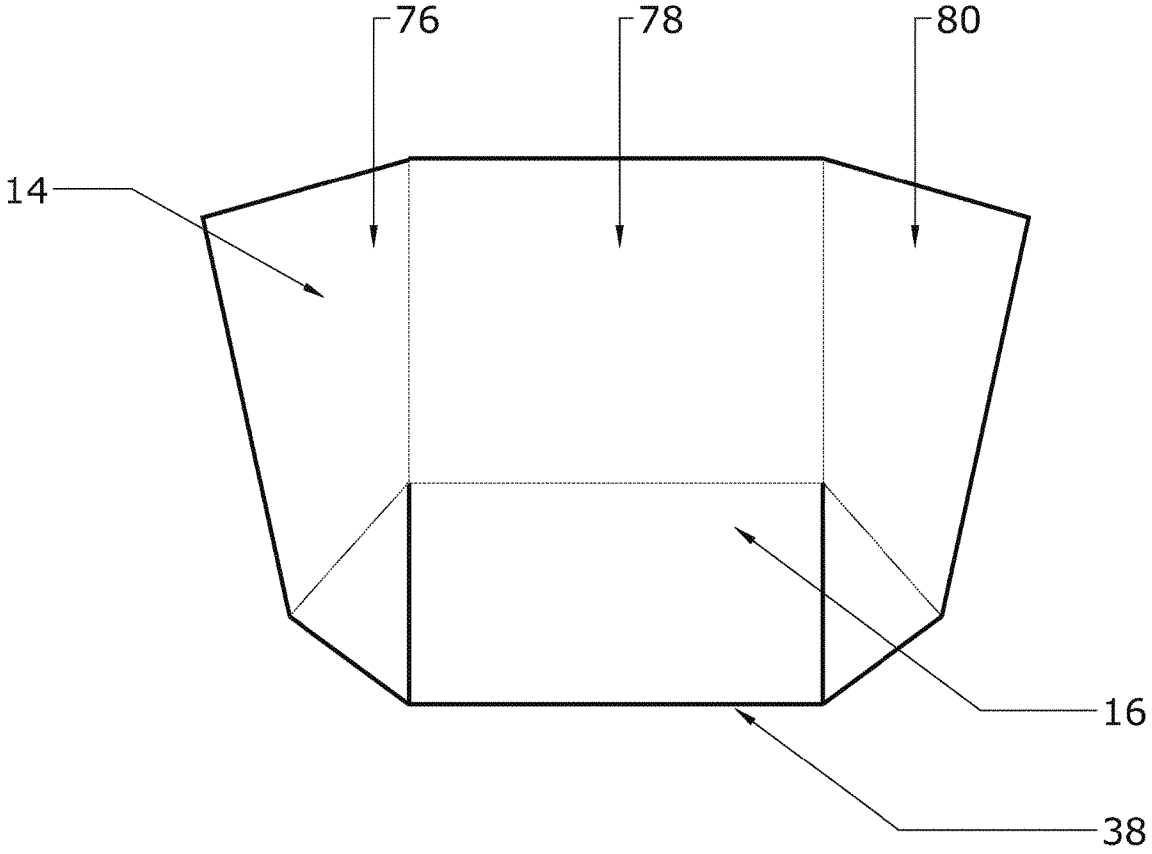
FIG. 24 is a perspective view of FIG. 23 shows the completed "panelled" backdrop.

FIG. 24 is a perspective plan view of FIG. 23 that shows the completed "panelled" backdrop with its three panels (76, 78 and 80) that segment the vertical plane (14) and the horizontal base (16) with the optional base configuration. The mountain fold from the previous step (38) becomes the front edge of the base.

Figure 25:
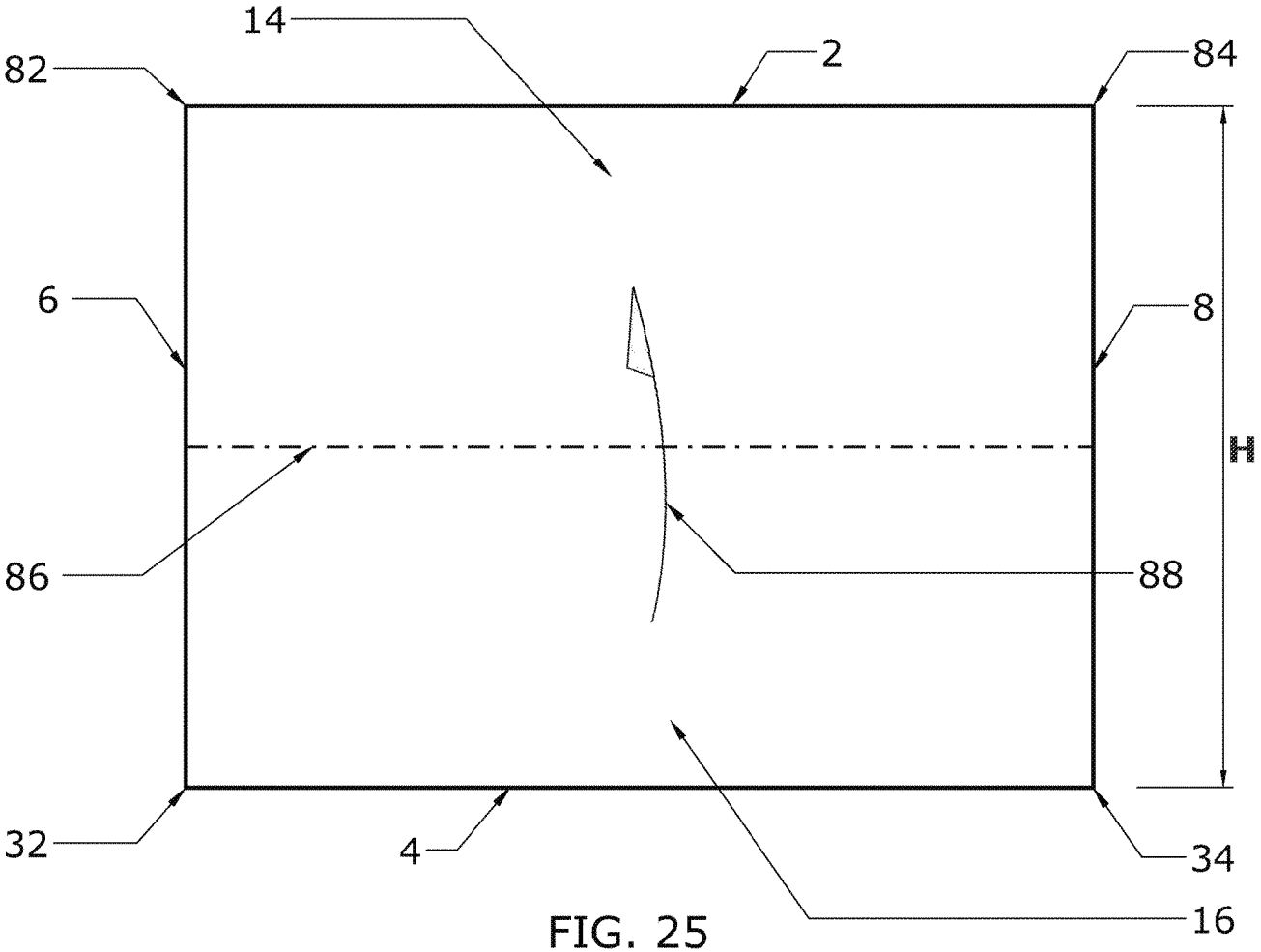
FIG. 25 is a top plan view of FIG. 1 that depicts the sheet of material used to start folding an additional embodiment of the folding process called the "raised base" backdrop and the first mountain fold.

FIG. 25 is a top plan view of FIG. 1 that depicts the sheet of material used to start folding an additional embodiment of the folding process called the "raised base" backdrop. The sheet has a top edge (2), a bottom edge (4), a first side edge on the left (6) and a second side edge on the right (8). There is a first top corner of the sheet (82) where the first side edge (6) meets the top edge (4). There is a second top corner of the sheet (84) where the second side edge (8) meets the top edge (4). There is a first bottom corner of the sheet (32) where the first side edge (6) meets the bottom edge (2) and there is a second bottom corner of the sheet (34) where the second side edge (8) meets the bottom edge (2). The first step in the folding process is a mountain fold (86), the placement of which should be such that half or more of the sheet remains at the bottom portion of the sheet. The portion above the fold (86) towards the top of the sheet will become the vertical plane of the backdrop (14). The portion below the fold (86) towards the bottom of the sheet will become the base of the backdrop (16). Optimally, the placement of (86) should bisect the height of the sheet (H), maximizing the resulting vertical backdrop while providing enough mass at the base to allow for the unit to be free-standing. The curved arrow (88) is a folding instruction that indicates the direction of the mountain fold.

Figure 26:
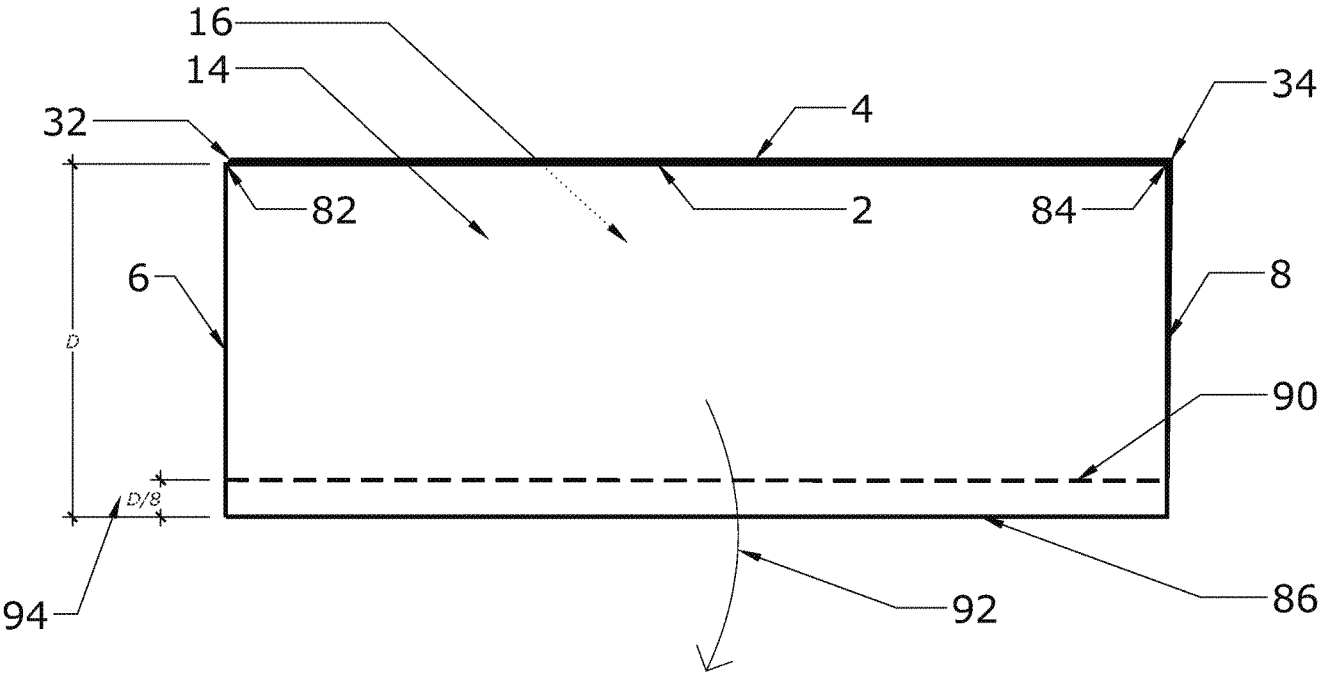
FIG. 26 is a top plan view of FIG. 25 that shows the result of the previous step and the next valley fold.

FIG. 26 is a top plan view of FIG. 25 that shows the result of the previous step. The bottom portion of the sheet (16) has been folded up and behind the top portion of the sheet (14), the result of which is that the left bottom corner of the sheet (32) is now behind the left top corner (82) and the right bottom corner of the sheet (34) is now behind the right top corner (84). The previous bottom edge (4) is now behind the top edge (2). The previous mountain fold (86) becomes the new bottom edge and will eventually be the line of demarcation between the base (16) and the vertical plane (14). There is a distance (D) shown with standard dimension lines that represents the measurement from the top edge (4) to the bottom edge (86). There is a new valley fold (90) that spans the width of the sheet from the left edge (6) to the right edge (8). There is a distance (94) that represents the measurement from the valley fold (90) to the bottom edge (86). This distance (94) also governs the eventual height of the raised base and should be approximately ⅛ of the distance (D). The distance (94) will be used repeatedly in the following figures. There is a distance (D/8) shown with standard dimension lines that represents the distance (94). The curved arrow (92) is a folding instruction that indicates the direction of the valley fold.

Figure 27:
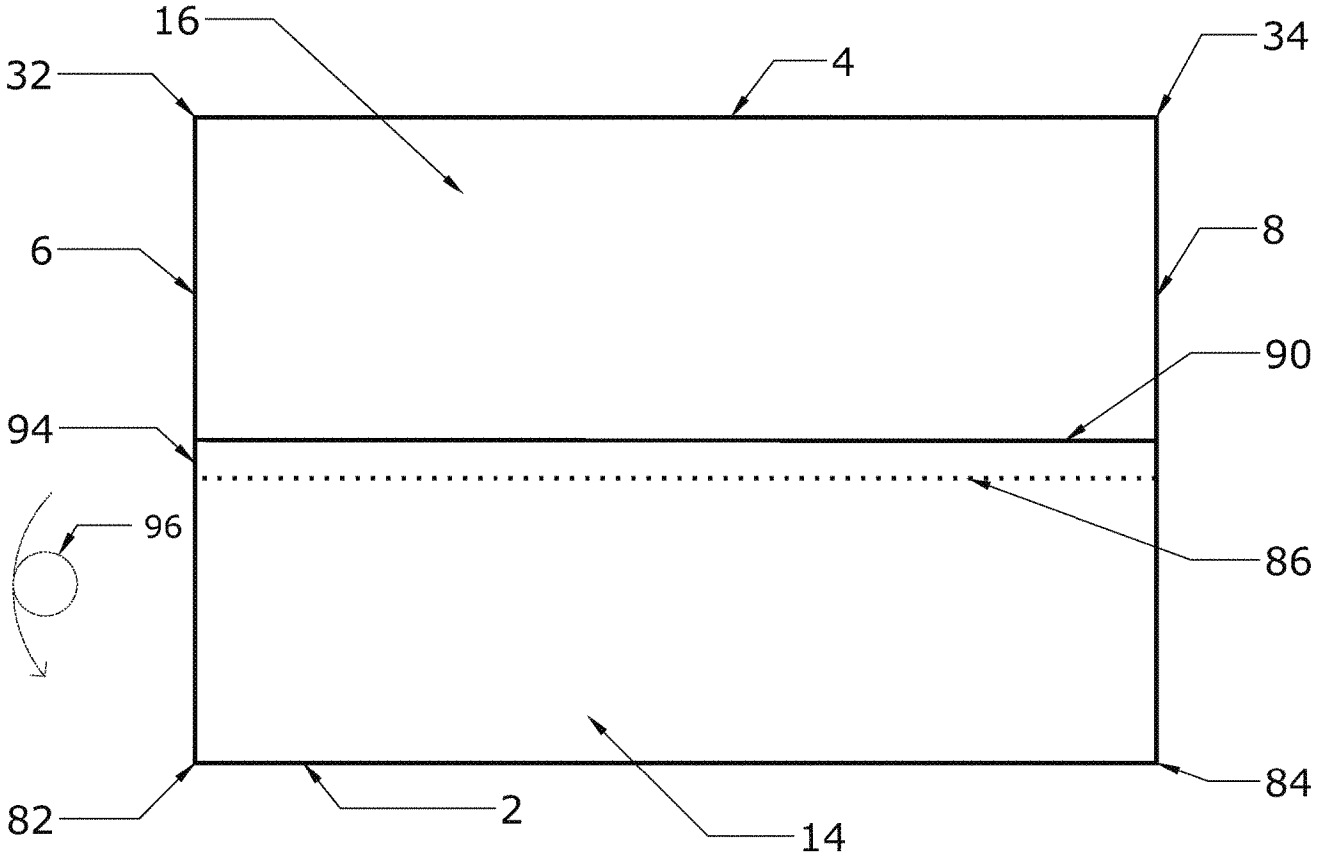
FIG. 27 is a top plan view of FIG. 26 that shows the result of the previous step.

FIG. 27 is a top plan view of FIG. 26 that shows the result of the previous step. Note that because of the folding in the previous steps, the labelling is inconsistent as the top and bottom corners have been flipped. This will correct itself in the next step. The dotted x-ray line shows the mountain fold (86) base behind the top sheet that will eventually be the rear edge of the three-dimensional backdrop. The eventual height of the raised base is shown as the distance (94). The fold (90) separates the sheet into a portion (14) that will become the vertical plane and a portion (16) that will become the base. An arrow using standard origami diagramming symbols (96) depicts the action needed to turn the entire backdrop over top-to-bottom.

Figure 28:
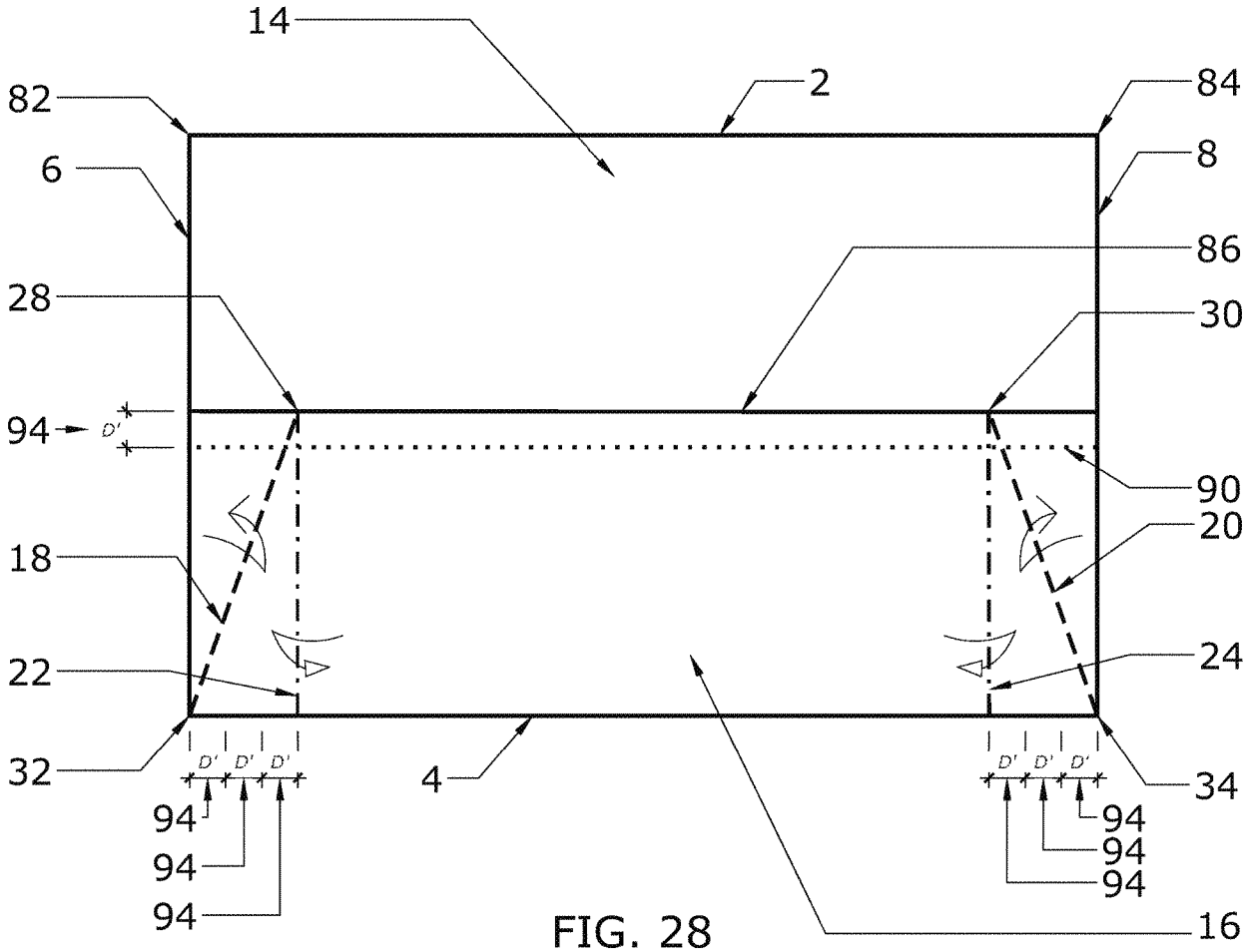
FIG. 28 is a plan view of FIG. 27 showing the result of flipping the backdrop over.

FIG. 28 is a plan view of FIG. 27 showing the result of flipping the backdrop over. Now all of the labelling is consistent with a typical sheet namely: a first bottom corner of the sheet (32) where the first side edge (6) meets the bottom edge (4); a second bottom corner of the sheet (34) where the second side edge (8) meets the bottom edge (4); a first top corner of the sheet (82) where the first side edge (6) meets the top edge (2) and a second top corner of the sheet (84) where the second side edge (8) meets the top edge (2). The fold (86) separates the sheet into a top portion (14) that will become the vertical plane and a bottom portion (16) that will become the base. A valley fold (18) is on the left side of the sheet from a pivot point (28) to a first bottom corner of the sheet (32) where the first side edge (6) meets the bottom edge (4); a valley fold (20) is on the right side of the sheet from a pivot point (30) to a second bottom corner of the sheet (34) where the second side edge (8) meets the bottom edge (4); a mountain fold on the left side of the sheet is the dashed and dotted line (22); a mountain fold on the right side of the sheet is the dashed and dotted line (24). The confluence or intersection of the mountain and valley folds with the previous fold (86) on the left side of the sheet is the pivot point (28). The confluence or intersection of the mountain and valley folds with the previous fold (86) on the right side of the sheet is the pivot point (30). The dotted x-ray line shows the previous valley fold (90) behind the top sheet. The eventual height of the raised base is shown as the distance (94). The placement of the pivot points (28 and 30), inset from the outside edges of the backdrop (6 and 8), must be three times the height set in FIG. 26, shown here as D' (94). FIG. 26 describes the calculation of this measurement. Arrows using standard origami diagramming symbols depicts the action needed to fold and unfold the mountain and valley folds.

Figure 29:
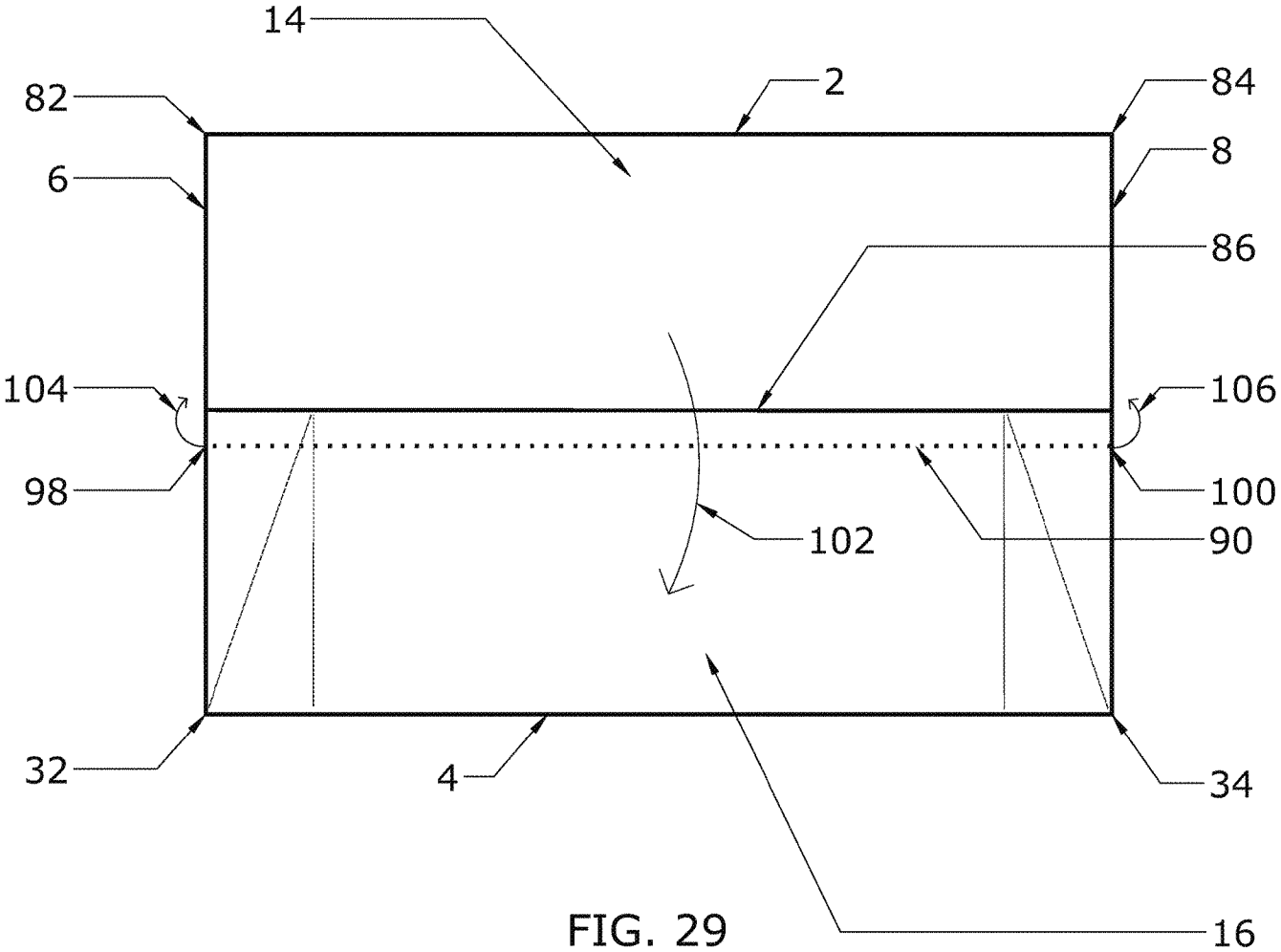
FIG. 29 is a plan view of FIG. 28 showing the result of the creases made in the previous step.

FIG. 29 is a plan view of FIG. 28 showing the result of the creases made in the previous step. The dotted x-ray line shows the previous valley fold (90) behind the top sheet. The intersection point of the left edge (6) and the hidden fold (90) is shown as a point (98). The intersection point of the right edge (8) and the hidden fold (90) is shown as a point (100). Standard origami diagramming arrows (102, 104 and 106) depict the action needed to flip the top portion of the sheet (14) down using the fold (86) as a hinge.

Figure 30:
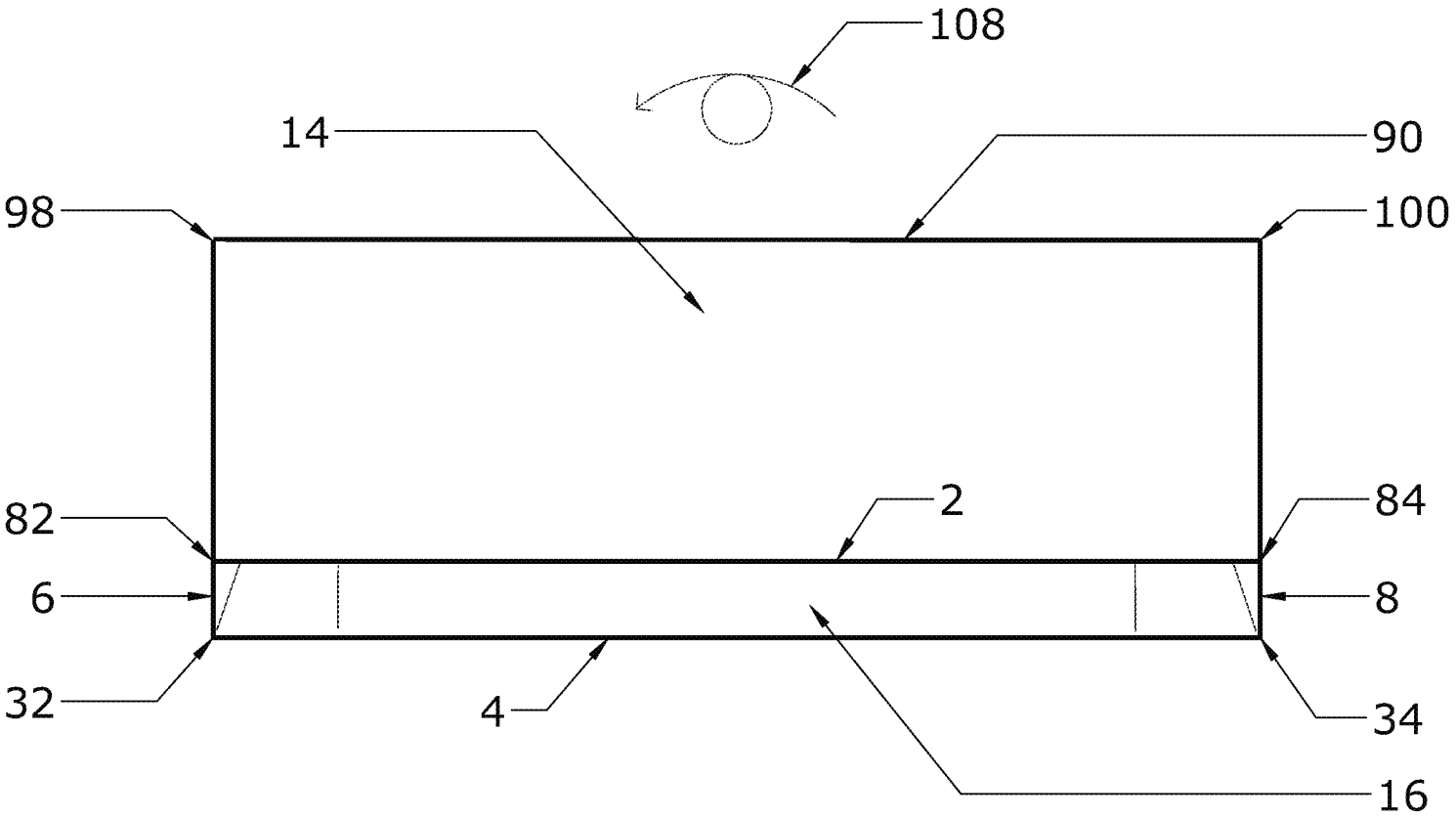
FIG. 30 is a plan view of FIG. 29 showing the previously-hidden fold now as the top edge of the backdrop.

FIG. 30 is a plan view of FIG. 29 showing the previously-hidden fold (90) now as the top edge of the backdrop as the top portion of the backdrop (14) has been flipped down to rest on top of the base (16). The intersection point (98) is now in the top left corner and the intersection point (100) is now in the top right corner. The previous top edge (2) is on top of the base (16), set back from the bottom edge (4) by a certain distance. Its corners (82 and 84) are likewise resting on top of the left edge (6) and the right edge (8) respectively. An arrow using standard origami diagramming symbols (108) depicts the action needed to turn the entire backdrop over side-to-side.

Figure 31:
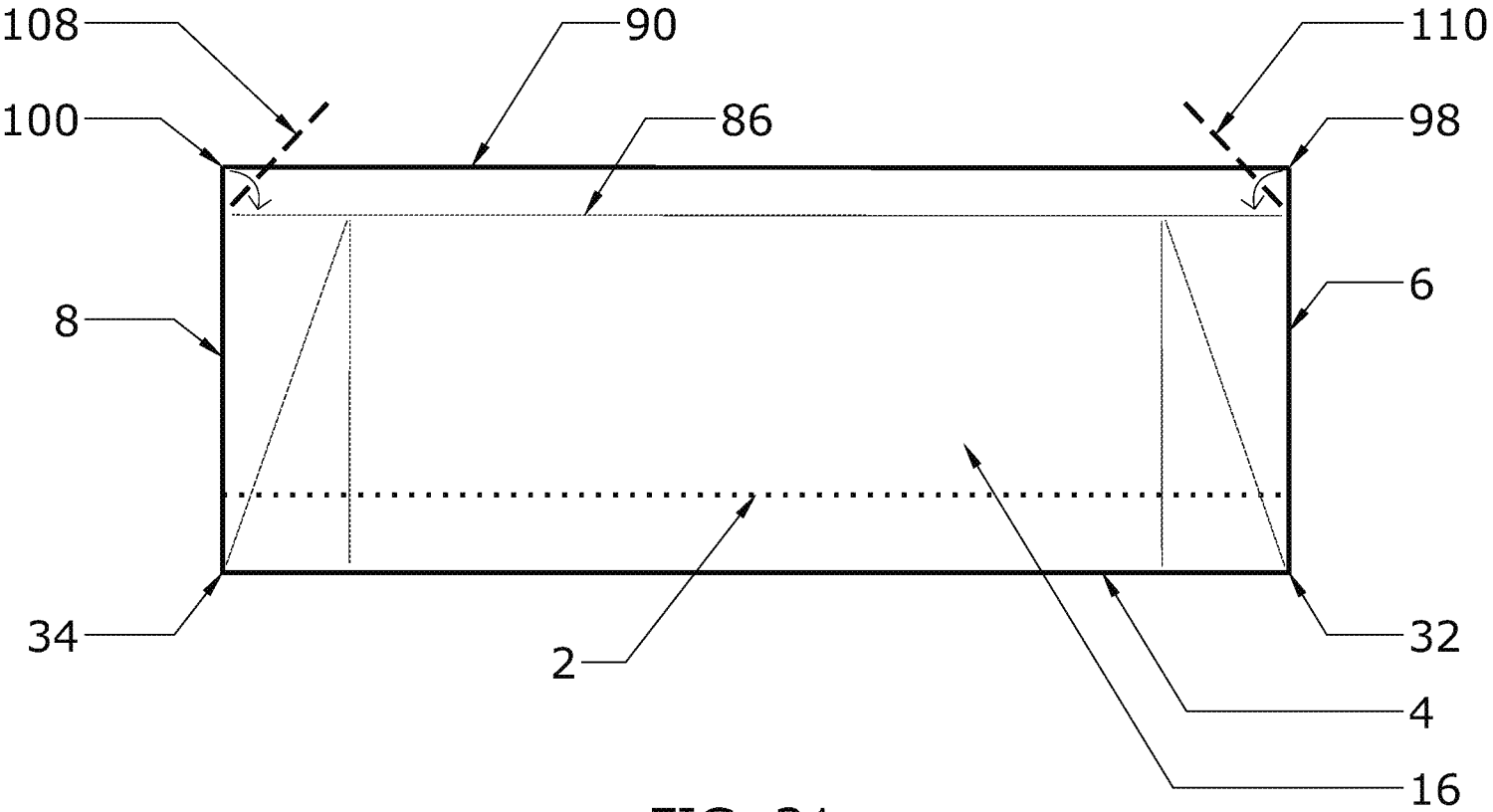
FIG. 31 is a plan view of FIG. 30 showing the result of the backdrop flipped over as well as the first corner locking folds.

FIG. 31 is a plan view of FIG. 30 showing the result of the backdrop flipped over side-to-side. The dotted x-ray line shows the placement of the previous top edge (2) behind the base (16). The bottom edge (4) of the base is shown. The flipping action has reversed the position of the sides (6) and (8) as well as their respective corners (32), (34), (98) and (100). A valley fold line (108) bisecting the angle between the left edge (8) and the crease line (86) depicts the first fold used to "lock" the corner (100). A second valley fold line (110) bisecting the angle between the right edge (6) and the crease line (86) depicts the first fold used to "lock" the corner (98). Arrows using standard origami diagramming symbols depict the action needed to fold the corners down.

Figure 32:
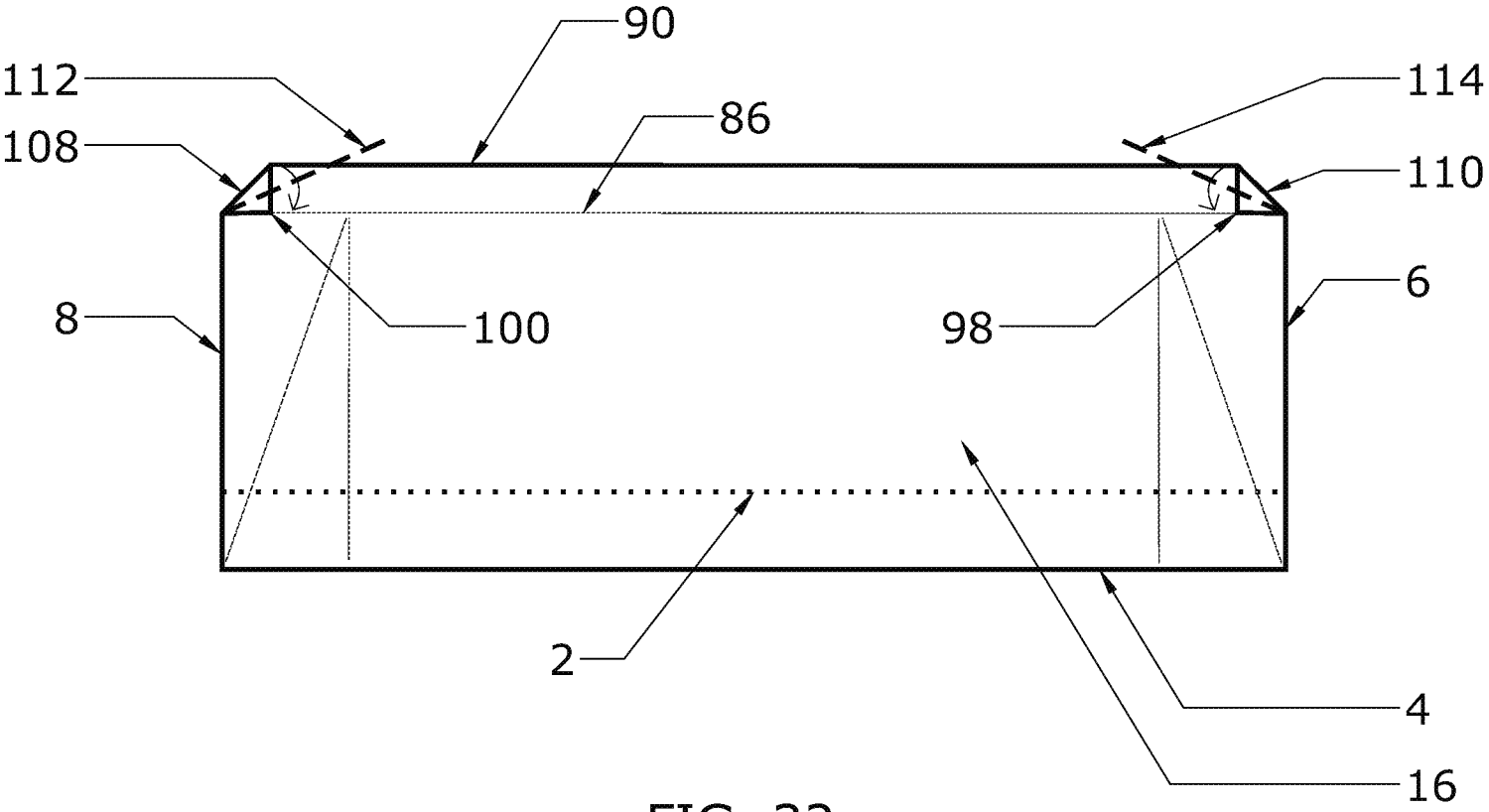
FIG. 32 is a plan view of FIG. 31 with the second corner locking folds.

FIG. 32 is a plan view of FIG. 31. A valley fold line (112) bisecting the angle between the left completed fold (108) and the crease line (86) depicts the second fold used to "lock" the corner (100). A valley fold line (114) bisecting the angle between the right completed fold (110) and the crease line (86) depicts the second fold used to "lock" the corner (98). The bottom edge (4) of the base (16) is shown as well as the backdrop's left side edge (8) and right side edge (6). Arrows using standard origami diagramming symbols depict the action needed to fold the edges down.

Figure 33:
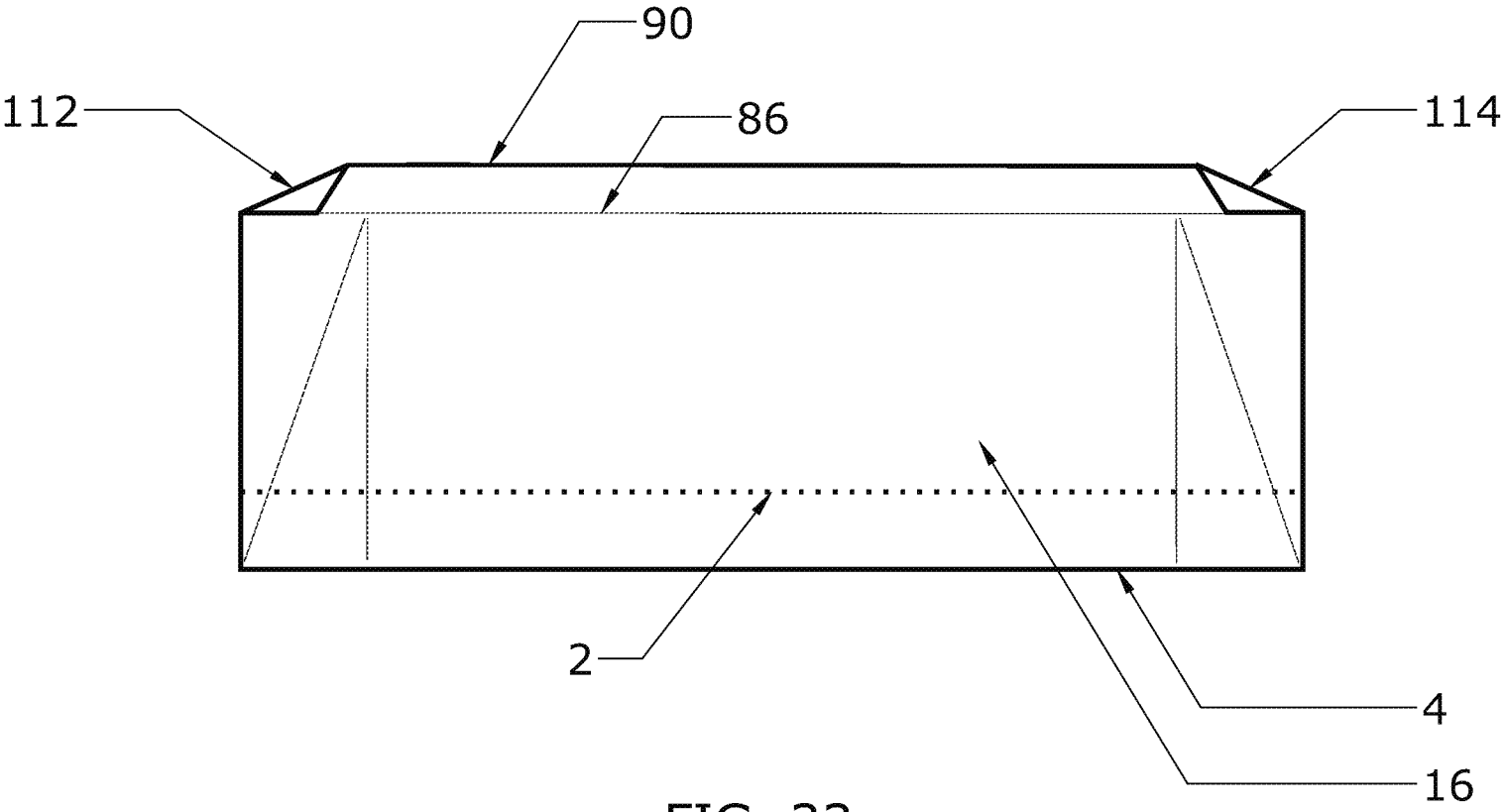
FIG. 33 is a plan view of FIG. 32 showing the result of locking the corners of the backdrop.

FIG. 33 is a plan view of FIG. 32 showing the result of the previous step with the corners "locked". The completed left edge locked corner (112) and the completed right edge locked corner (114) are shown on each side of the top edge (90). The crease previously used as a hinge (86) is shown. The dotted x-ray line shows the placement of the previous top edge (2) behind the base (16).

Figure 34:
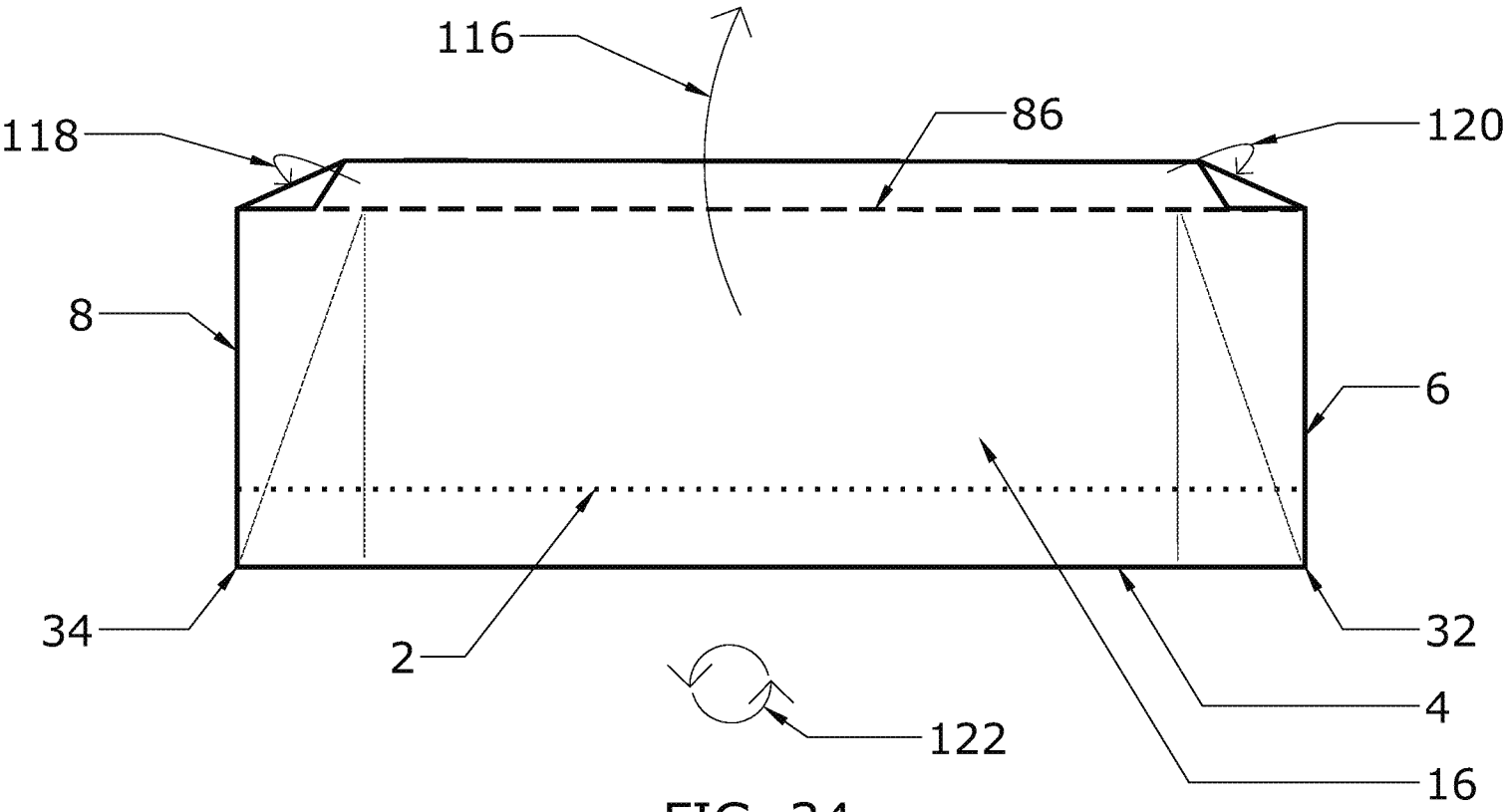
FIG. 34 is a plan view of FIG. 33 with the next valley fold.

FIG. 34 is a plan view of FIG. 33 that depicts using the crease (86) as the next valley fold used to first flip the base (16) up, denoted by the instructional arrows (116, 118 and 120). A double arrow using standard origami diagramming symbols (122) depicts the action needed to next rotate the entire backdrop 180 degrees. The dotted x-ray line shows the placement of the previous top edge (2) behind the base (16). The bottom edge (4) of the base (16) is shown as well as the backdrop's left side edge (8) and right side edge (6).

Figure 35:
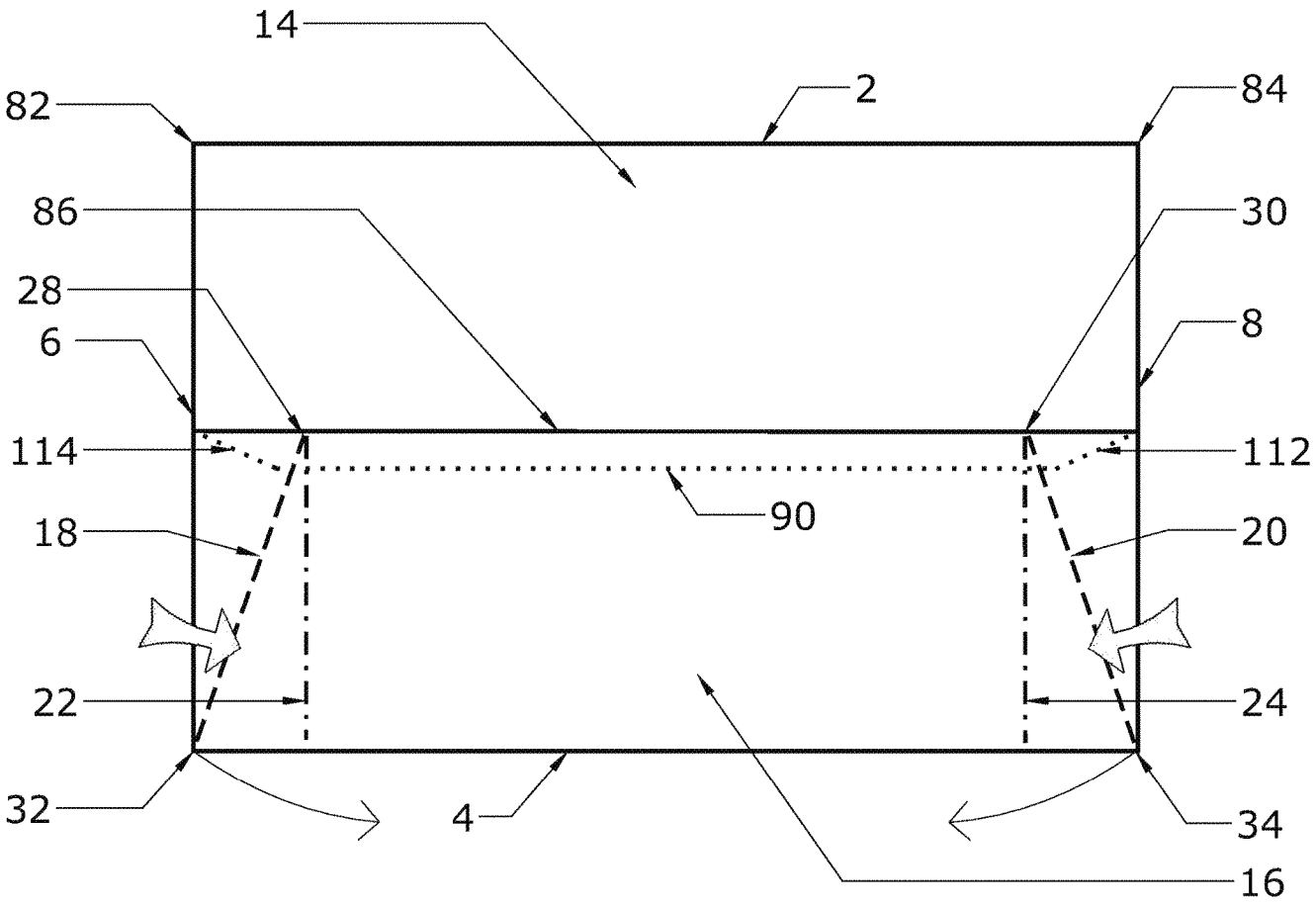
FIG. 35 is a plan view of FIG. 34 that shows the result of the previous step as well as a depiction of the key folds in the folding process and a typical placement of same.

FIG. 35 is a plan view of FIG. 34 that shows the result of the previous step. The flipping and rotating action has revealed the vertical plane (14) when the base (16) was flipped up; it has reversed the position of the planes (14) and (16), the sides (6) and (8) as well as their respective corners (32), (34), (82) and (84). Now all of the labelling is consistent with a typical sheet namely: a first bottom corner of the sheet (32) where the first side edge (6) meets the bottom edge (4); a second bottom corner of the sheet (34) where the second side edge (8) meets the bottom edge (4); a first top corner of the sheet (82) where the first side edge (6) meets the top edge (2) and a second top corner of the sheet (84) where the second side edge (8) meets the top edge (2). The fold (86) separates the sheet into a top portion (14) that will become the vertical plane and a bottom portion (16) that will become the base. A valley fold (18) is on the left side of the sheet from a pivot point (28) to a first bottom corner of the sheet (32) where the first side edge (6) meets the bottom edge (4); a valley fold (20) is on the right side of the sheet from a pivot point (30) to a second bottom corner of the sheet (34) where the second side edge (8) meets the bottom edge (4); a mountain fold on the left side of the sheet is the dashed and dotted line (22); a mountain fold on the right side of the sheet is the dashed and dotted line (24). The confluence or intersection of the mountain and valley folds with the fold (86) on the left side of the sheet is the pivot point (28). The confluence or intersection of the mountain and valley folds with the fold (86) on the right side of the sheet is the pivot point (30). The completed left edge locked corner (114) and the completed right edge locked corner (112) on each side of the edge (90) are shown as dotted x-ray lines behind the base (16). Various arrows using standard origami diagramming symbols depict the actions needed to fold the material along the folding lines.

Figure 36:
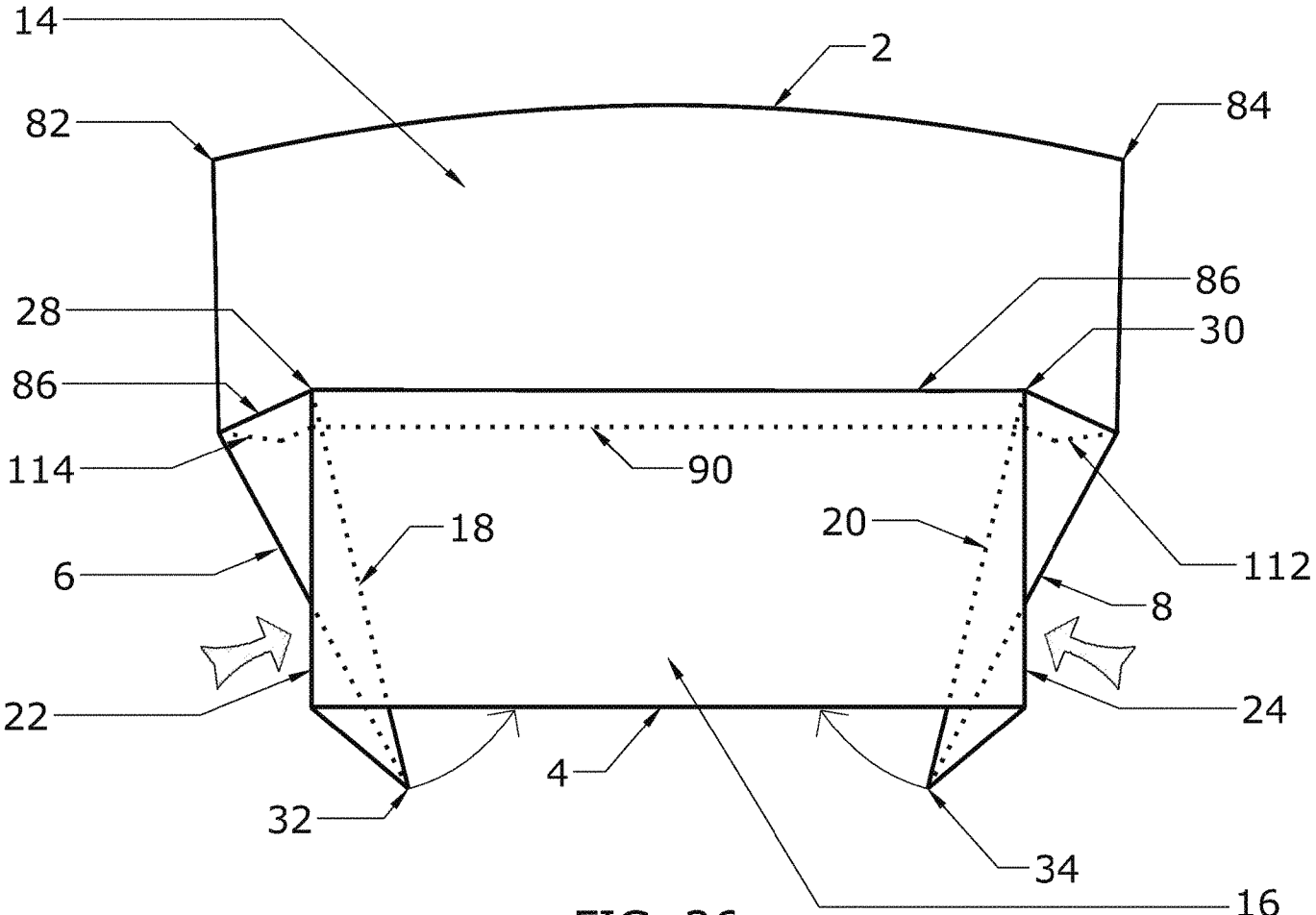
FIG. 36 is a perspective plan view of FIG. 35 that shows the backdrop becoming three-dimensional.

FIG. 36 is a perspective plan view of FIG. 35 that shows the backdrop becoming three-dimensional. The left side of the backdrop is partially folded as the left side of the vertical plane (14) is forced vertically into position along the fold (86). The partially-folded left side mountain fold (22) and the partially-folded left side valley fold (18) are shown, as well as the partially-moved corner (32). The left side edge (6) has been partially forced under the base (16). The partially-folded right side mountain fold (24) and the partially-folded right side valley fold (20) are shown, as well as the partially-moved corner (34). The top edge (2) begins to show the curve in the backdrop (14) and the top left corner (82) and top right corner (84) begin to shift as well. The lower portion of the right side edge (8) has been partially forced under the base (16). The completed left edge locked corner (114) and the completed right edge locked corner (112) on each side of the edge (90), shown as dotted x-ray lines behind the base (16), begin to shift. Various arrows using standard origami diagramming symbols depict the actions needed to fold the material along the folding lines.

Figure 37:
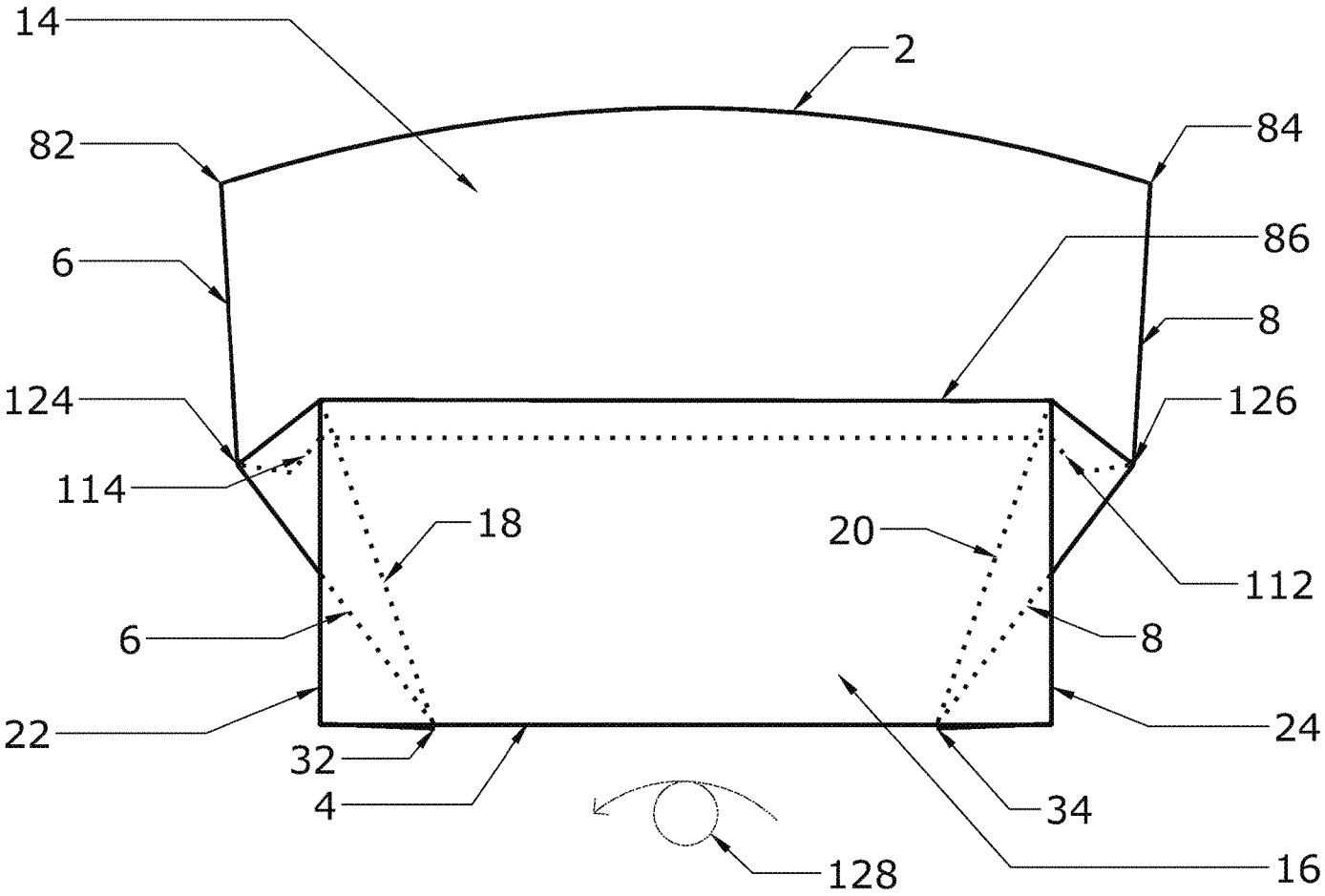
FIG. 37 is a perspective plan view of FIG. 36 that depicts the backdrop with the now vertical plane.

FIG. 37 is a perspective plan view of FIG. 36 that depicts the backdrop with the now vertical plane (14) with its curved top edge (2) and the horizontal base (16) separated by the fold (86). The top left corner (82) and the top right corner (84) are in their final positions. Dotted x-ray lines show the position of the material behind the main base of the backdrop. The lower portion of the left side edge (6) has been completely forced under the base. The completely-folded left side mountain fold (22) and the completely-folded left side valley fold (18) are shown, as well as the corner (32) in its final position. The completely-folded right side mountain fold (24) and the completely-folded right side valley fold (20) are shown, as well as the corner (34) in its final position. A portion of the right side edge (8) has been completely forced under the base (16). The completed left edge locked corner (114) and the left hinge point (124) where the left side (6) bends where it intersects the fold (86) are shown. The completed right edge locked corner (112) and the right hinge point (126) where the right side (8) bends where it intersects the fold (86) are shown. An arrow using standard origami diagramming symbols (128) depicts the action needed to turn the entire backdrop over side-to-side.

Figure 38:
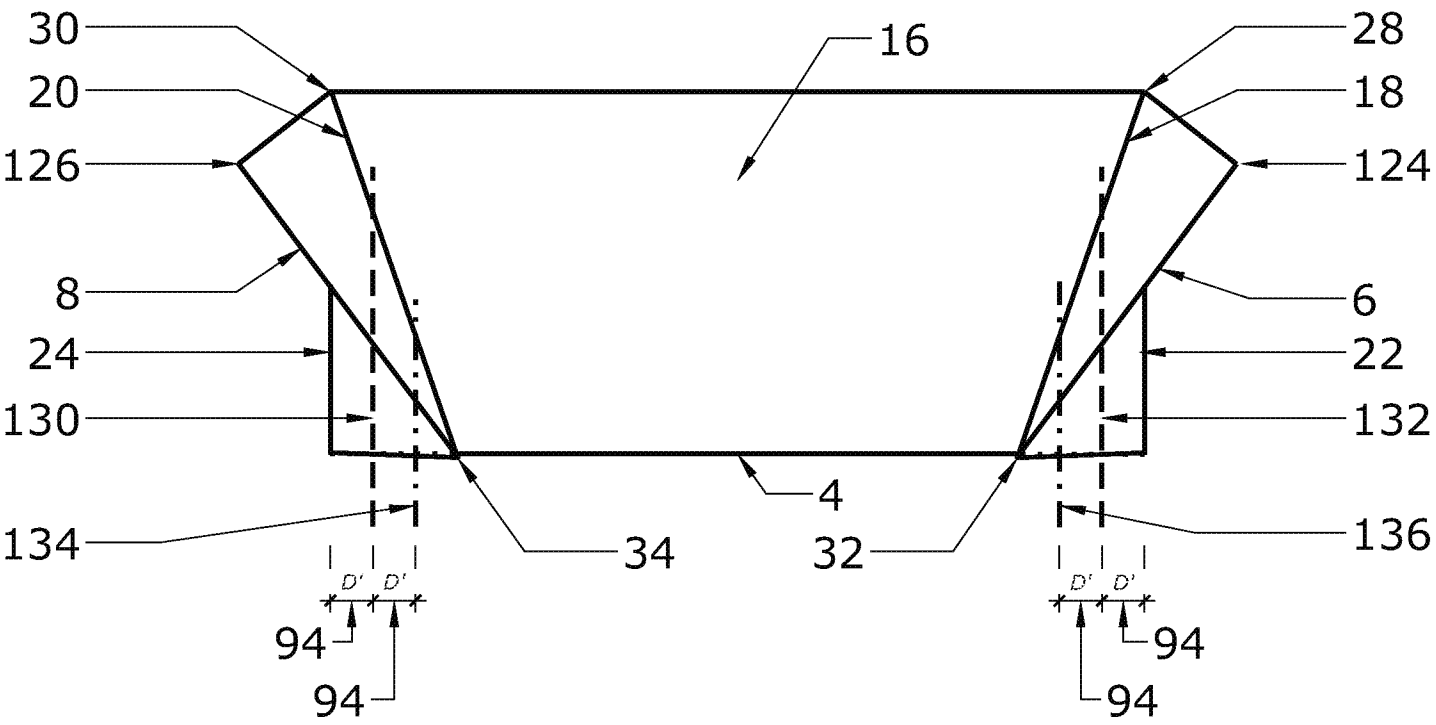
FIG. 38 shows a bottom view of the backdrop from FIG. 37.

FIG. 38 shows a bottom view of the backdrop from FIG. 37. The flipping action from the previous step in FIG. 37 has reversed the position of the sides (6) and (8) as well as their respective corners (32) and (34), the completed valley folds (18) and (20) and the completed mountain folds (22) and (24). The next set of folding lines and their placement is also shown. On each side of the base (16), the flap created by the previous folds is trisected using a valley fold and a mountain fold. This was the reason for the pivot point placement (28) and (30) in FIG. 28. The distance between the sets of lines is the same distance referenced in FIG. 28 and shown here as D'. The left side of the bottom of the backdrop has a valley fold (130) inset from the edge (24) by a distance (94) and a mountain fold ((134) further inset by the same distance (94). The right side of the bottom of the backdrop has a valley fold (132) inset from the edge (24) by a distance (94) and a mountain fold ((136) further inset by the same distance (94). The hinge points (124) and (126) are shown.

Figure 39:
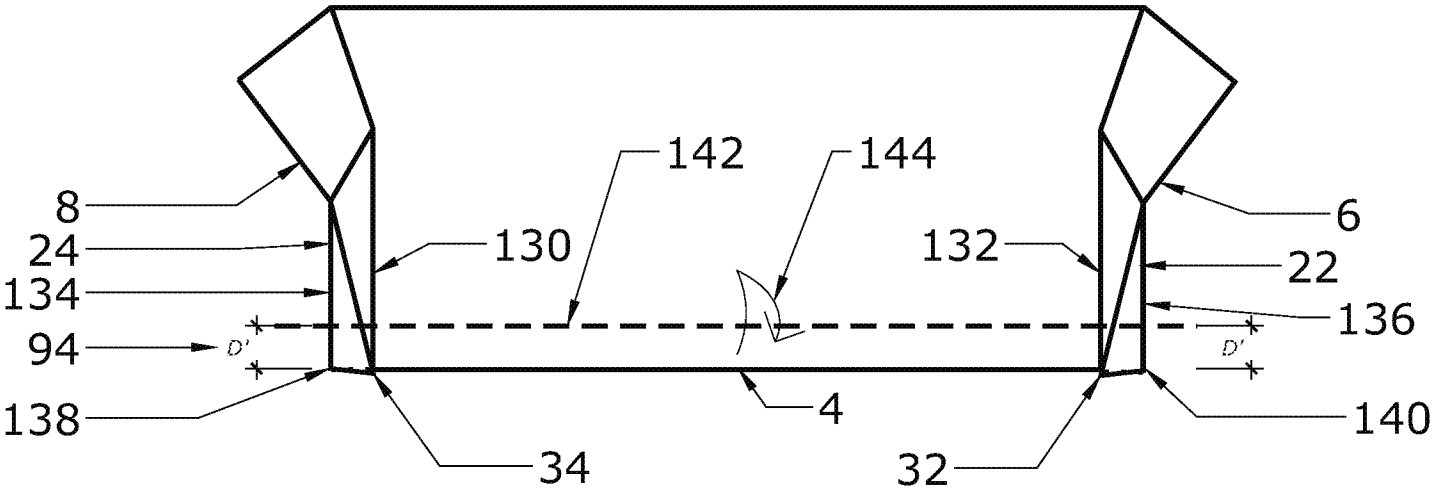
FIG. 39 shows a bottom view of the backdrop from FIG. 38 with the placement of the next valley fold.

FIG. 39 shows a bottom view of the backdrop from FIG. 38 with the placement of the next valley fold (142). The left side of the backdrop shows the completed valley fold (130) and the completed mountain fold (134) where it rests on top of the edge (24). The corner (34) rests on top of the fold (130) where it touches the bottom edge (4). A new left side corner (138) is shown where the fold (134) meets the bottom edge (4). The right side of the backdrop shows the completed valley fold (132) and the completed mountain fold (136) where it rests on top of the edge (22). The corner (32) rests on top of the fold (132) where it touches the bottom edge (4). A new right side corner (140) is shown where the fold (136)

meets the bottom edge (4). The valley fold (142) is inset from the bottom edge of the backdrop (4) by the same distance referenced in FIG. 38 and shown here as D'. This is also the measurement of the height of the base that has been referenced previously as (94). The curved arrow (144) is a folding instruction that indicates the direction of the fold and, in this case as the arrow also reverses direction, an instruction to unfold.

Figure 40:
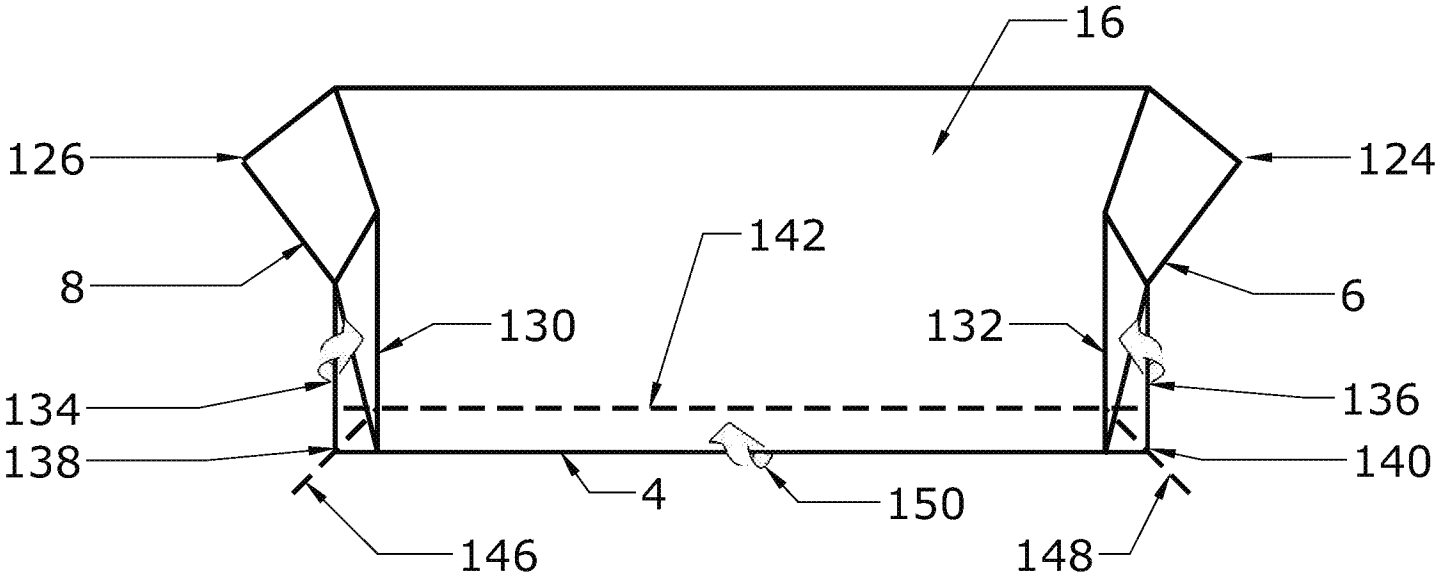
FIG. 40 is a bottom view of the backdrop from FIG. 39 that shows the actions needed to fold and lift the "legs" of the base into position.

FIG. 40 is a bottom view of the backdrop from FIG. 39 that shows the actions needed to fold and lift the "legs" of the base into a position perpendicular to the horizontal base (16). On the left side of the base, there is a valley fold (146) from the corner (138) to the intersection of the valley fold (142) and the fold (130). The outside fold (134) is shown with an arrow indicating how it lifts up using the fold (130) as a hinge. On the right side of the base, there is a valley fold (148) from the corner (140) to the intersection of the valley fold (142) and the fold (132). The outside fold (136) is shown with an arrow indicating how it lifts up using the fold (132) as a hinge. The bottom edge (4) is shown with an arrow (150) indicating how it lifts up using the fold (142) as a hinge. The hinge points (124) and (126) are shown.

Figure 41:
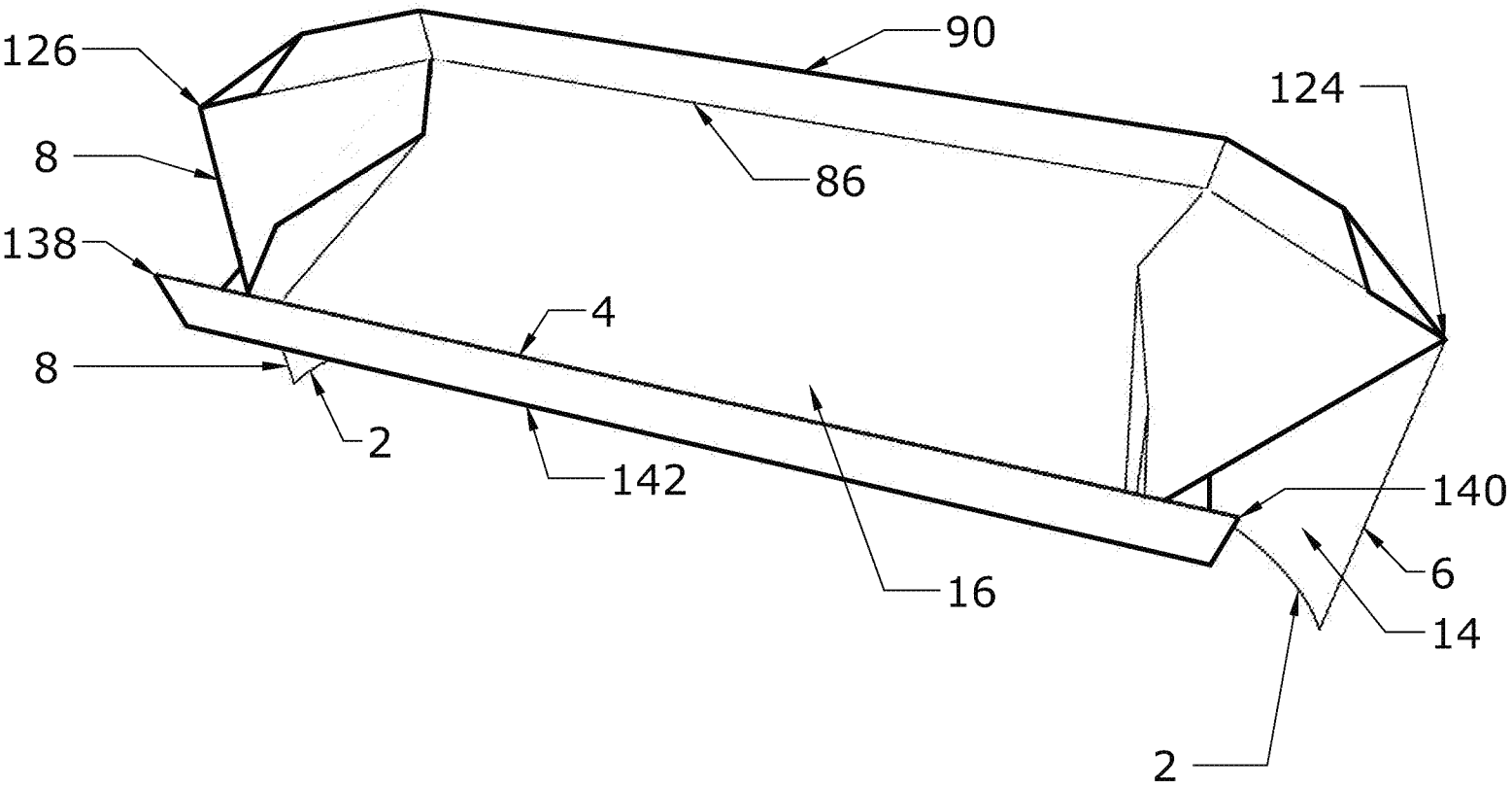
FIG. 41 shows an isometric view of the underside of the backdrop after FIG. 40's actions have been performed.

FIG. 41 shows an isometric view of the underside of the backdrop after FIG. 40's actions have been performed. The backdrop is upside down. The fold (90) will become the back edge of the raised base when the backdrop is turned over. The vertical plane (14) with its curved top edge (2) and the horizontal base (16) are separated by the fold (86). The side edges (6) and (8) are shown. The front bottom corners (138) and (140) are shown. The bottom edge (4) and the front edge of the raised base (142) are shown. The hinge points (124) and (126) are shown.

Figure 42:
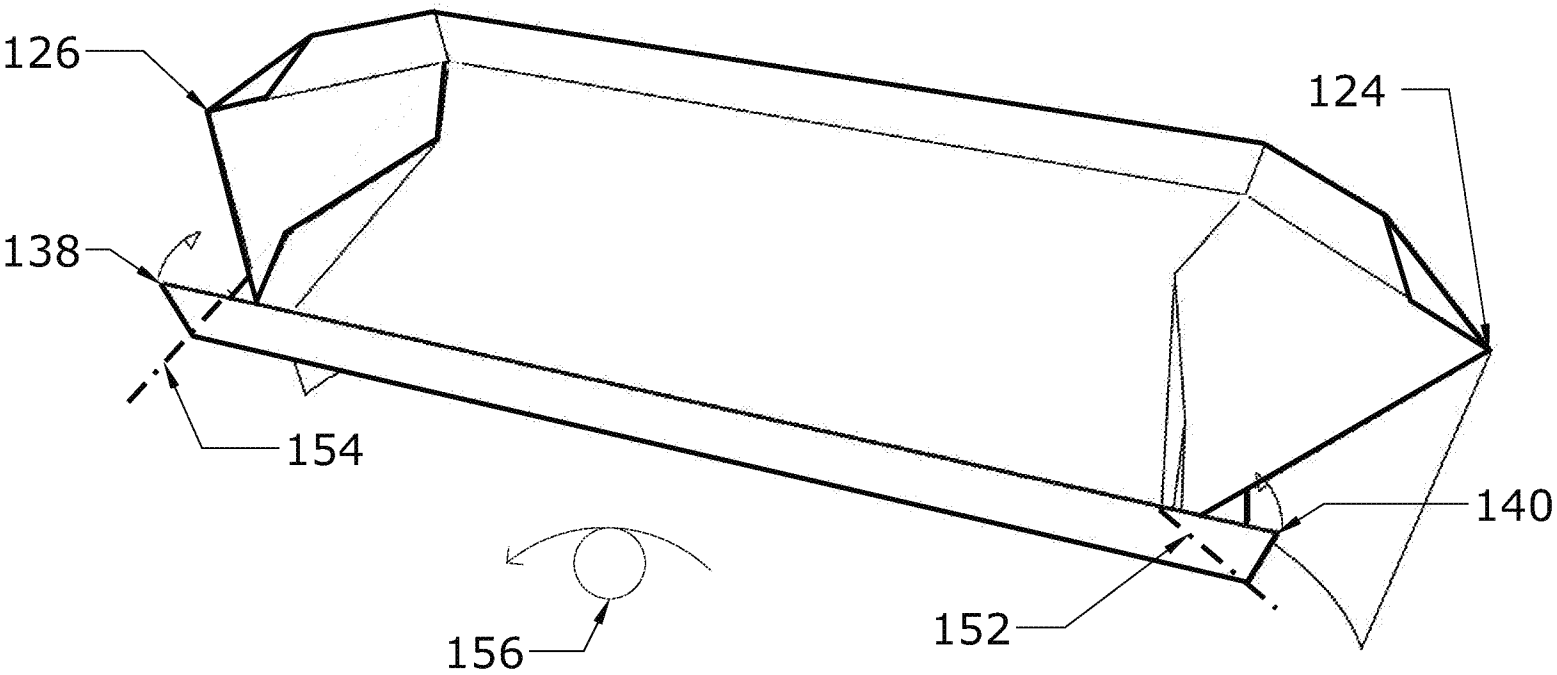
FIG. 42 shows an isometric view of the underside of the backdrop from FIG. 41.

FIG. 42 shows an isometric view of the underside of the backdrop from FIG. 41. The folds required to "lock" the front outside corners of the base are shown: mountain fold (154) folds the corner (138) back behind the front face of the raised base and mountain fold (152) folds the corner (140) back behind the front face of the raised base. The hinge points (124) and (126) are shown. An arrow (156) using standard origami diagramming symbols depicts the action needed to turn the entire backdrop over.

Figure 43:
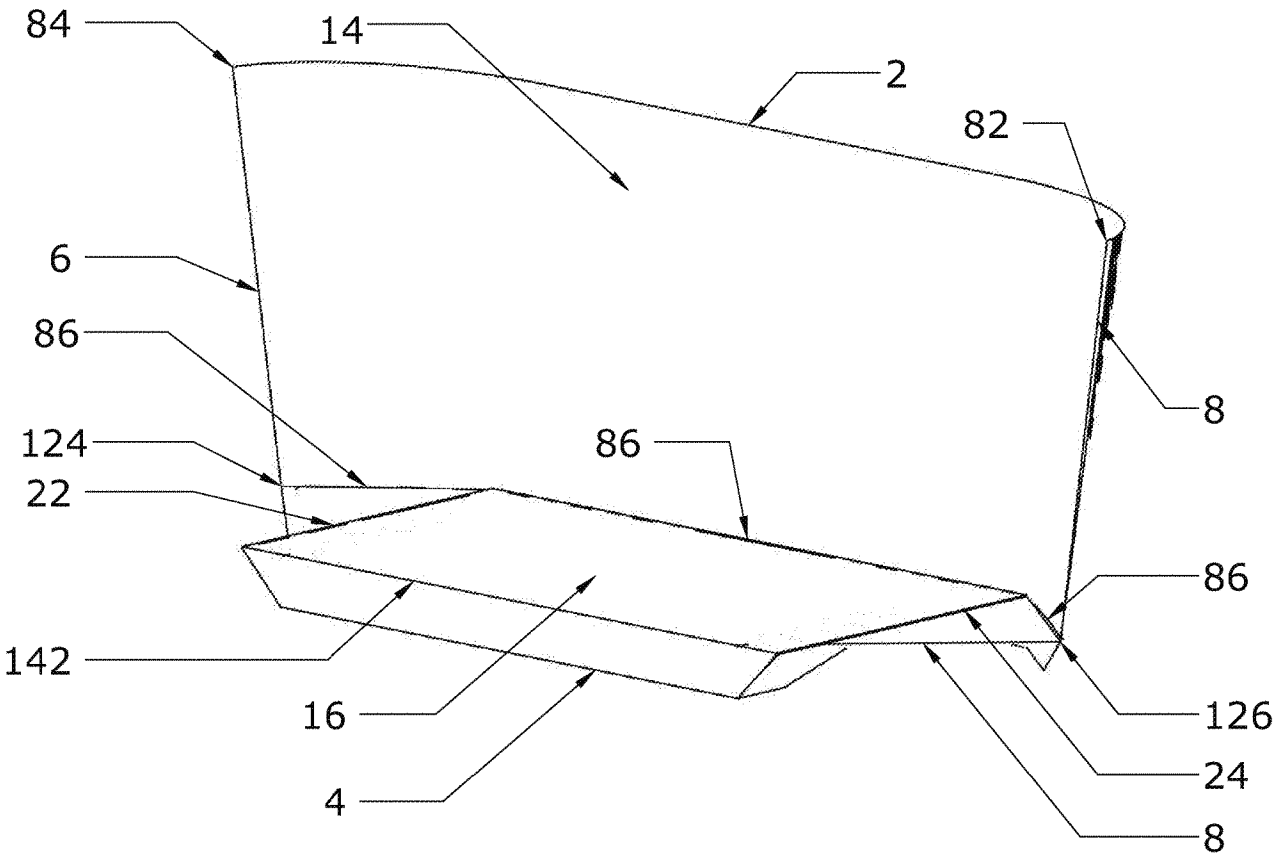
FIG. 43 shows an isometric view of the final "raised base" backdrop.

FIG. 43 shows an isometric view of the final "raised base" backdrop. The vertical plane (14) with its curved top edge (2) and the horizontal base (16) are separated by the fold (86). The side edges (6) and (8) are shown. The front top corners (82) and (84) are shown. The bottom edge (4) and the front edge of the raised base (142) are shown. The completed mountain folds (22) and (24) are shown. The hinge points (124) and (126) are shown.

Figure 44A:
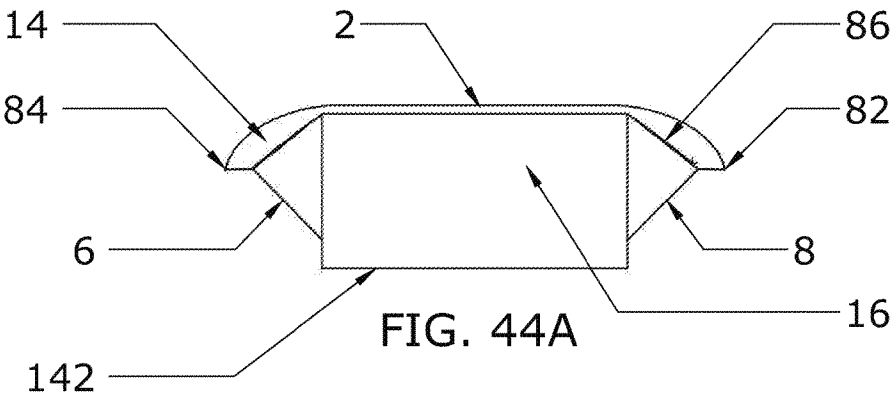
FIG. 44A is a top view of FIG. 43.

FIG. 44A is a top view of FIG. 43 showing the vertical plane (14), the horizontal base (16), the fold line (86) joining the two planes, the curved top edge of the material (2), the left side edge of the material (6), the right side edge of the material (8) and the front edge (142) of the raised base. The front top corners (82) and (84) are shown.

Figure 44D:
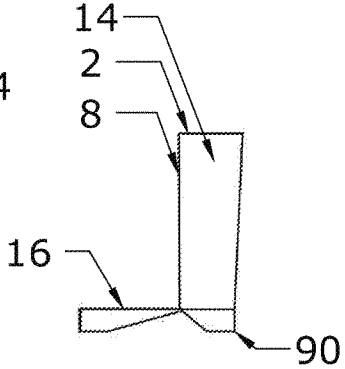
FIG. 44D is a right elevation view of FIG. 43.
Figure 44C:
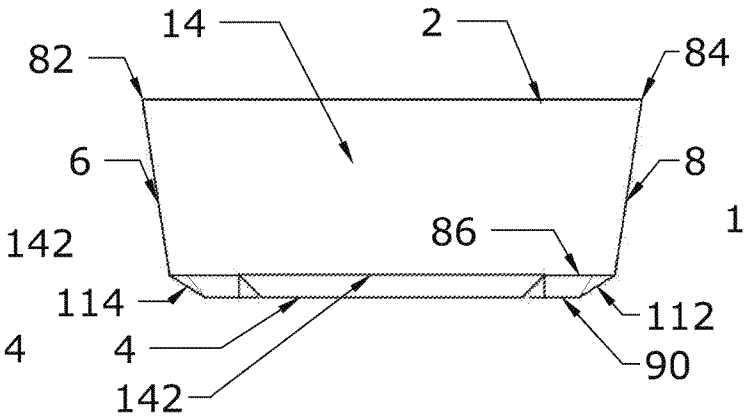
FIG. 44C is a front elevation view of FIG. 43.
Figure 44B:
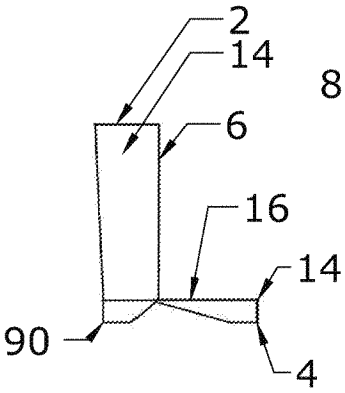
FIG. 44B is a left elevation view of FIG. 43.

FIG. 44B is a left elevation view of FIG. 43 showing the vertical plane (14), the horizontal base (16), the curved top edge of the material (2), the left side edge of the material (6), and the front edge (142) of the raised base. It also shows the front bottom edge (4) and the rear bottom edge (90).

FIG. 44C is a front elevation view of FIG. 43 showing the vertical plane (14), the horizontal base (16), the fold line (86) joining the two planes, the curved top edge of the material (2), the left side edge of the material (6), the right side edge of the material (8), the front edge (142) of the raised base as well as the front bottom edge (4) and the rear bottom edge (90). Also shown are the completed left edge locked corner (114) and the completed right edge locked corner (112) on each side of the edge (90) from FIG. 33.

FIG. 44D is a right elevation view of FIG. 43 showing the vertical plane (14), the horizontal base (16), the curved top edge of the material (2), the right side edge of the material (8), and the rear bottom edge (90) of the "raised base" version of the backdrop.

Figure 45:
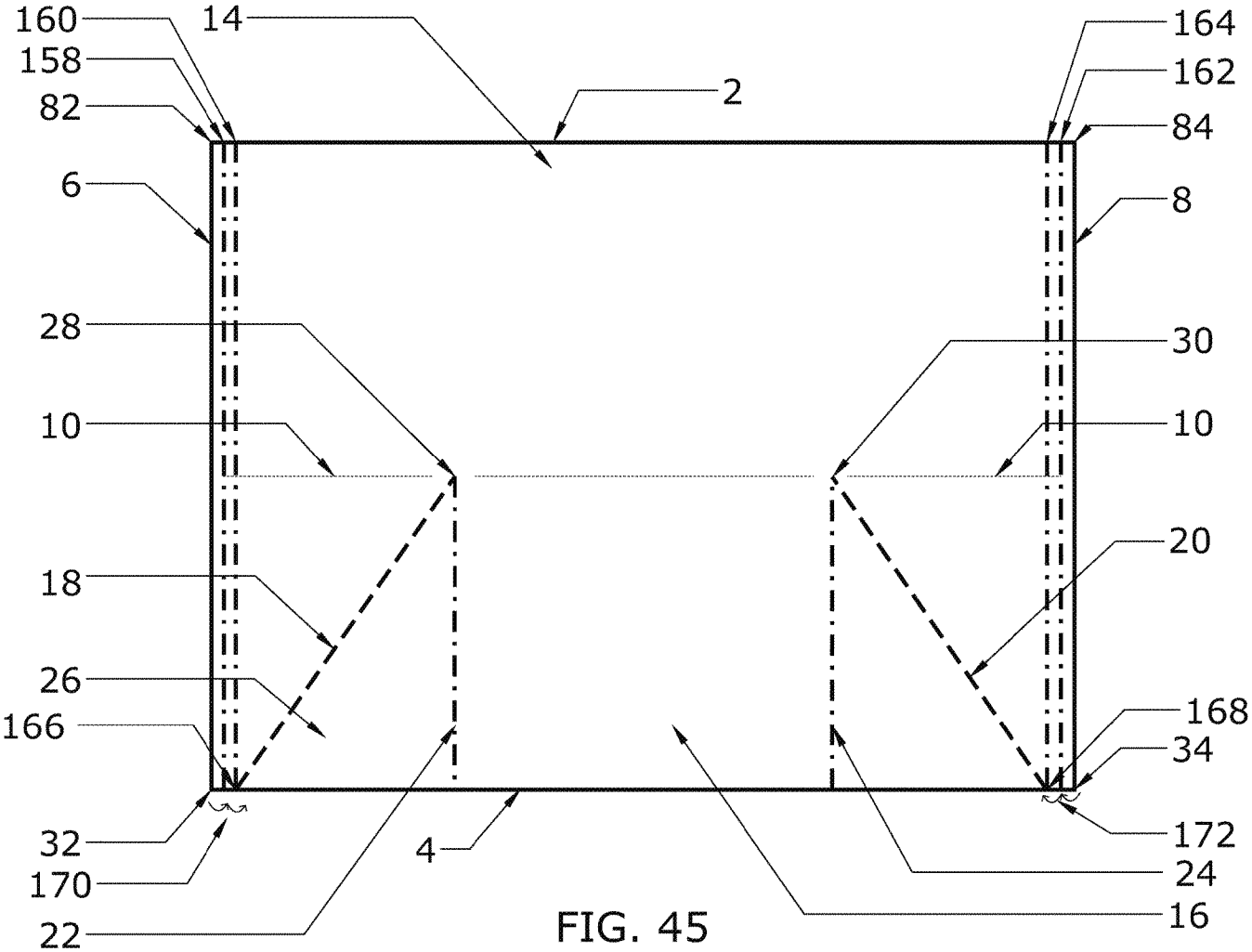
FIG. 45 is a top plan view of FIG. 3 and represents an additional embodiment of the fold placement that results in strengthened or reinforced vertical sides on the backdrop.

FIG. 45 is a top plan view of FIG. 3 and represents an additional embodiment of the fold placement that results in strengthened or reinforced vertical sides on the backdrop. The basic folds of the folding process are identical to those noted in FIG. 3: namely, the thin line (10) is the crease produced by valley-folding the sheet in half in FIG. 2; a valley fold (18) is on the left side of the sheet from a pivot point (28) to an intersection point (166) where the second mountain fold on the left side (160) intersects the bottom edge (4). A valley fold (20) is on the right side of the sheet from a pivot point (30) to an intersection point (168) where the second mountain fold on the right side (164) meets the bottom edge (4); a mountain fold on the left side of the sheet is the dashed and dotted line (22); a mountain fold on the right side of the sheet is the dashed and dotted line (24). The confluence or intersection of the mountain and valley folds with the crease (10) on the left side of the sheet is the pivot point (28). The confluence or intersection of the mountain and valley folds with the crease (10) on the right side of the sheet is the pivot point (30). Longitudinal mountain folds on the left side of the sheet (158 and 160) and longitudinal mountain folds on the right side of the sheet (162 and 164) represent the folds required to give the sides of the backdrop a reinforced structure. The distance between the folds and between the folds and the nearest edge is variable and dependent on the type and thickness of the material used. Arrows using standard origami diagramming symbols (170 and 172) depict the action needed to fold the edges upon themselves along the mountain folds.

Figures 46, 46A:
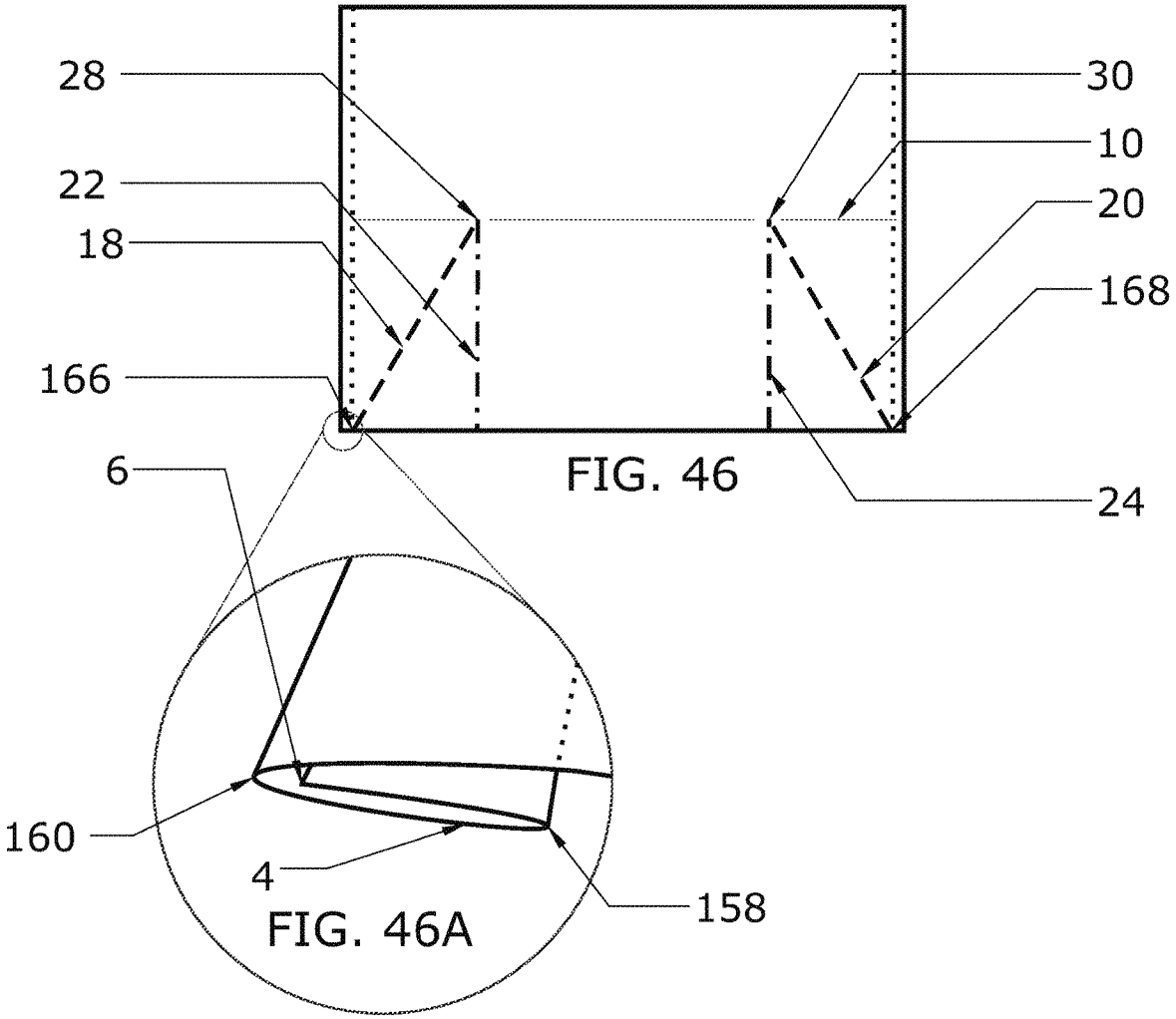
FIG. 46 is a top plan view of FIG. 45 that shows the result of the previous two folds.
FIG. 46A is an isometric view close-up representation of one of the resulting overlapping edges of FIG. 46.

FIG. 46 is a top plan view of FIG. 45 that shows the result of the previous two folds, with an isometric view close-up representation of one of the resulting overlapping edges (FIG. 46A).

Figure 47:
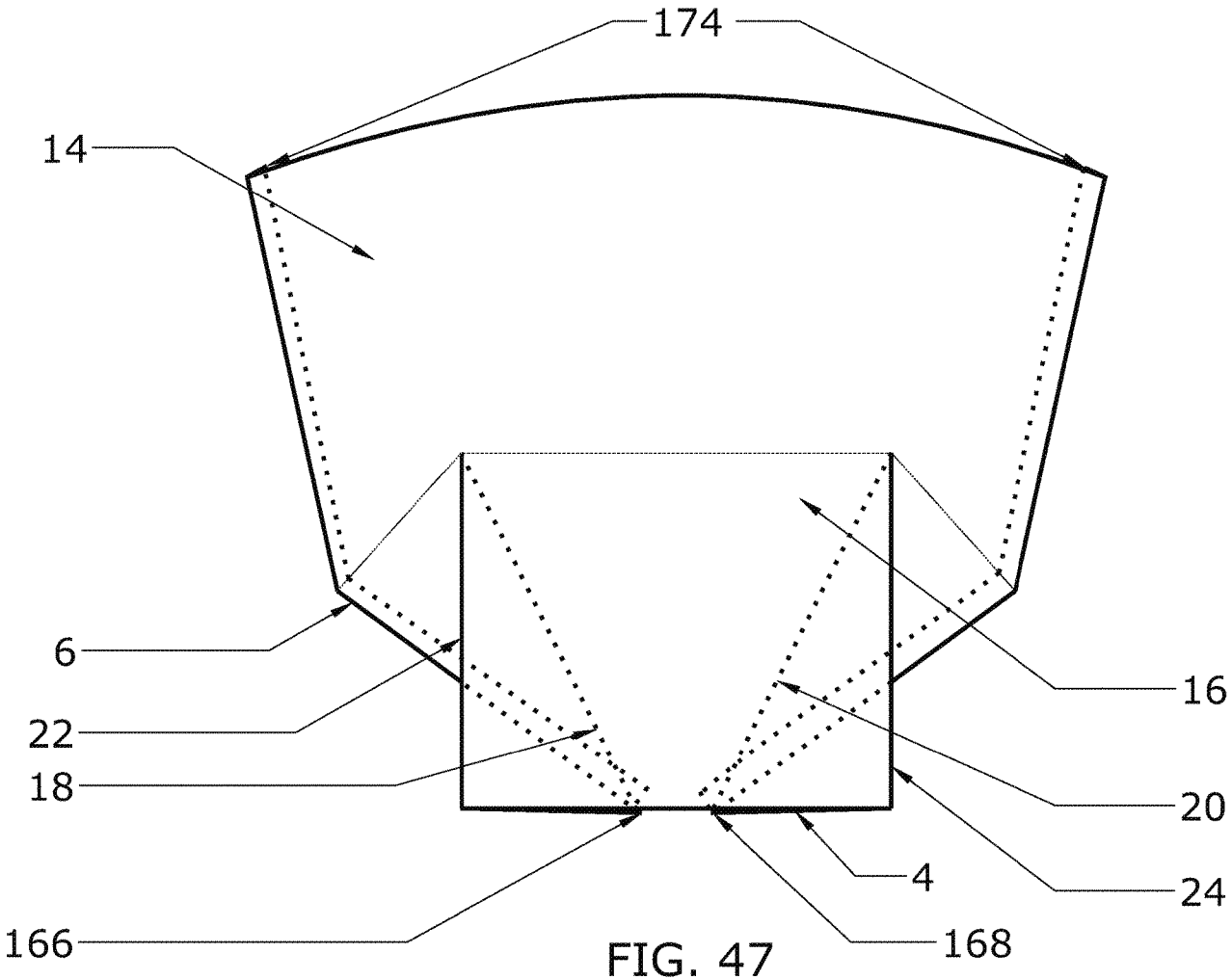
FIG. 47 is a perspective view of the embodiment of strengthened or reinforced vertical sides resulting from the folds of FIGS. 45, 46 and 46A.

FIG. 47 is an isometric view of the completed backdrop showing the result of the previous step and the 'reinforced' sides (174)

Operation:

FIG. 1 In a typical embodiment of the folding process, begin with a single sheet of suitable material.

FIG. 2 Valley-fold the sheet through the centre (10). To do this, lift the bottom edge (4) of the sheet to match the top edge (2) of the sheet and press the sheet flat to create a crease along the fold (10). Unfold the sheet.

FIG. 3 Decide how far from the right edge (8) to place the pivot point (30) along the crease you just made (10). In this embodiment, fold a mountain fold (24) perpendicular to the crease (10) by folding the edge with the crease back behind itself until you have folded twice as far as your chosen pivot point (30). Then flatten the sheet to form the mountain fold, being mindful of not creasing above the crease line (10). Doing so will result in a "panelled" backdrop (see additional embodiments in the Variations section below) and not a "curved" backdrop. To form the mountain fold, it is often easier to turn the material over and create a valley fold instead. The result will be a mountain fold when you turn the material back to its proper orientation. Unfold the mountain fold. Now that the mountain fold (24) is in place, fold and unfold a valley fold (20) from the pivot point (30) which is the confluence of the crease (10) and the mountain fold (24)

to the bottom corner of the sheet (34). Repeat on the right side to create the mountain fold (22) and the valley fold (18) from the pivot point (28).

FIG. 4 Push the edge (8) of the sheet underneath, allowing the folds you created to naturally bend the sheet unto itself. This folding placement and action creates a tension in the paper that will force the top edge of the sheet to lift up into a vertical position perpendicular to the "base" or bottom half of the sheet (16).

FIG. 5 Continue to push the right edge (8) of the backdrop until the folds lie flat. In this case, because the mountain fold was perpendicular to the bottom edge, the bottom edge (4) is folded back upon itself and its edges meet. Repeat the same action on the left using the mirror-image folds.

FIG. 6 Continue to push the left edge (6) of the backdrop until the folds lie flat. The backdrop is complete and is in a state ready to be used.

FIG. 7 If the base is felt to have too much depth for the item being displayed, the depth of the base can lessened by mountain-folding a portion of the base underneath the backdrop as shown in the diagram. This optional fold (38) will also have the effect of "locking" the front of the base and will provide enhanced stability. The placement of the mountain fold is variable according to the folder's aesthetic sensibilities.

FIGS. 8-10 show the completed backdrop.

Variations:

In an additional embodiment of the folding process, it is possible to create an 'extended' three-dimensional backdrop of the foldable backdrop that has a greater width than just one sheet of material. This is accomplished by first joining or linking two sheets of material along one side and then applying the folding process previously disclosed.

FIG. 13 Lay two sheets of material together and valley-fold (60) them along one edge. If the sheets have imagery printed on them, the bottom sheet will have the imagery facing up and the top sheet will have the imagery facing down. The imagery on the sheets may be laid out so as to repeat in the area of the sheets that will be linked. This will help to visually "hide" the seam between the sheets that will be created as the resulting imagery will be continuous.

FIG. 14 Valley-fold (64) the top sheet only along the folded edge. This spreads the whole of the material out to be nearly twice as wide as a single sheet (less the amount folded). Firmly flatten the overlapping sheets along the entire length of the seam.

FIG. 15 demonstrates the result of the folds so far. The inset shows a close-up isometric view of how the sheets in the join have been folded.

FIG. 16 shows how to "lock" the bottom edge of the backdrop at the join by valley-folding (68) all of the overlapping layers. On a 45 degree angle from the perpendicular edge of the seam, fold all the layers underneath the top sheet (48) and press flat. The pressure of the top sheet will keep the folded layers in place. Repeat the same folding procedure in a mirrored placement on the top edge of the backdrop at the join to "lock" the seam at that point.

Referring to FIG. 17, the folds disclosed as the folding process are shown. Note the asymmetrical placement of the left pivot point (28) and the right pivot point (30) and valley folds (18) and (20). This will result in a backdrop with variably curved sides: slightly curved on the left and severely curved on the right.

FIG. 18 Create the mountain and valley folds and push the edges of the paper (6) and (8) toward the centre and underneath the bottom half (16) of the backdrop. Allow the top half of the backdrop (14) to naturally be forced into its vertical state in perpendicular alignment with the "base" or bottom half of the backdrop (16).

Referring to FIG. 19, the slight dotted lines are x-ray lines that show the final placement of the material behind the base of the backdrop. Mountain-fold (38) a portion of the base underneath the backdrop as shown in the diagram. This optional fold will also have the effect of "locking" the front of the base and will provide enhanced stability. The placement of the mountain fold is variable according to the folder's aesthetic sensibilities.

FIG. 20 shows the completed backdrop. Note how the 45 degree angle in FIG. 17 becomes a 90 degree angle in the finished backdrop and FIG. 21 shows an isometric view of the finished "extended" backdrop.

FIG. 22 In an additional embodiment of the folding process, a "panelled" backdrop is disclosed. Thus far it has been shown that the top half of the sheet is not creased and forms a continuously curved vertical plane. In this embodiment, the vertical portion of the foldable backdrop (the portion of the sheet above the centre line crease (10)) is creased using valley folds (72) and (74) to form three segments or panels (76), (77) and (78). The regular folding process is applied to the lower portion of the sheet, namely on the left side of the sheet, create the mountain fold (22) and the valley fold (18) from the pivot point (28) to the bottom corner of the sheet (32). Repeat on the right side to create the mountain fold (24) and the valley fold (20) from the pivot point (30) to the bottom corner of the sheet (34).

FIG. 23 shows the completed backdrop with the folding process applied. Note that the vertical portion of the backdrop has three creased, conjoined sections or "panels". The slight dotted lines are x-ray lines that show the final placement of the material behind the base of the backdrop. An optional mountain (38) fold across a portion of the base indicates folding that portion of the base underneath the backdrop. This optional fold will also have the effect of "locking" the front of the base and will provide enhanced stability. The placement of the mountain fold is variable according to the folder's aesthetic sensibilities.

FIG. 24 shows the completed foldable backdrop with a "panelled" vertical plane (14).

In an additional embodiment of the folding process, a "raised base" variation of the foldable backdrop is disclosed. Using the folding process previously disclosed and additional folding techniques applied to a single sheet of material, a foldable backdrop with a base that has been elevated by a uniform amount is disclosed.

FIG. 25 Mountain-fold (88) the sheet of material.

FIG. 26 Valley-fold (90) the top portion of the sheet. The placement of the valley fold should be approximately ⅛ of the distance (D). The placement of the valley fold governs the eventual height of the raised base (94).

FIG. 27 shows the result of the previous step. Turn the entire backdrop over.

FIG. 28 Fold and unfold the mountain folds (22) and (24) and the valley folds (18) and (20). The placement of the pivot points (28) and (30), inset from the outside edge of the backdrop, must be three times the height set in FIG. 26, shown here as D' (94).

FIG. 29 Flip the top portion (14) of the sheet down, allowing the back portion of the material (shown by the dotted x-ray line (90)) to flip up as the top portion flips down.

FIG. 30 The result of the previous step is shown. Turn the entire backdrop over. The portion of the sheet that was underneath (16) will be on top.

FIG. 31 Valley-fold the corners (108) and (110).

FIG. 32 Valley-fold the corners again (112) and (114). This will "lock" the layers of the corners together.

FIG. 34 Valley-fold the top portion of the material (16) up and press the sheet flat at the "locked" corners. Rotate the entire backdrop 180 degrees.

FIG. 35 Apply the folds of the folding process that you previously creased in FIG. 28.

FIG. 36 Continue pushing the side edges (6) and (8) in, allowing the lower corners to swing up and flat against the bottom edge of the backdrop. The backdrop becomes three-dimensional as the vertical plane (14) is forced into position perpendicular to the base (16).

FIG. 37 shows the completed folds. Turn the entire backdrop over.

FIG. 38 shows a bottom view of the backdrop. Fold a valley fold (130) and (132) and a mountain fold (134) and (136) on the flap on each side of the backdrop. The folds trisect the flap. The distance between the lines is the same distance referenced in FIG. 28 and shown here as D' (94).

FIG. 39 Valley-fold (142) the entire bottom edge. The distance between the valley fold and the bottom edge of the backdrop (4) is also the same distance referenced in FIG. 38 and shown here as D' (94). Unfold the valley fold (142).

FIG. 40 On the left side, using the creased valley fold (130) from the previous step, lift the outside portion of the folded flap (134) so that the flap is perpendicular to the base. Valley-fold (146) the corner. This will cause the base to become three-dimensional and will lift the left "leg" of the base into position. Repeat on the other side: using the creased valley fold (132) from the previous step, lift the outside portion of the folded flap (136) so that the flap is perpendicular to the base. Valley-fold (148) the corner.

FIG. 41 shows the result of the previous step as an isometric view showing the model upside down.

FIG. 42 Mountain-fold (152) and (154) the front corners (138) and (140) to "lock" the front outside corners of the base. Turn the entire backdrop over.

FIG. 43 The completed "raised base" variation of the foldable backdrop.

In an additional embodiment of the folding process, it is possible to create a three-dimensional backdrop that has strengthened or reinforced sides. This is accomplished by first folding the edges of the sheet of material along two sides and then applying the folding process previously disclosed.

Referring to FIG. 45, mountain-fold (158, 160, 162 and 164) each of the side edges.

Referring to FIG. 46, the regular folding process is applied to the lower portion of the sheet, namely on the left side of the sheet, create the mountain fold (22) and the valley fold (18) from the pivot point (28) to the bottom edge of the sheet (166). Repeat on the right side to create the mountain fold (24) and the valley fold (20) from the pivot point (30) to the bottom edge of the sheet (168).

Referring to FIG. 47, there is illustrated the completed "reinforced" variation of the foldable backdrop.

The process can be applied to any stiff, foldable material like paper, card stock, cardboard, plastic sheeting, sheet metal and the like. The process of folding is such that, when applied to a sheet of material (printed with imagery on one or both sides or otherwise), part of the sheet is forced into a vertical and perpendicular alignment with the rest of the sheet, the resultant tension in the material forming a curved (or angled depending on the folds used) backdrop or background. The sheet of material does not have to have square corners. The resulting free-standing backdrop is intended to be used to enhance the static display of other items such as building brick models, model vehicles, figurines, toys, etc. Using folding alone is a vast improvement on existing prior art that uses tabs and slots or glue to create and maintain the position of the vertical surface.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A Foldable Backdrop, comprising:

a centrally positioned crease horizontally across a single sheet of foldable material selected for the backdrop, the sheet having a top edge, a bottom edge, a first side edge and a second side edge, the crease symmetrically dividing the sheet into a top half and a bottom half;

a first mountain fold in the bottom half of the sheet spaced from the first side edge, the first mountain fold extending from the bottom edge to the crease;

a second mountain fold in the bottom half of the sheet spaced from the second side edge, the second mountain fold extending from the bottom edge to the crease;

a first valley fold from a first pivot point at the confluence of the crease and the first mountain fold to one of a first side edge, a bottom edge spaced inwardly from the first side edge or a first bottom corner of the sheet where the first side edge meets the bottom edge;

a second valley fold from a second pivot point at the confluence of the crease and the second mountain fold to one of a second side edge, a bottom edge spaced inwardly from the second side edge or a second bottom corner of the sheet where the second side edge meets the bottom edge;

the first bottom corner of the sheet being positioned under the first mountain fold and the second bottom corner of the sheet being positioned under the second mountain fold to form a base, whereby a tension in the sheet will force the top half of the sheet into a vertical position perpendicular to the base.

2. The foldable backdrop of claim 1, wherein the first mountain fold and the second mountain fold are perpendicular to the crease.

3. The foldable backdrop of claim 1, wherein the first valley fold extends from the first pivot point to the first bottom corner and the second valley fold extends from the second pivot point to the second bottom corner.

4. The foldable backdrop of claim 1, wherein the first valley fold extends from the first pivot point to the first side edge and the second valley fold extends from the second pivot point to the second side edge.

5. The foldable backdrop of claim 1, wherein the first valley fold extends from the first pivot point to the bottom edge spaced inwardly from the first side edge and the second valley fold extends from the second pivot point to the bottom edge spaced inwardly from second side edge.

6. The foldable back drop of claim 1, wherein the top half of the sheet is linked to a top half of another sheet by an interlocking fold positioned along one of the first side edge or the second side edge.

7. The foldable backdrop of claim 1, wherein a depth of the base is lessened by mountain-folding a portion of the base underneath.

8. The foldable backdrop of claim 1, wherein a valley fold extends from the first mountain fold across the top half of the sheet to the top edge and an additional valley fold extends from the second mountain fold across the top half of the sheet to the top edge to define backdrop panels.

9. The foldable backdrop of claim 1, wherein the base has depending legs.

10. A method of forming a foldable backdrop comprising:

forming a centrally positioned crease horizontally across a single sheet of foldable material selected for the backdrop, the sheet having a top edge, a bottom edge, a first side edge and a second side edge, the crease symmetrically dividing the sheet into a top half and a bottom half;

forming a first mountain fold in the bottom half of the sheet spaced from the first side edge, the first mountain fold extending from the bottom edge to the crease;

forming a second mountain fold in the bottom half of the sheet spaced from the second side edge, the second mountain fold extending from the bottom edge to the crease;

forming a first valley fold from a first pivot point at the confluence of the crease and the first mountain fold to one of a first side edge, a bottom edge spaced inwardly from the first side edge or a first bottom corner of the sheet where the first side edge meets the bottom edge;

forming a second valley fold from a second pivot point at the confluence of the crease and the second mountain fold to one of a second side edge, a bottom edge spaced inwardly from the second side edge or a second bottom corner of the sheet where the second side edge meets the bottom edge;

pushing the first bottom corner of the sheet under the first mountain fold and pushing the second bottom corner of the sheet under the second mountain fold to form a base, whereby a tension in the sheet will force the top half of the sheet into a vertical position perpendicular to the base.

11. The method of claim 10, wherein the first mountain fold and the second mountain fold are perpendicular to the crease.

12. The method of claim 10, wherein the first valley fold extends from the first pivot point to the first bottom corner and the second valley fold extends from the second pivot point to the second bottom corner.

13. The method of claim 10, wherein the first valley fold extends from the first pivot point to the first side edge and the second valley fold extends from the second pivot point to the second side edge.

14. The method of claim 10, wherein the first valley fold extends from the first pivot point to the bottom edge spaced inwardly from the first side edge and the second valley fold extends from the second pivot point to the bottom edge spaced inwardly from second side edge.

15. The method of claim 10, wherein one sheet is linked to another sheet by an interlocking fold positioned along one of the first side edge or the second side edge.

16. The method of claim 10, wherein a depth of the base is lessened by mountain-folding a portion of the base underneath.

17. The method of claim 10, wherein a valley fold extends from the first mountain fold across the top half of the sheet to the top edge and an additional valley fold extends from the second mountain fold across the top half of the sheet to the top edge to define backdrop panels.

18. The method of claim 10, wherein the base has depending legs.

19. The method of claim 10 wherein the edges of the sheet of material are folded along two sides to reinforce the sides prior to forming the first mountain fold, the second mountain fold, the first valley fold and the second valley fold.

* * * * *